US008230929B2

(12) United States Patent
Kaminsky et al.

(10) Patent No.: US 8,230,929 B2
(45) Date of Patent: Jul. 31, 2012

(54) METHODS OF PRODUCING HYDROCARBONS FOR SUBSTANTIALLY CONSTANT COMPOSITION GAS GENERATION

(75) Inventors: Robert D Kaminsky, Houston, TX (US); William A Symington, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 273 days.

(21) Appl. No.: 12/405,901

(22) Filed: Mar. 17, 2009

(65) Prior Publication Data

US 2009/0308608 A1 Dec. 17, 2009

Related U.S. Application Data

(60) Provisional application No. 61/128,664, filed on May 23, 2008.

(51) Int. Cl.
*E21B 43/12* (2006.01)
*E21B 43/24* (2006.01)

(52) U.S. Cl. ..... 166/369; 166/261; 166/250.15; 166/402

(58) Field of Classification Search ..... 166/250.15, 166/250.07, 268, 402, 305.1, 369, 266, 261; 208/370

See application file for complete search history.

(56) References Cited

U.S. PATENT DOCUMENTS 363,419 A 5/1887 Poetsch
895,612 A 8/1908 Baker
1,342,780 A 6/1920 Vedder
1,422,204 A 7/1922 Hoover et al.
1,666,488 A 4/1928 Crawshaw
1,701,884 A 2/1929 Hogle
1,872,906 A 8/1932 Doherty
2,033,560 A 3/1936 Wells ..... 166/1

(Continued)

FOREIGN PATENT DOCUMENTS

CA 994694 8/1976

(Continued)

OTHER PUBLICATIONS

Allred, (1964) "Some Characteristic Properties of Colorado Oil Shale Which May Influence In Situ Processing," *Quarterly Colo. School of Mines, 1st Symposium Oil Shale*, v.59. No. 3, pp. 47-75.

(Continued)

*Primary Examiner* — William P Neuder
*Assistant Examiner* — Catherine Loikith
(74) *Attorney, Agent, or Firm* — ExxonMobil Upstream Research Company-Law Department

(57) ABSTRACT

A method for producing hydrocarbon fluids from an organic-rich rock formation to a surface facility is provided. The method may include heating the formation in situ to cause pyrolysis of formation hydrocarbons, and producing production fluids from the formation via two or more wells. The produced fluids have been at least partially generated as a result of pyrolysis of the formation hydrocarbons. In addition, the produced fluids comprise non-condensable fluids, or gases, which taken together have an averaged Wobbe Index which varies at a rate of more than 5% over a period of time. The method also includes controlling production from one or more of the wells such that a combination of the production fluids from the wells results in a combined gas stream that's averaged Wobbe Index varies at a rate of less than 5% over the period of time. The combined stream comprises combustible hydrocarbon fluids.

40 Claims, 13 Drawing Sheets

U.S. PATENT DOCUMENTS

| | | | | |
|---|---|---|---|---|
| 2,033,561 | A | 3/1936 | Wells | 166/21 |
| 2,534,737 | A | 12/1950 | Rose | |
| 2,584,605 | A | 2/1952 | Merriam et al. | |
| 2,634,961 | A | 4/1953 | Ljungstrom | 262/3 |
| 2,732,195 | A | 1/1956 | Ljungstrom | 262/3 |
| 2,777,679 | A | 1/1957 | Ljungstrom | 262/3 |
| 2,780,450 | A | 2/1957 | Ljungstrom | 262/3 |
| 2,795,279 | A | 6/1957 | Sarapuu | |
| 2,812,160 | A | 11/1957 | West et al. | 255/1.4 |
| 2,813,583 | A | 11/1957 | Marx et al. | |
| 2,847,071 | A | 8/1958 | De Priester | 166/39 |
| 2,887,160 | A | 5/1959 | De Priester et al. | 166/59 |
| 2,895,555 | A | 7/1959 | De Priester | 166/59 |
| 2,923,535 | A | 2/1960 | Ljungstrom | 262/3 |
| 2,944,803 | A | 7/1960 | Hanson | 262/3 |
| 2,952,450 | A | 9/1960 | Purre | 262/3 |
| 2,974,937 | A | 3/1961 | Kiel | |
| 3,004,601 | A | 10/1961 | Bodine | 166/39 |
| 3,013,609 | A | 12/1961 | Brink | 166/39 |
| 3,095,031 | A | 6/1963 | Eurenius et al. | 158/99 |
| 3,106,244 | A | 10/1963 | Parker | |
| 3,109,482 | A | 11/1963 | O'Brien | 158/115 |
| 3,127,936 | A | 4/1964 | Eurenius | 166/39 |
| 3,137,347 | A | 6/1964 | Parker | 166/39 |
| 3,149,672 | A | 9/1964 | Orkiszewski et al. | 166/39 |
| 3,170,815 | A | 2/1965 | White | |
| 3,180,411 | A | 4/1965 | Parker | 166/11 |
| 3,183,675 | A | 5/1965 | Schroeder | 61/36 |
| 3,183,971 | A | 5/1965 | McEver et al. | |
| 3,194,315 | A | 7/1965 | Rogers | 166/57 |
| 3,205,942 | A | 9/1965 | Sandberg | |
| 3,225,829 | A | 12/1965 | Chown et al. | 166/59 |
| 3,228,869 | A | 1/1966 | Irish | |
| 3,241,611 | A | 3/1966 | Dougan | 166/7 |
| 3,241,615 | A | 3/1966 | Brandt et al. | 166/59 |
| 3,254,721 | A | 6/1966 | Smith et al. | 166/59 |
| 3,256,935 | A | 6/1966 | Nabor et al. | 166/9 |
| 3,263,211 | A | 7/1966 | Heidman | |
| 3,267,680 | A | 8/1966 | Schlumberger | 61/36 |
| 3,271,962 | A | 9/1966 | Dahms et al. | 61/36 |
| 3,284,281 | A | 11/1966 | Thomas | 166/2 |
| 3,285,335 | A | 11/1966 | Reistle, Jr. | |
| 3,288,648 | A | 11/1966 | Jones | |
| 3,294,167 | A | 12/1966 | Vogel | 166/11 |
| 3,295,328 | A | 1/1967 | Bishop | 61/0.5 |
| 3,323,840 | A | 6/1967 | Mason et al. | |
| 3,358,756 | A | 12/1967 | Vogel | |
| 3,372,550 | A | 3/1968 | Schroeder | 61/36 |
| 3,376,403 | A | 4/1968 | Mircea | 219/10.49 |
| 3,382,922 | A | 5/1968 | Needham | |
| 3,400,762 | A | 9/1968 | Peacock et al. | 166/11 |
| 3,436,919 | A | 4/1969 | Shock et al. | 61/0.5 |
| 3,439,744 | A | 4/1969 | Bradley | |
| 3,468,376 | A | 9/1969 | Slusser et al. | 166/272 |
| 3,500,913 | A | 3/1970 | Nordgren et al. | 166/259 |
| 3,501,201 | A | 3/1970 | Closmann et al. | 299/4 |
| 3,502,372 | A | 3/1970 | Prats | |
| 3,513,914 | A | 5/1970 | Vogel | 166/271 |
| 3,515,213 | A | 6/1970 | Prats | |
| 3,516,495 | A | 6/1970 | Patton | |
| 3,521,709 | A | 7/1970 | Needham | |
| 3,528,252 | A | 9/1970 | Gail | 61/36 |
| 3,528,501 | A | 9/1970 | Parker | |
| 3,547,193 | A | 12/1970 | Gill | |
| 3,559,737 | A | 2/1971 | Ralstin et al. | 166/281 |
| 3,572,838 | A | 3/1971 | Templeton | |
| 3,599,714 | A | 8/1971 | Messman | 166/258 |
| 3,602,310 | A | 8/1971 | Halbert | 166/303 |
| 3,613,785 | A | 10/1971 | Closmann et al. | 166/271 |
| 3,620,300 | A | 11/1971 | Crowson | 166/248 |
| 3,642,066 | A | 2/1972 | Gill | 166/248 |
| 3,661,423 | A | 5/1972 | Garret | |
| 3,692,111 | A | 9/1972 | Breithaupt et al. | 166/252 |
| 3,695,354 | A | 10/1972 | Dilgren et al. | |
| 3,700,280 | A | 10/1972 | Papadopoulos et al. | |
| 3,724,225 | A | 4/1973 | Mancini et al. | 62/12 |
| 3,730,270 | A | 5/1973 | Allred | |
| 3,739,851 | A | 6/1973 | Beard | |
| 3,741,306 | A | 6/1973 | Papadopoulos | 166/252 |
| 3,759,328 | A | 9/1973 | Ueber et al. | |
| 3,759,329 | A | 9/1973 | Ross | 166/308.1 |
| 3,759,574 | A | 9/1973 | Beard | |
| 3,779,601 | A | 12/1973 | Beard | |
| 3,880,238 | A | 4/1975 | Tham et al. | |
| 3,882,937 | A | 5/1975 | Robinson | 166/267 |
| 3,882,941 | A | 5/1975 | Pelofsky | |
| 3,888,307 | A | 6/1975 | Closmann | |
| 3,924,680 | A | 12/1975 | Terry | |
| 3,943,722 | A | 3/1976 | Ross | 61/36 |
| 3,950,029 | A | 4/1976 | Timmins | 299/2 |
| 3,958,636 | A | 5/1976 | Perkins | |
| 3,967,853 | A | 7/1976 | Closmann et al. | |
| 3,978,920 | A | 9/1976 | Badyopadhyay | 166/258 |
| 3,999,607 | A | 12/1976 | Pennington et al. | |
| 4,003,432 | A | 1/1977 | Paull et al. | 166/271 |
| 4,005,750 | A | 2/1977 | Shuck | 166/308 |
| 4,007,786 | A | 2/1977 | Schlinger | |
| 4,008,762 | A | 2/1977 | Fisher et al. | |
| 4,008,769 | A | 2/1977 | Chang | |
| 4,014,575 | A | 3/1977 | French et al. | |
| 4,030,549 | A | 6/1977 | Bouck | 166/280 |
| 4,037,655 | A | 7/1977 | Carpenter | |
| 4,043,393 | A | 8/1977 | Fisher et al. | |
| 4,047,760 | A | 9/1977 | Ridley | |
| 4,057,510 | A | 11/1977 | Crouch et al. | |
| 4,065,183 | A | 12/1977 | Hill et al. | |
| 4,067,390 | A | 1/1978 | Camacho et al. | 166/302 |
| 4,069,868 | A | 1/1978 | Terry | |
| 4,071,278 | A | 1/1978 | Carpenter et al. | 299/5 |
| 4,093,025 | A | 6/1978 | Terry | |
| 4,096,034 | A | 6/1978 | Anthony | |
| 4,125,159 | A | 11/1978 | Vann | 166/285 |
| 4,140,180 | A | 2/1979 | Bridges et al. | 166/248 |
| 4,149,595 | A | 4/1979 | Cha | |
| 4,160,479 | A | 7/1979 | Richardson et al. | |
| 4,163,475 | A | 8/1979 | Cha et al. | |
| 4,167,291 | A | 9/1979 | Ridley | |
| 4,169,506 | A | 10/1979 | Berry | |
| 4,185,693 | A | 1/1980 | Crumb et al. | |
| 4,186,801 | A | 2/1980 | Madgavkar et al. | |
| 4,202,168 | A | 5/1980 | Acheson et al. | |
| 4,239,283 | A | 12/1980 | Ridley | 299/2 |
| 4,246,966 | A | 1/1981 | Stoddard et al. | |
| 4,250,230 | A | 2/1981 | Terry | |
| 4,265,310 | A | 5/1981 | Britton et al. | 166/259 |
| 4,271,905 | A | 6/1981 | Redford et al. | |
| 4,272,127 | A | 6/1981 | Hutchins | 299/2 |
| 4,285,401 | A | 8/1981 | Erickson | |
| 4,318,723 | A | 3/1982 | Holmes et al. | |
| 4,319,635 | A | 3/1982 | Jones | 166/263 |
| 4,320,801 | A | 3/1982 | Rowland et al. | 166/248 |
| 4,324,291 | A | 4/1982 | Wong et al. | |
| 4,340,934 | A | 7/1982 | Segesman | |
| 4,344,485 | A | 8/1982 | Butler | |
| 4,358,222 | A | 11/1982 | Landau | 405/130 |
| 4,362,213 | A | 12/1982 | Tabor | |
| 4,368,921 | A | 1/1983 | Hutchins | 299/2 |
| 4,369,842 | A | 1/1983 | Cha | |
| 4,372,615 | A | 2/1983 | Ricketts | 299/2 |
| 4,375,302 | A | 3/1983 | Kalmar | |
| 4,384,614 | A | 5/1983 | Justheim | |
| 4,397,502 | A | 8/1983 | Hines | 299/2 |
| 4,401,162 | A | 8/1983 | Osborne | 166/248 |
| 4,412,585 | A | 11/1983 | Bouck | 166/248 |
| 4,417,449 | A | 11/1983 | Hegarty et al. | |
| 4,473,114 | A | 9/1984 | Bell et al. | |
| 4,474,238 | A | 10/1984 | Gentry et al. | 166/268 |
| 4,483,398 | A | 11/1984 | Peters et al. | |
| 4,485,869 | A | 12/1984 | Sresty et al. | 166/248 |
| 4,487,257 | A | 12/1984 | Dauphine | 166/60 |
| 4,487,260 | A | 12/1984 | Pittman et al. | 166/259 |
| 4,511,382 | A | 4/1985 | Valencia et al. | 62/20 |
| 4,533,372 | A | 8/1985 | Valencia et al. | 62/12 |
| 4,537,067 | A | 8/1985 | Sharp et al. | |
| 4,545,435 | A | 10/1985 | Bridges et al. | |
| 4,546,829 | A | 10/1985 | Martin et al. | |
| 4,550,779 | A | 11/1985 | Zakiewicz | 166/248 |

4,567,945 A 2/1986 Segalman ..... 166/248
4,589,491 A 5/1986 Perkins ..... 166/302
4,589,973 A 5/1986 Minden
4,602,144 A 7/1986 Vogel
4,607,488 A 8/1986 Karinthi et al. ..... 62/45
4,626,665 A 12/1986 Fort ..... 219/534
4,633,948 A 1/1987 Closmann
4,634,315 A 1/1987 Owen et al. ..... 405/217
4,637,464 A 1/1987 Forgac et al.
4,640,352 A 2/1987 Vanmeurs et al. ..... 166/245
4,671,863 A 6/1987 Tejeda
4,694,907 A 9/1987 Stahl et al. ..... 166/303
4,704,514 A 11/1987 Van Egmond et al. ..... 219/278
4,705,108 A 11/1987 Little et al. ..... 166/248
4,706,751 A 11/1987 Gondouin
4,730,671 A 3/1988 Perkins
4,737,267 A 4/1988 Pao et al.
4,747,642 A 5/1988 Gash et al. ..... 299/11
4,754,808 A 7/1988 Harmon et al. ..... 166/254
4,776,638 A 10/1988 Hahn
4,779,680 A 10/1988 Sydansk
4,815,790 A 3/1989 Rosar et al.
4,817,711 A 4/1989 Jeambey
4,828,031 A 5/1989 Davis
4,860,544 A 8/1989 Krieg et al. ..... 62/45
4,886,118 A 12/1989 Van Meurs et al. ..... 166/245
4,923,493 A 5/1990 Valencia et al. ..... 62/13
4,926,941 A 5/1990 Glandt et al. ..... 166/248
4,928,765 A 5/1990 Nielson
4,929,341 A 5/1990 Thirumalachar et al.
4,974,425 A 12/1990 Krieg et al. ..... 62/45.1
5,016,709 A 5/1991 Combe et al. ..... 166/245
5,036,918 A 8/1991 Jennings et al.
5,050,386 A 9/1991 Krieg et al. ..... 62/45.1
5,055,030 A 10/1991 Schirmer
5,055,180 A 10/1991 Klaila
5,082,055 A 1/1992 Hemsath
5,085,276 A 2/1992 Rivas et al.
5,117,908 A 6/1992 Hofmann
5,120,338 A 6/1992 Potts, Jr. et al. ..... 62/12
5,217,076 A 6/1993 Masek
5,236,039 A 8/1993 Edelstein
5,255,742 A 10/1993 Mikus ..... 166/303
5,275,063 A 1/1994 Steiger et al.
5,297,626 A 3/1994 Vinegar et al. ..... 166/271
5,305,829 A 4/1994 Kumar ..... 166/245
5,372,708 A 12/1994 Gewertz
5,377,756 A 1/1995 Northrop et al.
5,392,854 A 2/1995 Vinegar et al. ..... 166/271
5,411,089 A 5/1995 Vinegar et al. ..... 166/272
5,416,257 A 5/1995 Peters ..... 588/1
5,620,049 A 4/1997 Gipson et al. ..... 166/248
5,621,844 A 4/1997 Bridges
5,661,977 A 9/1997 Shnell
5,730,550 A 3/1998 Andersland et al. ..... 405/128
5,838,634 A 11/1998 Jones et al.
5,844,799 A 12/1998 Joseph et al.
5,868,202 A 2/1999 Hsu
5,899,269 A 5/1999 Wellington et al. ..... 166/58
5,905,657 A 5/1999 Celniker
5,907,662 A 5/1999 Buettner
5,956,971 A 9/1999 Cole et al. ..... 62/623
6,015,015 A 1/2000 Luft et al.
6,016,867 A 1/2000 Gregoli et al.
6,023,554 A 2/2000 Vinegar et al. ..... 392/301
6,055,803 A 5/2000 Mastronarde et al.
6,056,057 A 5/2000 Vinegar et al.
6,079,499 A 6/2000 Mikus et al.
6,148,911 A 11/2000 Gipson et al. ..... 166/248
6,158,517 A 12/2000 Hsu
6,246,963 B1 6/2001 Cross et al.
6,247,358 B1 6/2001 Dos Santos
6,328,104 B1 12/2001 Graue
6,434,435 B1 8/2002 Tubel et al.
6,480,790 B1 11/2002 Calvert et al.
6,540,018 B1 4/2003 Vinegar et al.
6,581,684 B2 6/2003 Wellington et al. ..... 166/245
6,585,046 B2 7/2003 Neuroth et al.
6,589,303 B1 7/2003 Lokhandwale et al.
6,591,906 B2 7/2003 Wellington et al.
6,607,036 B2 8/2003 Ranson et al. ..... 166/302
6,609,761 B1 8/2003 Ramey et al.
6,668,922 B2 12/2003 Ziauddin et al.
6,684,644 B2 2/2004 Mittricker et al. ..... 60/772
6,684,948 B1 2/2004 Savage
6,708,758 B2 3/2004 de Rouffignac et al. ..... 166/245
6,709,573 B2 3/2004 Smith
6,712,136 B2 3/2004 de Rouffignac et al. ..... 166/245
6,715,546 B2 4/2004 Vinegar et al.
6,722,429 B2 4/2004 de Rouffignac et al. ..... 166/245
6,742,588 B2 6/2004 Wellington et al. ..... 166/245
6,745,831 B2 6/2004 Fowler et al.
6,745,832 B2 6/2004 Wellington et al. ..... 166/245
6,752,210 B2 6/2004 de Rouffignac et al.
6,754,588 B2 6/2004 Cross et al.
6,764,108 B2 7/2004 Ernst et al.
6,782,947 B2 8/2004 de Rouffignac et al. ..... 166/245
6,796,139 B2 9/2004 Briley et al. ..... 62/260
6,820,689 B2 11/2004 Sarada
6,832,485 B2 12/2004 Sugarmen et al.
6,854,929 B2 2/2005 Vinegar et al. ..... 405/129.65
6,858,049 B2 2/2005 Mittricker ..... 48/127.7
6,877,555 B2 * 4/2005 Karanikas et al. ..... 166/245
6,880,633 B2 4/2005 Wellington et al. ..... 166/245
6,887,369 B2 5/2005 Moulton et al. ..... 208/107
6,896,053 B2 5/2005 Berchenko et al. ..... 166/245
6,896,707 B2 5/2005 O'Rear et al.
6,913,078 B2 7/2005 Shahin et al. ..... 166/245
6,918,444 B2 7/2005 Passey et al. ..... 166/258
6,923,258 B2 8/2005 Wellington et al. ..... 166/245
6,932,155 B2 8/2005 Vinegar et al.
6,948,562 B2 9/2005 Wellington et al. ..... 166/272.1
6,951,247 B2 10/2005 de Rouffignac et al.
6,953,087 B2 10/2005 de Rouffignac et al. ..... 166/245
6,964,300 B2 11/2005 Vinegar et al. ..... 166/245
6,969,123 B2 11/2005 Vinegar et al. ..... 299/3
6,988,549 B1 1/2006 Babcock
6,994,160 B2 2/2006 Wellington et al.
6,997,518 B2 2/2006 Vinegar et al.
7,001,519 B2 2/2006 Linden et al.
7,004,247 B2 2/2006 Cole et al.
7,004,251 B2 2/2006 Ward et al.
7,011,154 B2 3/2006 Maher et al. ..... 166/245
7,032,660 B2 4/2006 Vinegar et al. ..... 166/245
7,036,583 B2 5/2006 de Rouffignac et al. ..... 166/245
7,048,051 B2 5/2006 McQueen
7,051,807 B2 5/2006 Vinegar et al.
7,055,600 B2 6/2006 Messier et al.
7,063,145 B2 6/2006 Veenstra et al.
7,066,254 B2 6/2006 Vinegar et al. ..... 166/245
7,073,578 B2 7/2006 Vinegar et al. ..... 166/245
7,077,198 B2 7/2006 Vinegar et al. ..... 166/245
7,077,199 B2 7/2006 Vinegar et al. ..... 166/250.1
7,093,655 B2 8/2006 Atkinson ..... 166/266
7,096,942 B1 8/2006 de Rouffignac et al. ..... 166/245
7,096,953 B2 8/2006 de Rouffignac et al. ..... 166/302
7,100,994 B2 9/2006 Vinegar et al.
7,104,319 B2 9/2006 Vinegar et al. ..... 166/245
7,121,342 B2 10/2006 Vinegar et al. ..... 166/302
7,124,029 B2 10/2006 Jammes et al.
7,165,615 B2 1/2007 Vinegar et al.
7,181,380 B2 2/2007 Dusterhoft et al.
7,198,107 B2 4/2007 Maguire
7,219,734 B2 5/2007 Bai et al.
7,225,866 B2 6/2007 Berchenko et al. ..... 166/245
7,243,618 B2 7/2007 Gurevich
7,322,415 B2 1/2008 de St. Remey
7,331,385 B2 2/2008 Symington et al. ..... 166/248
7,353,872 B2 4/2008 Sandberg
7,357,180 B2 4/2008 Vinegar et al. ..... 166/254.1
7,441,603 B2 10/2008 Kaminsky et al. ..... 166/308.1
7,461,691 B2 12/2008 Vinegar et al.
7,857,056 B2 12/2008 Kaminsky et al.
7,484,561 B2 2/2009 Bridges
7,516,785 B2 4/2009 Kaminsky ..... 166/245
7,516,786 B2 4/2009 Dallas et al.
7,516,787 B2 4/2009 Kaminsky ..... 166/250.1
7,546,873 B2 6/2009 Kim et al.

| | | | | |
|---|---|---|---|---|
| 7,549,470 | B2 | 7/2009 | Vinegar et al. | |
| 7,556,095 | B2 | 7/2009 | Vinegar | |
| 7,617,869 | B2 | 11/2009 | Carney et al. | |
| 7,631,691 | B2 | 12/2009 | Symington et al. | |
| 7,644,993 | B2 | 1/2010 | Kaminsky et al. | |
| 7,647,971 | B2 | 1/2010 | Kaminsky | |
| 7,647,972 | B2 | 1/2010 | Kaminsky | |
| 7,654,320 | B2 | 2/2010 | Payton | |
| 7,669,657 | B2 | 3/2010 | Symington et al. | |
| 7,743,826 | B2 | 6/2010 | Harris et al. | |
| 7,798,221 | B2 | 9/2010 | Vinegar et al. | |
| 7,860,377 | B2 | 12/2010 | Vinegar et al. | |
| 7,905,288 | B2 | 3/2011 | Kinkead | |
| 2001/0049342 | A1 | 12/2001 | Passey et al. | |
| 2002/0013687 | A1 | 1/2002 | Ortoleva | |
| 2002/0023751 | A1 | 2/2002 | Neuroth et al. | |
| 2002/0029882 | A1 | 3/2002 | Rouffignac et al. | |
| 2002/0049360 | A1 | 4/2002 | Wellington et al. | |
| 2002/0077515 | A1 | 6/2002 | Wellington et al. | |
| 2002/0099504 | A1 | 7/2002 | Cross et al. | |
| 2003/0080604 | A1 | 5/2003 | Vinegar et al. | |
| 2003/0085570 | A1 | 5/2003 | Ernst et al. | |
| 2003/0111223 | A1 | 6/2003 | Rouffignac et al. | |
| 2003/0131994 | A1 | 7/2003 | Vinegar et al. | |
| 2003/0131995 | A1 | 7/2003 | de Rouffignac et al. | |
| 2003/0178195 | A1 | 9/2003 | Agee et al. | |
| 2003/0183390 | A1 | 10/2003 | Veenstra et al. | |
| 2003/0192691 | A1 | 10/2003 | Vinegar et al. | |
| 2003/0196788 | A1 | 10/2003 | Vinegar et al. | |
| 2003/0196789 | A1 | 10/2003 | Wellington | |
| 2003/0209348 | A1 | 11/2003 | Ward et al. | |
| 2003/0213594 | A1 | 11/2003 | Wellington et al. | |
| 2004/0020642 | A1 | 2/2004 | Vinegar et al. | |
| 2004/0140095 | A1 | 7/2004 | Vinegar et al. | |
| 2004/0198611 | A1 | 10/2004 | Atkinson | |
| 2004/0211557 | A1 | 10/2004 | Cole et al. | |
| 2005/0051327 | A1 | 3/2005 | Vinegar et al. | |
| 2005/0252656 | A1 | 11/2005 | Maguire | |
| 2005/0252832 | A1 | 11/2005 | Doyle et al. | |
| 2005/0252833 | A1 | 11/2005 | Doyle et al. | |
| 2005/0269077 | A1 | 12/2005 | Sandberg | 166/249 |
| 2005/0269088 | A1 | 12/2005 | Vinegar et al. | |
| 2006/0021752 | A1 | 2/2006 | de St. Remey | |
| 2006/0100837 | A1 | 5/2006 | Symington et al. | |
| 2006/0213657 | A1 | 9/2006 | Berchenko et al. | |
| 2007/0000662 | A1 | 1/2007 | Symington et al. | |
| 2007/0023186 | A1 | 2/2007 | Kaminsky et al. | |
| 2007/0045265 | A1 | 3/2007 | McKinzie, II | 219/207 |
| 2007/0045267 | A1 | 3/2007 | Vinegar et al. | |
| 2007/0084418 | A1 | 4/2007 | Gurevich | |
| 2007/0095537 | A1 | 5/2007 | Vinegar | |
| 2007/0102359 | A1 | 5/2007 | Lombardi et al. | |
| 2007/0131415 | A1 | 6/2007 | Vinegar et al. | |
| 2007/0144732 | A1 | 6/2007 | Kim et al. | 166/245 |
| 2007/0209799 | A1 | 9/2007 | Vinegar et al. | 166/302 |
| 2007/0246994 | A1 | 10/2007 | Symington et al. | 299/3 |
| 2008/0087420 | A1* | 4/2008 | Kaminsky et al. | 166/245 |
| 2008/0087421 | A1 | 4/2008 | Kaminsky | 166/245 |
| 2008/0087426 | A1 | 4/2008 | Kaminsky | 166/271 |
| 2008/0087427 | A1* | 4/2008 | Kaminsky et al. | 166/272.1 |
| 2008/0087428 | A1 | 4/2008 | Symington et al. | 166/272.2 |
| 2008/0173443 | A1 | 7/2008 | Symington et al. | 166/248 |
| 2008/0185145 | A1 | 8/2008 | Carney et al. | |
| 2008/0207970 | A1 | 8/2008 | Meurer et al. | 484/24 |
| 2008/0230219 | A1 | 9/2008 | Kaminsky | 166/248 |
| 2008/0271885 | A1 | 11/2008 | Kaminsky | 166/245 |
| 2008/0283241 | A1 | 11/2008 | Kaminsky et al. | 166/245 |
| 2008/0289819 | A1 | 11/2008 | Kaminsky et al. | 166/256 |
| 2008/0290719 | A1 | 11/2008 | Kaminsky et al. | 299/3 |
| 2009/0038795 | A1 | 2/2009 | Kaminsky et al. | |
| 2009/0050319 | A1 | 2/2009 | Kaminsky et al. | 166/257 |
| 2009/0101346 | A1 | 4/2009 | Vinegar et al. | |
| 2009/0101348 | A1 | 4/2009 | Kaminsky | |
| 2009/0107679 | A1 | 4/2009 | Kaminsky | |
| 2009/0133935 | A1 | 5/2009 | Kinkead | |
| 2009/0145598 | A1 | 6/2009 | Symington et al. | |
| 2009/0308608 | A1 | 12/2009 | Kaminsky et al. | |
| 2010/0078169 | A1 | 4/2010 | Symington et al. | |
| 2010/0089575 | A1 | 4/2010 | Kaminsky et al. | |
| 2010/0089585 | A1 | 4/2010 | Kaminsky | |
| 2010/0095742 | A1 | 4/2010 | Symington et al. | |
| 2010/0101793 | A1 | 4/2010 | Symington et al. | |
| 2010/0218946 | A1 | 9/2010 | Symington et al. | |
| 2010/0282460 | A1 | 11/2010 | Stone et al. | |
| 2010/0319909 | A1 | 12/2010 | Symington et al. | |

FOREIGN PATENT DOCUMENTS

| | | |
|---|---|---|
| CA | 1288043 | 8/1991 |
| CA | 2560223 | 3/2007 |
| EP | 0387846 | 9/1990 |
| FR | EP 0866212 | 9/1998 |
| GB | 855408 | 11/1960 |
| GB | 1454324 | 11/1976 |
| GB | 1463444 | 2/1977 |
| GB | 1 478 880 | 7/1977 |
| GB | 1501310 | 2/1978 |
| GB | 1559948 | 1/1980 |
| GB | 1595082 | 8/1981 |
| WO | WO 82/01408 | 4/1982 |
| WO | WO 90/06480 | 6/1990 |
| WO | WO 99/67504 | 12/1999 |
| WO | WO 01/78914 | 10/2001 |
| WO | WO 01/81505 | 11/2001 |
| WO | WO 02/085821 | 10/2002 |
| WO | WO 2005/010320 | 2/2005 |
| WO | WO 2005/045192 | 5/2005 |
| WO | WO 2006/115943 | 11/2006 |
| WO | WO 2007/033371 | 3/2007 |
| WO | WO 2007/050445 | 5/2007 |
| WO | WO 2007/050479 | 5/2007 |

OTHER PUBLICATIONS

Baugman, G. L. (1978) *Synthetic Fuels Data Handbook*, Second Edition, Cameron Engineers Inc.

Berry, K. L., et al. (1982) "Modified in situ retorting results of two field retorts", Gary, J. H., ed., 15th Oil Shale Symp., CSM, pp. 385-396.

Boyer, H. E. et al. (1985) "Chapter 16: Heat-Resistant Materials," *Metals Handbook*, American Society for Metals, 16 pages.

Ali, A.H.A, et al, (2003) "Watching Rocks Change—Mechanical Earth Modeling", *Oilfield Review*, pp. 22-39.

Asquith, G., et al., (2004) *Basic Well Log Analysis*, Second Ed., Chapter 1, pp. 1-20.

Ball, J.S., et al. (1949) "Composition of Colorado Shale-Oil Naphtha", *Industrial and Engineering Chemistry*, vol. 41, No. 3 pp. 581-587.

Barnes, A. L. et al. (1968) "Quarterly of the Colorado School of Mines" *Fifth Symposium on Oil Shale*, v. 63(4), Oct. 1968, pp. 827-852.

Bastow, T.P., (1998) Sedimentary Processes Involving Aromatic Hydrocarbons >>. Thesis (PhD in Applied Chemistry) Curtin University of Technology (Australia), December, p. 102.

Blanton, T. L. et al, (1999) "Stress Magnitudes from Logs: Effects of Tectonic Strains and Temperature", *SPE Reservoir Eval. & Eng.*2, vol. 1, February, pp. 62-68.

Brandt, H. et al. (1965) "Stimulating Heavy Oil Reservoirs With Downhole Air-Gas Burners," *World Oil*, (Sep. 1965), pp. 91-95.

Charlier, R. et al, (2002) "Numerical Simulation of the Coupled Behavior of Faults During the Depletion of a High-Pressure/High-Temperature Reservoir", *Society of Petroleum Engineers*, SPE 78199, pp. 1-12.

Cipolla, C.L., et al. (1994), "Practical Application of in-situ Stress Profiles", *Society of Petroleum Engineers*, SPE 28607, pp. 487-499.

R. L., (1998) "Solution Mining of Colorado Nahcolite, Wyoming State Geological Survey Public Information Circular 40," *Proceedings of the First International Soda Ash Conference*, V.II (Rock Springs, Wyoming, Jun. 10-12) pp. 121-130.

Domine, F. et al. (2002) "Up to What Temperature is Petroleum Stable? New Insights from a 5200 Free Radical Reactions Model", *Organic Chemistry*, 33, pp. 1487-1499.

Dunks, G. et al. (1983) "Electrochemical Studies of Molten Sodium Carbonate," *Inorg. Chem.* , 22, pp. 2168-2177.

Dusseault, M.B. (1998) "Casing Shear: Causes, Cases, Cures", Society of Petroleum Engineers, SPE 48,864 pp. 337-349.
Dyni, J. R., (1974) "Stratigraphy and Nahcolite Resources of the Saline Facies of the Green River Formation in Northwest Colorado," in D.K. Murray (ed.), *Guidebook to the Energy Resources of the Piceance Creek Basin Colorado, Rocky Mountain Association of Geologists*, Guidebook, pp. 111-122.
Fainberg, V. et al. (1998) "Integrated Oil Shale Processing Into Energy and Chemicals Using Combined-Cycle Technology," *Energy Sources*, v.20.6, Abstract, 1 page.
Farouq Ali, S. M., (1994), "Redeeming features of in situ combustion", DOE/NIPER *Symposium on In Situ Combustion Practices—Past, Present, and Future Application*, Tulsa, OK, Apr. 21-22, No. ISC 1, p. 3-8.
Fox, J. P, (1980) "Water-related Impacts of In-Situ Oil Shale Processing," *California Univ., Berkeley, Lawrence Berkeley Lab*, Chapters 6-7.
Fredrich, J. T. et al, (1996) "Three-Dimensional Geomechanical Simulation of Reservoir Compaction and Implications for Well Failures in the Belridge Diatomite", *Society of Petroleum Engineers*SPE 36698, pp. 195-210.
Fredrich, J. T. et al, (2000) "Geomechanical Modeling of Reservoir Compaction, Surface Subsidence, and Casing Damage at the Belridge Diatomite Field", *SPE Reservoir Eval. & Eng.3*, vol. 4, August, pp. 348-359.
Fredrich, J. T. et al, (2003) "Stress Perturbations Adjacent to Salt Bodies in the Deepwater Gulf of Mexico", *Society of Petroleum Engineers*SPE 84554, pp. 1-14.
Frederiksen, S. et al, (2000) "A Numerical Dynamic Model for the Norwegian-Danish Basin", *Tectonophysics*, 343, 2001, pp. 165-183.
Freund, H. et al., (1989) "Low-Temperature Pyrolysis of Green River Kerogen", *The American Association of Petroleum Geologists Bulletin*, v. 73, No. 8 (Aug.) pp. 1011-1017.
Gatens III, J. M. et al, (1990) "In-Situ Stress Tests and Acoustic Logs Determine Mechanical Properties and Stress Profiles in the Devonian Shales", *SPE Formation Evaluation*SPE 18523, pp. 248-254.
Garthoffner, E. H., (1998), "Combustion front and burned zone growth in successful California ISC projects", SPE 46244, pp. 1-11.
Greaves, M., et al. (1994) "In situ combustion (ISC) processes: 3D studies of vertical and horizontal wells", *Europe Comm. Heavy Oil Technology in a Wider Europe Symposium*, Berlin, Jun. 7-8, p. 89-112.
Hansen, K. S. et al, (1989) "Earth Stress Measurements in the South Belridge Oil Field, Kern County, California", *SPE Formation Evaluation*, December pp. 541-549.
Hansen, K. S. et al, (1993) "Finite-Element Modeling of Depletion-Induced Reservoir Compaction and Surface Subsidence in the South Belridge Oil Field, California", SPE 26074, pp. 437-452.
Hansen, K. S. et al, (1995) "Modeling of Reservoir Compaction and Surface Subsidence at South Belridge", *SPE Production & Facilities*, August pp. 134-143.
Hardy, M. et al. (2003) "Solution Mining of Nahcolite at the American Soda Project, Piceance Creek, Colorado," *SME Annual Mtg.*, Feb. 24-26, Cincinnati, Ohio, Preprint 03-105.
Hardy, M., et al. (2003) "Solution Mining of Nahcolite at American Soda's Yankee Gulch Project," *Mining Engineering*, Oct. 2003, pp. 23-31.
Henderson, W, et al. (1968) "Thermal Alteration as a Contributory Process to the Genesis of Petroleum", *Nature*vol. 219, pp. 1012-1016.
Hilbert, L. B. et al, (1999) "Field-Scale and Wellbore Modeling of Compaction-Induced Casing Failures", *SPE Drill. & Completion*, 14(2), Jun. pp. 92-101.
Hill, G. R. et al. (1967) "Direct Production of a Low Pour Point High Gravity Shale Oil", *I& EC Product Research and Development*, 6(1), March pp. 52-59.
Holditch, S. A., (1989) "Pretreatment Formation Evaluation", *Recent Advances in Hydraulic Fracturing*, SPE Monograph vol. 12, Chapter 2 (Henry L. Doherty Series), pp. 39-56.
Holmes, A. S. et al. (1982) "Process Improves Acid Gas Separation," *Hydrocarbon Processing*, pp. 131-136.
Holmes, A. S. et al. (1983) "Pilot Tests Prove Out Cryogenic Acid-Gas/Hydrocarbon Separation Processes," *Oil & Gas Journal*, pp. 85-91.
Ireson, A. T. (1990) "Review of the Soluble Salt Process for In-Situ Recovery of Hydrocarbons from Oil Shale with Emphasis on Leaching and Possible Beneficiation," *23rd Colorado School of Mines Oil Shale Symposium*(Golden, Colorado), 152-161.
Kenter, C. J. et al, (2004) "Geomechanics and 4D: Evaluation of Reservoir Characteristics from Timeshifts in the Overburden", *Gulf Rocks 2004, 6th North America Rock Mechanics Symposium*(*NARMS*): *Rock Mechanics Across Borders and Disciplines,*Houston, Texas, Jun. 5-9, ARMA/NARMS 04-627.
Kuo, M. C. T. et al (1979) "Inorganics leaching of spent shale from modified in situ processing," J. H. Gary (ed.) *Twelfth Oil Shale Symposium Proceedings*, Colorado School of Mines, Golden CO., Apr. 18-20, pp. 81-93.
Laughrey, C. D. et al. (2003) "Some Applications of Isotope Geochemistry for Determining Sources of Stray Carbon Dioxide Gas," *Environmental Geosciences*, 10(3), pp. 107-122.
Le Pourhiet, L. et al, (2003) "Initial Crustal Thickness Geometry Controls on the Extension in a Back Arc Domain: Case of the Gulf of Corinth", *Tectonics*, vol. 22, No. 4, pp. 6-1-6-14.
Lundquist, L. (1951) "Refining of Swedish Shale Oil", *Oil Shale Cannel Coal Conference*, vol./Issue: 2, pp. 621-627.
Marotta, A. M. et al, (2003) "Numerical Models of Tectonic Deformation at the Baltica-Avalonia Transition Zone During the Paleocene Phase of Inversion", *Tectonophysics*, 373, pp. 25-37.
Mohammed, Y. A., et al (2001) "A Mathematical Algorithm for Modeling Geomechanical Rock Properties of the Khuff and PreKhuff Reservoirs in Ghawar Field", *Society of Petroleum Engineers*SPE 68194, pp. 1-8.
Molenaar, M. M. et al, (2004) "Applying Geo-Mechanics and 4D: '4D In-Situ Stress' as a Complementary Tool for Optimizing Field Management", *Gulf Rocks 2004, 6th North America Rock Mechanics Symposium (NARMS): Rock Mechanics Across Borders and Disciplines*, Houston, Texas, Jun. 5-9, ARMA/NARMS 04-639, pp. 1-7.
Moschovidis, Z. (1989) "Interwell Communication by Concurrent Fracturing—a New Stimulation Technique", *Journ. of Canadian Petro. Tech.* 28(5), pp. 42-48.
Motzfeldt, K. (1954) "The Thermal Decomposition of Sodium Carbonate by the Effusion Method," *Jrnl. Phys. Chem.*, v. LIX, pp. 139-147.
Newkirk, A. E. et al. (1958) "Drying and Decomposition of Sodium Carbonate," *Anal. Chem.*, 30(5), pp. 982-984.
Nielsen, K. R., (1995) "Colorado Nahcolite: A Low Cost Source of Sodium Chemicals," *7th Annual Canadian Conference on Markets for Industrial Minerals*, (Vancouver, Canada, Oct. 17-18) pp. 1-9.
Nottenburg, R.N. et al. (1979) "Temperature and stress dependence of electrical and mechanical properties of Green River oil shale," *Fuel*, 58, pp. 144-148.
Nowacki, P. (ed.), (1981) *Oil Shale Technical Handbook*, Noyes Data Corp.
Pattillo, P. D. et al, (1998) "Reservoir Compaction and Seafloor Subsidence at Valhall", SPE 47274, 1998, pp. 377-386.
Pattillo, P. D. et al, (2002) "Analysis of Horizontal Casing Integrity in the Valhall Field", SPE 78204, pp. 1-10.
Persoff, P. et al. (1979) "Control strategies for abandoned in situ oil shale retorts," J. H. Gary (ed.), *12th Oil Shale Symposium Proceedings*, Colorado School of Mines, Golden, CO., Apr. 18-20, pp. 72-80.
Peters, G., (1990) "The Beneficiation of Oil Shale by the Solution Mining of Nahcolite," *23rd Colorado School of Mines Oil Shale Symposium*(Golden, CO) pp. 142-151.
Plischke, B., (1994) "Finite Element Analysis of Compaction and Subsidence—Experience Gained from Several Chalk Fields", *Society of Petroleum Engineers*, SPE 28129, 1994, pp. 795-802.
Prats, M., et al. (1977) "Soluble-Salt Processes for In-Situ Recovery of Hydrocarbons from Oil Shale," *Journal of Petrol. Technol.*, pp. 1078-1088.
Ramey, M. et al. (2004)"The History and Performance of Vertical Well Solution Mining of Nahcolite ($NaHCO_3$) in the Piceance Basin, Northwestern, Colorado, USA," *Solution Mining Research Institute: Fall 2004 Technical Meeting*(Berlin, Germany).

Reade Advanced Materials; 2006 About.com Electrical resistivity of materials. [Retrieved on Oct. 15, 2009] Retrieved from internet: URL: http://www.reade.com/Particle%5FBriefings/elec%5Fres.html. Entire Document.
Ruzicka, D.J. et al. (1987) "Modified Method Measures Bromine Number of Heavy Fuel Oils", *Oil & Gas Journal*, 85(31), Aug. 3, pp. 48-50.
Sahu, D. et al. (1988) "Effect of Benzene and Thiophene on Rate of Coke Formation During Naphtha Pyrolysis", *Canadian Journ. Of Chem. Eng.* , 66, Oct. pp. 808-816.
Smart, K. J. et al, (2004) "Integrated Structural Analysis and Geomechanical Modeling: an Aid to Reservoir Exploration and Development", *Gulf Rocks 2004, 6th North America Rock Mechanics Symposium (NARMS): Rock Mechanics Across Borders and Disciplines*, Houston, Texas, Jun. 5-9, AAMA/NARMS 04-470.
Symington, W.A., et al (2006) ExxonMobil's electrofrac process for in situ oil shale conversion 26th Oil Shale Symposium, Colorado School of Mines.
Syunyaev, Z.I. et al. (1965) "Change in the Resistivity of Petroleum Coke on Calcination," Chemistry and Technology of Fuels and Oils, 1(4), pp. 292-295.
Templeton, C. C. (1978) "Pressure-Temperature Relationship for Decomposition of Sodium Bicarbonate from 200 to 600° F," *J. of Chem. And Eng. Data*, 23(1), pp. 7-8.
Thomas, A. M. (1963) "Thermal Decomposition of Sodium Carbonate Solutions," *J. of Chem. And Eng. Data*, 8(1), pp. 51-54.
Turta, A., (1994), "In situ combustion—from pilot to commercial application", *DOE/NIPER Symposium on In Situ Combustion Practices—Past, Present, and Future Application*, Tulsa, OK, Apr. 21-22, No. ISC 3, p. 15-39.
Tzanco, E. T., et al. (1990), "Laboratory Combustion Behavior of Countess B Light Oil", *Petroleum Soc. Of CIM and SPE*, Calgary, Jun. 10-13, No. CIM/SPE 90-63, p. 63.1-63.16.
Veatch, Jr. R.W. And Martinez, S.J., et al. (1990) "Hydraulic Fracturing: Reprint Series No. 28", *Soc. of Petroleum Engineers*SPE 14085, Part I, Overview.
Warpinski, N. R., (1989) "Elastic and Viscoelastic Calculations of Stresses in Sedimentary Basins", SPE Formation Evaluation, vol. 4, pp. 522-530.
Yoon, E. et al. (1996) "High-Temperature Stabilizers for Jet Fuels and Similar Hydrocarbon Mixtures. 1. Comparative Studies of Hydrogen Donors", *Energy & Fuels*, 10, pp. 806-811.
"Encyclopedia of Chemical Technology" (4th ed. ), *Alkali and Chlorine Products*, pp. 1025-1039 (1998).
EP Search Report dated Dec. 29, 2003 (RS 110243, Corresponding to US Pat 7,331,385).
EP Search Report dated Mar. 17, 2004 (RS 110686, Corresponding to U.S. Patent 7,441,603).
EP Search Report, Supplementary dated Apr. 10, 2007 (EP 04 77 9878 Corresponding to U.S. Patent 7,441,603).
EP Search Report dated Apr. 29, 2005 (RS 112183, Corresponding to U.S. Appl. No. 11/250,804, Published as US 2006/0100837 on May 11, 2008).
EP Search Report dated Jun. 2, 2006 (RS113865, corresponding to U.S. Appl. No. 11/726,651).
EP Search Report dated Feb. 16, 2007 (RS 114808, Corresponding to U.S. Appl. No. 11/973,746, Published as US 2008/0087420 on May 17, 2008).
EP Search Report dated Feb. 16, 2007 (RS 114804, Corresponding to U.S. Appl. No. 11/973,750, Published as US 2008/0087427 on Apr. 17, 2008).
EP Search Report dated Mar. 21, 2007 (RS 114890, Corresponding to U.S. Patent 7,516,787).
EP Search Report dated Feb. 16, 2007 (RS 114807, Corresponding to U.S. Patent 7,669,657).
EP Search Report dated Nov. 13, 2007 (RS 115479, Corresponding to U.S. Appl. No. 12/148,414).
EP Search Report dated Aug. 29, 2007 (No. RS115553, Corresponding to U.S. Appl. No. 12/148,388).
EP Search Report dated Jul. 4, 2007 ( RS 115341 Corresponding to U.S. Appl. No. 12/074,899).
EP Search Report dated Jul. 5, 2007 (RS 115432 Corresponding to U.S. Appl. No. 12/075,087).
EP Search Report dated Mar. 12, 2009 (EP 08 00 3956,—Corresponding to U.S. Appl. No. 12/271,521).
EP Search Report dated Aug. 29, 2007 (RS 1155554, Corresponding to U.S. Appl. No. 12/154,238).
EP Search Report dated Aug. 28, 2007 (RS 1155555, Corresponding to U.S. Appl. No. 12/154,256).
International Search Report for PCT/US01/09247 Jun. 20, 2001.
International Search Report for PCT/US04/11508, Jan. 5, 2005.
International Search Report for PCT/US08/88045, Feb. 12, 2009.
International Search Report for PCT/US04/24947 Mar. 10, 2005.
International Search Report for PCT/US07/07133, Jan. 4, 2008.
International Search Report for PCT/US07/21673 Jun. 24, 2008.
International Search Report for PCT/US07/21668 Apr. 29, 2008.
International Search Report for PCT/US07/21666 Apr. 4, 2008.
International Search Report for PCT/US07/21669, Apr. 29, 2008.
International Search Report for PCT/US07/21660 Apr. 4, 2008.
International Search Report for PCT/US07/021968, May 14, 2008.
International Search Report for PCT/US07/021968, May 21, 2008.
International Search Report for PCT/US08/005008, Aug. 29, 2008.
International Search Report for PCT/US08/05056, Aug. 25, 2008.
International Search Report for PCT/US/08/003069, Jun. 25, 2008.
International Search Report for PCT/US08/003043, Jul. 2, 2008.
International Search Report for PCT/US08/083815, Mar. 20, 2009.
International Search Report for PCT/US08/006462 Sep. 22, 2008.
International Search Report for PCT/US08/006463 Aug. 22, 2008.
International Search Report for PCT/US07/21645 Apr. 21, 2008.
International Search Report for PCT/US09/037419 Jul. 7, 2009.
International Search Report for PCT/US09/055403, Oct. 22, 2009.
International Search Report for PCT/US10/20342 Feb. 26, 2010.
International Search Report for PCT/US10/031910 Aug. 3, 2010.
International Search Report for PCT/US10/057204 Jan. 27, 2011.
U.S. Appl. No. 12/630,636 Office Action mailed Oct. 27, 2010.
U.S. Appl. No. 11/250,804 Office Action mailed Oct. 16, 2008.
U.S. Appl. No. 11/250,804 Office Action mailed Jun. 11, 2009.
U.S. Appl. No. 11/973,746 Office Action mailed Jun. 25, 2009.
U.S. Appl. No. 11/973,746 Office Action mailed Nov. 8, 2010.
U.S. Appl. No. 11/973,750 Office Action mailed Dec. 4, 2008.
U.S. Appl. No. 11/973,750 Office Action mailed Jul. 22, 2009.
U.S. Appl. No. 12/638,630 Office Action mailed Mar. 16, 2011.
U.S. Appl. No. 12/712,904 Office Action mailed Nov. 10, 2010.
U.S. Appl. No. 12/148,414 Office Action mailed May 19, 2010.
U.S. Appl. No. 12/148,414 Office Action mailed Oct. 22, 2010.
U.S. Appl. No. 12/148,388 Office Action mailed Jun. 10, 2010.
U.S. Appl. No. 12/148,388 Office Action mailed Nov. 19, 2010.
U.S. Appl. No. 12/074,899 Office Action mailed Dec. 16, 2009.
U.S. Appl. No. 12/074,899 Office Action mailed Jul. 26, 2010.
U.S. Appl. No. 12/074,899 Office Action mailed Jan. 4, 2011.
U.S. Appl. No. 12/075,087 Office Action mailed Oct. 12, 2010.
U.S. Appl. No. 12/075,087 Office Action mailed Mar. 7, 2011.
U.S. Appl. No. 12/271,521 Office Action mailed Nov. 2, 2010.
U.S. Appl. No. 11/973,898 Office Action mailed May 6, 2010.
U.S. Appl. No. 11/973,898 Office Action mailed Dec. 20, 2010.
U.S. Appl. No. 12/405,901 Office Action mailed Feb. 14, 2011.
U.S. Appl. No. 12/154,238 Office Action mailed Apr. 22, 2011.
U.S. Appl. No. 12/154,256 Office Action mailed May 9, 2011.
U.S. Appl. No. 12/148,414 Office Action mailed May 17, 2011.
U.S. Appl. No. 12/443,680 Office Action mailed Jun. 23, 2011.
U.S. Appl. No. 6/918,444—Office Action mailed Sep. 16, 2004.
U.S. Appl. No. 7/331,385—Office Action mailed Jul. 12, 2007.
U.S. Appl. No. 7/631,691—Office Action mailed Mar. 18, 2009.
U.S. Appl. No. 7/441,603—Office Action mailed Feb. 25, 2008.
U.S. Appl. No. 7/857,056—Office Action mailed Mar. 19, 2010.
U.S. Appl. No. 7/516,785—Office Action mailed Apr. 2, 2008.
U.S. Appl. No. 7/516,787—Office Action mailed Apr. 3, 2008.
U.S. Appl. No. 7/647,972—Office Action mailed May 19, 2009.
U.S. Appl. No. 7/647,971—Office Action mailed May 21, 2009.
U.S. Appl. No. 7/669,657—Office Action mailed Jun. 26, 2008.
U.S. Appl. No. 7/669,657—Office Action mailed Dec. 15, 2008.
U.S. Appl. No. 7/669,657—Office Action mailed Sep. 15, 2009.
U.S. Appl. No. 7/644,993—Office Action mailed Jun. 24, 2009.

* cited by examiner

METHODS OF PRODUCING HYDROCARBONS FOR SUBSTANTIALLY CONSTANT COMPOSITION GAS GENERATION

STATEMENT OF RELATED APPLICATIONS

This application claims the benefit of U.S. provisional patent application No. 61/128,664 which was filed on May 23, 2008. That application is titled "Field Management for Substantially Constant Gas Generation," and is incorporated herein in its entirety by reference.

BACKGROUND OF THE INVENTION

1. Field of the Invention

The present invention relates to the field of hydrocarbon recovery from subsurface formations. More specifically, the present invention relates to the in situ recovery of hydrocarbon fluids from organic-rich rock formations including, for example, oil shale formations, coal formations and tar sands formations. The present invention also relates to methods for providing a substantially constant gas composition during the production of hydrocarbon fluids from organic-rich rock formations.

2. General Discussion of Technology

Certain geological formations are known to contain an organic matter known as "kerogen." Kerogen is a solid, carbonaceous material. When kerogen is imbedded in rock formations, the mixture is referred to as oil shale. This is true whether or not the mineral is, in fact, technically shale, that is, a rock formed from compacted clay.

Kerogen is subject to decomposing upon exposure to heat over a period of time. Upon heating, kerogen molecularly decomposes to produce oil, gas, and carbonaceous coke. Small amounts of water may also be generated. The oil, gas and water fluids become mobile within the rock matrix, while the carbonaceous coke remains essentially immobile.

Oil shale formations are found in various areas worldwide, including the United States. Such formations are notably found in Wyoming, Colorado, and Utah. Oil shale formations tend to reside at relatively shallow depths and are often characterized by limited permeability. Some consider oil shale formations to be hydrocarbon deposits which have not yet experienced the years of heat and pressure thought to be required to create conventional oil and gas reserves.

The decomposition rate of kerogen to produce mobile hydrocarbons is temperature dependent. Temperatures generally in excess of 270° C. (518° F.) over the course of many months may be required for substantial conversion. At higher temperatures substantial conversion may occur within shorter times. When kerogen is heated to the necessary temperature, chemical reactions break the larger molecules forming the solid kerogen into smaller molecules of oil and gas. The thermal conversion process is referred to as pyrolysis or retorting.

Attempts have been made for many years to extract oil from oil shale formations. Near-surface oil shales have been mined and retorted at the surface for over a century. In 1862, James Young began processing Scottish oil shales. The industry lasted for about 100 years. Commercial oil shale retorting through surface mining has been conducted in other countries as well. Such countries include Australia, Brazil, China, Estonia, France, Russia, South Africa, Spain, Jordan and Sweden. However, the practice has been mostly discontinued in recent years because it proved to be uneconomical or because of environmental constraints on spent shale disposal. (See T. F. Yen, and G. V. Chilingarian, "*Oil Shale,*" Amsterdam, Elsevier, p. 292, the entire disclosure of which is incorporated herein by reference.) Further, surface retorting requires mining of the oil shale, which limits that particular application to very shallow formations.

In the United States, the existence of oil shale deposits in northwestern Colorado has been known since the early 1900's. While research projects have been conducted in this area from time to time, no serious commercial development has been undertaken. Most research on oil shale production was carried out in the latter half of the 1900's. The majority of this research was on shale oil geology, geochemistry, and retorting in surface facilities.

In 1947, U.S. Pat. No. 2,732,195 issued to Fredrik Ljungstrom. That patent, entitled "Method of Treating Oil Shale and Recovery of Oil and Other Mineral Products Therefrom," proposed the application of heat at high temperatures to the oil shale formation in situ. The purpose of such in situ heating was to distill hydrocarbons and produce them to the surface. The '195 Ljungstrom patent is incorporated herein in its entirety by reference.

Ljungstrom coined the phrase "heat supply channels" to describe bore holes drilled into the formation. The bore holes received an electrical heat conductor which transferred heat to the surrounding oil shale. Thus, the heat supply channels served as early heat injection wells. The electrical heating elements in the heat injection wells were placed within sand or cement or other heat-conductive material to permit the heat injection wells to transmit heat into the surrounding oil shale while preventing the inflow of fluid. According to Ljungstrom, the subsurface "aggregate" was heated to between 500° and 1,000° C. in some applications.

Along with the heat injection wells, fluid producing wells were completed in near proximity to the heat injection wells. As kerogen was pyrolyzed upon heat conduction into the aggregate or rock matrix, the resulting oil and gas would be recovered through the adjacent production wells.

Ljungstrom applied his approach of thermal conduction from heated wellbores through the Swedish Shale Oil Company. A full scale plant was developed that operated from 1944 into the 1950's. (See G. Salamonsson, "The Ljungstrom In Situ Method for Shale-Oil Recovery," $2^{nd}$ Oil Shale and Cannel Coal Conference, v. 2, Glasgow, Scotland, Institute of Petroleum, London, p. 260-280 (1951), the entire disclosure of which is incorporated herein by reference.)

Additional in situ methods have been proposed. These methods generally involve the injection of heat and/or solvent into a subsurface oil shale formation. Heat may be in the form of heated methane (see U.S. Pat. No. 3,241,611 to J. L. Dougan), flue gas, or superheated steam (see U.S. Pat. No. 3,400,762 to D. W. Peacock). Heat may also be in the form of electric resistive heating, dielectric heating, radio frequency (RF) heating (U.S. Pat. No. 4,140,180, assigned to the ITT Research Institute in Chicago, Ill.) or oxidant injection to support in situ combustion. In some instances, artificial permeability has been created in the matrix to aid the movement of pyrolyzed fluids upon heating. Permeability generation methods include mining, rubblization, hydraulic fracturing (see U.S. Pat. No. 3,468,376 to M. L. Slusser and U.S. Pat. No. 3,513,914 to J. V. Vogel), explosive fracturing (see U.S. Pat. No. 1,422,204 to W. W. Hoover, et al.), heat fracturing (see U.S. Pat. No. 3,284,281 to R. W. Thomas), and steam fracturing (see U.S. Pat. No. 2,952,450 to H. Purre).

It has been disclosed to run alternating current or radio frequency electrical energy between stacked conductive fractures or electrodes in the same well in order to heat a subterranean formation. See U.S. Pat. No. 3,149,672 titled "Method and Apparatus for Electrical Heating of Oil-Bearing Formations;" U.S. Pat. No. 3,620,300 titled "Method and Apparatus for Electrically Heating a Subsurface Formation;" U.S. Pat. No. 4,401,162 titled "In Situ Oil Shale Process;" and U.S. Pat. No. 4,705,108 titled "Method for In Situ Heating of Hydrocarbonaceous Formations." U.S. Pat. No. 3,642,066 titled "Electrical Method and Apparatus for the Recovery of Oil," provides a description of resistive heating within a subterranean formation by running alternating current between different wells. Others have described methods to create an effective electrode in a wellbore. See U.S. Pat. No. 4,567,945 titled "Electrode Well Method and Apparatus;" and U.S. Pat. No. 5,620,049 titled "Method for Increasing the Production of Petroleum From a Subterranean Formation Penetrated by a Wellbore."

U.S. Pat. No. 3,137,347 titled "In Situ Electrolinking of Oil Shale," describes a method by which electric current is flowed through a fracture connecting two wells to get electric flow started in the bulk of the surrounding formation. Heating of the formation occurs primarily due to the bulk electrical resistance of the formation. F. S. Chute and F. E. Vermeulen, *Present and Potential Applications of Electromagnetic Heating in the In Situ Recovery of Oil*, AOSTRA J. Res., v. 4, p. 19-33 (1988) describes a heavy-oil pilot test where "electric preheat" was used to flow electric current between two wells to lower viscosity and create communication channels between wells for follow-up with a steam flood.

In 1989, U.S. Pat. No. 4,886,118 issued to Shell Oil Company. That patent, entitled "Conductively Heating a Subterranean Oil Shale to Create Permeability and Subsequently Produce Oil," declared that "[c]ontrary to the implications of . . . prior teachings and beliefs . . . the presently described conductive heating process is economically feasible for use even in a substantially impermeable subterranean oil shale." (col. 6, ln. 50-54). Despite this declaration, it is noted that few, if any, commercial in situ shale oil operations have occurred other than Ljungstrom's. The '118 patent proposed controlling the rate of heat conduction within the rock surrounding each heat injection well to provide a uniform heat front. The '118 Shell patent is incorporated herein in its entirety by reference.

Additional history behind oil shale retorting and shale oil recovery can be found in co-owned patent publication WO 2005/010320 entitled "Methods of Treating a Subterranean Formation to Convert Organic Matter into Producible Hydrocarbons," and in patent publication WO 2005/045192 entitled "Hydrocarbon Recovery from Impermeable Oil Shales." The Background and technical disclosures of these two patent publications are incorporated herein by reference.

A need exists for improved processes for the production of shale oil. In addition, a need exists for improved methods for controlling gas composition in a combined gas stream created from production fluids in a shale oil development area. Further, a need exists for a process that generates electricity from hydrocarbon gases produced from a shale oil production operation. Further still, a need exists for a method of maintaining a substantially constant composition in the produced gases wherein the gases have a quality that changes over time when produced from in situ heating.

SUMMARY OF THE INVENTION

The methods described herein have various benefits in improving the recovery of hydrocarbon fluids from an organic-rich rock formation such as a formation containing solid hydrocarbons or heavy hydrocarbons. In various embodiments, such benefits may include increased production of hydrocarbon fluids from an organic-rich rock formation, and providing a source of electrical energy for the recovery operation, such as an oil shale production operation.

A method for producing hydrocarbon fluids from an organic-rich rock formation to a surface facility is first provided. The organic-rich rock formation comprises formation hydrocarbons such as solid hydrocarbons or heavy hydrocarbons. In one aspect, the organic-rich rock formation is an oil shale formation.

The method includes heating the organic-rich rock formation in situ in order to cause pyrolysis of formation hydrocarbons, and then producing production fluids from the organic-rich rock formation via two or more wells. The produced fluids have been at least partially generated as a result of pyrolysis of the formation hydrocarbons located in the organic-rich rock formation. The produced fluids have both condensable (liquid) and noncondensable (gas) components.

The noncondensable gas portion may be separated into a gas stream. The gas stream may comprise combustible hydrocarbon fluids. Further, the gas stream may have a Wobbe Index value that varies at a rate of more than 5% as the formation is heated and produced over a period of time. The period of time for measuring variance in the gas stream is typically more than six months, and may be more than one year. The Wobbe Index value may be a daily average, a weekly average, or an average taken over some other period of time. Stated another way, the Wobbe Index value may constitute, for example, a daily average or a weekly average of Wobbe Index assessments.

The method also includes controlling production from one or more of the two or more wells such that a combination of the production fluids from the two or more wells produces a gas stream whose Wobbe Index value varies at a rate of less than 5% over the period of time.

In one aspect, the two or more wells comprise at least a first group of wells, a second group of wells and a third group of wells. The first group of wells may comprise a different number of wells than the second group of wells or the third group of wells. Preferably, the first group of wells begins to produce hydrocarbon fluids at a first start-up time, the second group of wells begins to produce at a second later start-up time, and the third group of wells begins to produce at yet a third later start-up time. The time between the first start-up time and the second start-up time represents a first increment, while the time between the second start-up time and the third start-up time represents a second increment. The first increment and the second increment may be the same lengths of time or may be different lengths of time.

A method for utilizing gas produced from an in situ conversion process in a hydrocarbon development area is also provided. In one embodiment, the method includes operating in a development area in which production fluids are produced. The production fluids may be produced as a result of pyrolysis of formation hydrocarbons in an organic-rich rock formation within the development area. The organic-rich rock formation preferably comprises oil shale, while the production fluids comprise shale oil.

The development area may be divided into sections. Each section may have two or more production wells. The production wells produce the production fluids to the surface. A processing facility resides at the surface.

The method includes incrementally producing production fluids from the organic-rich rock formation within the respective sections. The production fluids from each section include a noncondensable portion that comprises a gas stream. The gas streams from incremental sections may be combined to form a combined gas stream. Production from the sections is coordinated such that a composition of carbon dioxide and hydrogen within the combined gas stream remains substantially within the defined ranges.

The method also includes selecting a gas turbine. The gas turbine is designed to receive a combustible gas stream having a composition that comprises carbon dioxide and hydrogen within the defined ranges. The gas turbine is configured to provide energy to an electrical generator. The method further comprises passing the gas stream through the gas turbine to provide energy from the gas tubine to the electrical generator. In one aspect, the electrical generator provides electricity to downhole heating elements. It may also provide electricity to support surface production facilities at the development area.

In one embodiment, the method also comprises adjusting the production rate of hydrocarbon fluids being produced from a first section to change mol. percentages of carbon dioxide and hydrogen within the combined gas stream. Alternatively, the production rate is adjusted to provide a selected carbon dioxide-to-hydrogen molar ratio in the combined gas stream.

The step of obtaining a combined gas stream from the respective production fluids may be obtained by separating the respective production fluids into liquid streams and gas streams, and then combining the gas streams separated from the respective production fluids at the surface facility to form a combined gas stream. Alternatively, the step of obtaining a combined gas stream may be obtained by commingling the respective production fluids, and then separating the commingled production fluids at a surface facility into at least a combined liquid stream and a combined gas stream. In either instance, both the liquid stream and the gas stream comprise combustible hydrocarbon fluids.

Another method is provided herein for producing hydrocarbon fluids from an organic-rich rock formation in a development area. Preferably, the development area is a shale oil development area. The method in one embodiment includes dividing the development area into three or more production areas. Each production area preferably has two or more production wells. The method also includes heating the organic-rich rock formation in situ in a first production area. The purpose of heating is to cause pyrolysis of formation hydrocarbons in the first production area.

The method further comprises producing hydrocarbon fluids from the first production area. Production is accomplished through the two or more production wells at a first production rate. In addition, the method includes incrementally heating the organic-rich rock formation in situ in subsequent production areas in order to cause pyrolysis of formation hydrocarbons in the respective subsequent production areas.

The method also includes incrementally producing hydrocarbon fluids from each of the subsequent production areas via two or more production wells. The production fluids are delivered to a surface processing facility. In one aspect, incrementally producing hydrocarbon fluids from the subsequent production areas comprises spacing production start-up between the subsequent production areas by at least three months.

The method further includes controlling production rates from one or more of the production areas. Controlling production rates may be done by controlling production rates from individual wells within selected subsequent production areas. The purpose is to substantially match the capacity of fluids processing facilities at the development area. In one aspect, matching the capacity of processing facilities means maintaining a substantially constant production rate for the hydrocarbons.

BRIEF DESCRIPTION OF THE DRAWINGS

So that the present inventions can be better understood, certain drawings, charts, graphs and flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

Figure 1:
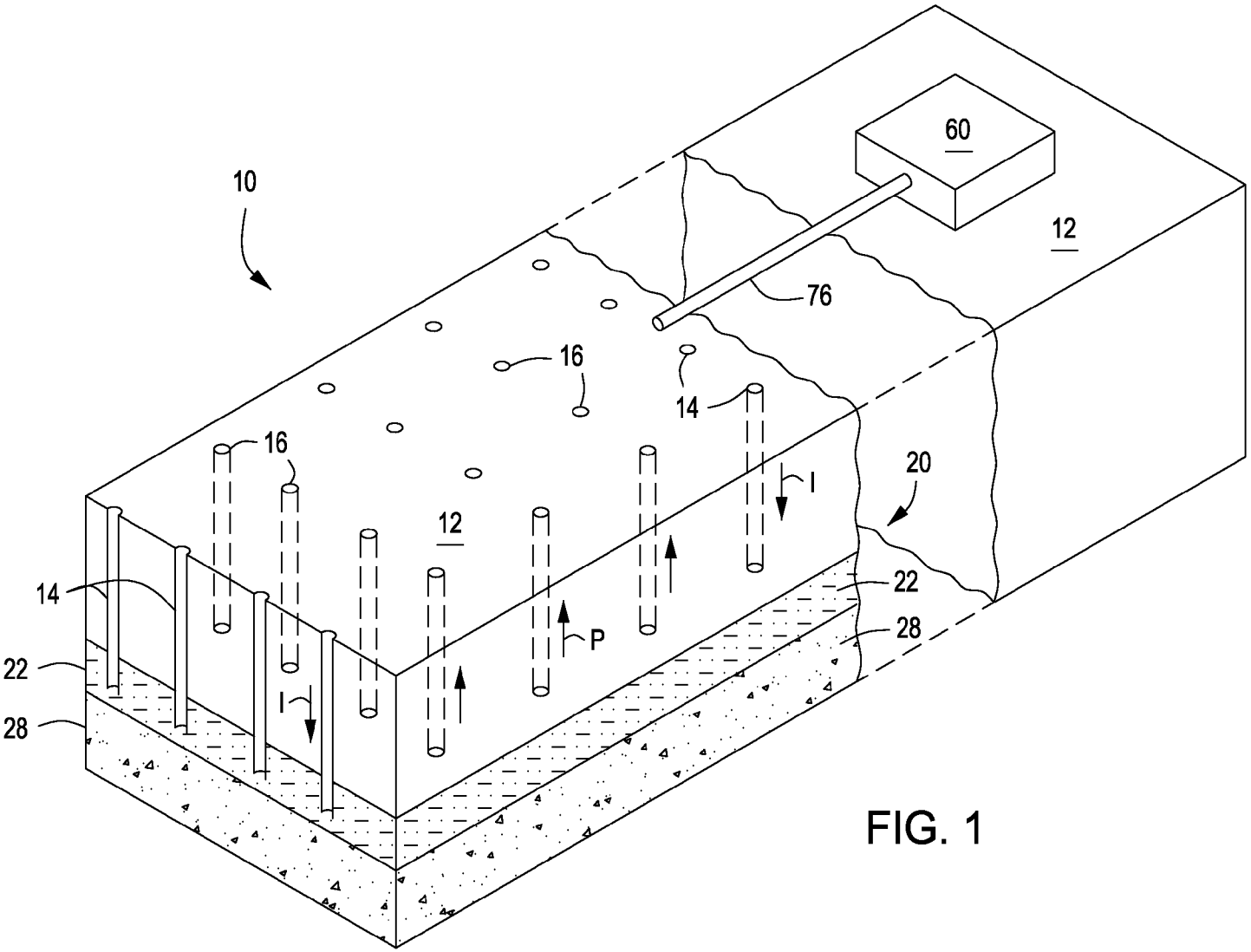
FIG. 1 is a three-dimensional isometric view of an illustrative hydrocarbon development area. The development area includes an organic-rich rock matrix that defines a subsurface formation.

As used herein, the term "hydrocarbon(s)" refers to organic material with molecular structures containing carbon bonded to hydrogen. Hydrocarbons may also include other elements, such as, but not limited to, halogens, metallic elements, nitrogen, oxygen, and/or sulfur.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, pyrolyzed shale oil, synthesis gas, a pyrolysis product of coal, carbon dioxide, hydrogen sulfide and water (including steam). Produced fluids may include both hydrocarbon fluids and non-hydrocarbon fluids.

As used herein, the term "condensable hydrocarbons" means those hydrocarbons that condense to a liquid at about 25° C. and one atmosphere absolute pressure. Condensable hydrocarbons may include a mixture of hydrocarbons having carbon numbers greater than 4.

As used herein, the term "non-condensable" means those chemical species that do not condense to a liquid at about 25° C. and one atmosphere absolute pressure. Non-condensable species may include non-condensable hydrocarbons and non-condensable non-hydrocarbon species such as, for example, carbon dioxide, hydrogen, carbon monoxide, hydrogen sulfide, and nitrogen. Non-condensable hydrocarbons may include hydrocarbons having carbon numbers less than 5.

As used herein, the term "heavy hydrocarbons" refers to hydrocarbon fluids that are highly viscous at ambient conditions (15° C. and 1 atm pressure). Heavy hydrocarbons may include highly viscous hydrocarbon fluids such as heavy oil, tar, and/or asphalt. Heavy hydrocarbons may include carbon and hydrogen, as well as smaller concentrations of sulfur, oxygen, and nitrogen. Additional elements may also be present in heavy hydrocarbons in trace amounts. Heavy hydrocarbons may be classified by API gravity. Heavy hydrocarbons generally have an API gravity below about 20 degrees. Heavy oil, for example, generally has an API gravity of about 10-20 degrees, whereas tar generally has an API gravity below about 10 degrees. The viscosity of heavy hydrocarbons is generally greater than about 100 centipoise at about 15° C.

As used herein, the term "solid hydrocarbons" refers to any hydrocarbon material that is found naturally in substantially solid form at formation conditions. Non-limiting examples include kerogen, coal, shungites, asphaltites, and natural mineral waxes.

As used herein, the term "formation hydrocarbons" refers to both heavy hydrocarbons and solid hydrocarbons that are contained in an organic-rich rock formation. Formation hydrocarbons may be, but are not limited to, kerogen, oil shale, coal, bitumen, tar, natural mineral waxes, and asphaltites.

As used herein, the term "tar" refers to a viscous hydrocarbon that generally has a viscosity greater than about 10,000 centipoise at 15° C. The specific gravity of tar generally is greater than 1.000. Tar may have an API gravity less than 10 degrees. "Tar sands" refers to a formation that has tar in it.

As used herein, the term "kerogen" refers to a solid, insoluble hydrocarbon that principally contains carbon, hydrogen, nitrogen, oxygen, and sulfur.

As used herein, the term "bitumen" refers to a non-crystalline solid or viscous hydrocarbon material that is substantially soluble in carbon disulfide.

As used herein, the term "oil" refers to a hydrocarbon fluid containing a mixture of condensable hydrocarbons.

As used herein, the term "subsurface" refers to geologic strata occurring below the earth's surface.

As used herein, the term "hydrocarbon-rich formation" refers to any formation that contains more than trace amounts of hydrocarbons. For example, a hydrocarbon-rich formation may include portions that contain hydrocarbons at a level of greater than 5 percent by volume. The hydrocarbons located in a hydrocarbon-rich formation may include, for example, oil, natural gas, heavy hydrocarbons, and solid hydrocarbons.

As used herein, the term "organic-rich rock" refers to any rock matrix holding solid hydrocarbons and/or heavy hydrocarbons. Rock matrices may include, but are not limited to, sedimentary rocks, shales, siltstones, sands, silicilytes, carbonates, and diatomites. Organic-rich rock may contain kerogen.

As used herein, the term "formation" refers to any definable subsurface region. The formation may contain one or more hydrocarbon-containing layers, one or more non-hydrocarbon containing layers, an overburden, and/or an underburden of any geologic formation. An "overburden" and/or an "underburden" is geological material above or below the formation of interest.

An overburden or underburden may include one or more different types of substantially impermeable materials. For example, overburden and/or underburden may include sandstone, shale, mudstone, or wet/tight carbonate (i.e., an impermeable carbonate without hydrocarbons). An overburden and/or an underburden may include a hydrocarbon-containing layer that is relatively impermeable. In some cases, the overburden and/or underburden may be permeable.

As used herein, the term "organic-rich rock formation" refers to any formation containing organic-rich rock. Organic-rich rock formations include, for example, oil shale formations, coal formations, and tar sands formations.

As used herein, the term "pyrolysis" refers to the breaking of chemical bonds through the application of heat. For example, pyrolysis may include transforming a compound into one or more other substances by heat alone or by heat in combination with an oxidant. Pyrolysis may include modifying the nature of the compound by addition of hydrogen atoms which may be obtained from molecular hydrogen, water, carbon dioxide, or carbon monoxide. Heat may be transferred to a section of the formation to cause pyrolysis.

As used herein, the term "water-soluble minerals" refers to minerals that are soluble in water. Water-soluble minerals include, for example, nahcolite (sodium bicarbonate), soda ash (sodium carbonate), dawsonite ($NaAl(CO_3)(OH)_2$), or combinations thereof. Substantial solubility may require heated water and/or a non-neutral pH solution.

As used herein, the term "formation water-soluble minerals" refers to water-soluble minerals that are found naturally in a formation.

As used herein, the term "subsidence" refers to a downward movement of an earth surface relative to an initial elevation of the surface.

As used herein, the term "thickness" of a layer refers to the distance between the upper and lower boundaries of a cross section of a layer, wherein the distance is measured normal to the average tilt of the cross section.

As used herein, the term "thermal fracture" refers to fractures created in a formation caused directly or indirectly by expansion or contraction of a portion of the formation and/or fluids within the formation, which in turn is caused by increasing/decreasing the temperature of the formation and/or fluids within the formation, and/or by increasing/decreasing a pressure of fluids within the formation due to heating. Thermal fractures may propagate into or form in neighboring regions significantly cooler than the heated zone.

As used herein, the term "hydraulic fracture" refers to a fracture at least partially propagated into a formation, wherein the fracture is created through injection of pressurized fluids into the formation. While the term "hydraulic fracture" is used, the inventions herein are not limited to use in hydraulic fractures. The invention is suitable for use in any fracture created in any manner considered to be suitable by one skilled in the art. The fracture may be artificially held open by injection of a proppant material. Hydraulic fractures may be substantially horizontal in orientation, substantially vertical in orientation, or oriented along any other plane.

As used herein, the term "wellbore" refers to a hole in the subsurface made by drilling or insertion of a conduit into the subsurface. A wellbore may have a substantially circular cross section, or other cross-sectional shape (e.g., an oval, a square, a rectangle, a triangle, or other regular or irregular shapes). As used herein, the term "well", when referring to an opening in the formation, may be used interchangeably with the term "wellbore."

As used herein, the term "start-up time" refers to the time at which production fluids from a group of wells within a development area begins.

Description of Selected Specific Embodiments

The inventions are described herein in connection with certain specific embodiments. However, to the extent that the following detailed description is specific to a particular embodiment or a particular use, such is intended to be illustrative only and is not to be construed as limiting the scope of the inventions.

As discussed herein, some embodiments of the inventions include or have application related to an in situ method of recovering natural resources. The natural resources may be recovered from a formation containing organic-rich rock including, for example, an oil shale formation. The organic-rich rock may include formation hydrocarbons such as kerogen, coal, or heavy hydrocarbons. In some embodiments of the inventions the natural resources may include hydrocarbon fluids including, for example, products of the pyrolysis of formation hydrocarbons such as shale oil. In some embodiments of the inventions the natural resources may also include water-soluble minerals including, for example, nahcolite (sodium bicarbonate, or $2NaHCO_3$), soda ash (sodium carbonate, or $Na_2CO_3$) and dawsonite ($NaAl(CO_3)(OH)_2$).

FIG. 1 presents a perspective view of an illustrative oil shale development area 10. A surface 12 of the development area 10 is indicated. Below the surface 12 are various subsurface strata 20. The strata 20 include, for example, an organic-rich rock formation 22 and a non-organic-rich rock formation 28 there below. The illustrative organic-rich rock formation 22 contains formation hydrocarbons (such as, for example, kerogen) and possibly valuable water-soluble minerals (such as, for example, nahcolite).

It is understood that the representative formation 22 may be any organic-rich rock formation, including a rock matrix containing coal or tar sands, for example. In addition, the rock matrix making up the formation 22 may be permeable, semi-permeable or non-permeable. The present inventions are particularly advantageous in shale oil development areas initially having very limited or effectively no fluid permeability.

In order to access formation 22 and recover natural resources therefrom, a plurality of wellbores is formed. First, certain wellbores 14 are shown along a periphery of the development area 12. These wellbores 14 are designed originally to serve as heater wells. The heater wells provide heat to pyrolyze hydrocarbon solids in the organic-rich rock formation 22. In some embodiments, a well spacing of 15 to 25 feet is provided for the heater wells 14. Subsequent to the pyrolysis process, the peripheral wellbores 14 may be converted to water injection wells. Selected injection wells 14 are denoted with a downward arrow "I."

The illustrative wellbores 14 are presented in so-called "line drive" arrangements. However, as discussed more fully in connection with FIG. 4, various other arrangements may be provided. The inventions disclosed herein are not limited to the arrangement of or method of selection for heater wells or water injection wells.

Additional wellbores 16 are shown at 14 internal to the development area 10. These represent production wells. The representative wellbores 16 for the production wells are essentially vertical in orientation relative to the surface 12. However, it is understood that some or all of the wellbores 16 for the production wells could deviate into an obtuse or even horizontal orientation. Selected production wells 16 are denoted with an upward arrow "P."

In the arrangement of FIG. 1, each of the wellbores 14 and 16 is completed in the oil shale formation 22. The completions may be either open or cased hole. The well completions for the production well 16 may also include propped or unpropped hydraulic fractures emanating therefrom. Subsequent to production, some of these internal wellbores 16 may be converted to water production wells.

In the view of FIG. 1, only eight wellbores 14 are shown for the injection wells and only eight wellbores 16 are shown for the production wells. However, it is understood that in an oil shale development project, numerous additional wellbores 14 and 16 will most likely be drilled. The wellbores 16 for the production wells may be located in relatively close proximity, being from 10 feet to up to 300 feet in separation. Alternatively, the wellbores may be spaced from 30 to 200 feet or 50 to 100 feet.

Typically, the wellbores 14 are also completed at shallow depths, being from 200 to 5,000 feet at true vertical depth. Alternatively, the wellbores may be completed at depths from 1,000 to 4,000 feet, or 1,500 to 3,500 feet. In some embodiments, the oil shale formation targeted for in situ retorting is at a depth greater than 200 feet below the surface or alternatively 400 feet below the surface. In alternative embodiments, the oil shale formation targeted for in situ retorting is at a depth greater than 500, 1,000, or 1,500 feet below the surface. In alternative embodiments, the oil shale formation targeted for in situ retorting is at a depth between 200 and 5,000 feet, alternatively between 1,000 and 4,000 feet, 1,200 and 3,700 feet, or 1,500 and 3,500 feet below the surface.

The wellbores 14 and 16 may be selected for certain initial functions before being converted to water injection wells and oil production wells and/or water-soluble mineral solution production wells. In one aspect, the wellbores 14 and 16 are dimensioned to serve two, three, or four different purposes in designated sequences. Suitable tools and equipment may be sequentially run into and removed from the wellbores 14 and 16 to serve the various purposes.

A production fluids processing facility 60 is also shown schematically in FIG. 1. The processing facility 60 is equipped to receive fluids produced from the organic-rich rock formation 22 through one or more pipelines or flow lines 76. The fluid processing facility 60 may include equipment suitable for receiving and separating oil, gas, and water produced from the heated formation 22. The fluids processing facility 60 may further include equipment for separating out dissolved water-soluble minerals and/or migratory contaminant species, including, for example, dissolved organic contaminants, metal contaminants, or ionic contaminants in the produced water recovered from the organic-rich rock formation 16. If the pyrolysis is performed in the absence of oxygen or air, the contaminant species may include aromatic hydrocarbons. These may include, for example, benzene, toluene, xylene, and tri-methylbenzene. The contaminants may also include polyaromatic hydrocarbons such as anthracene, naphthalene, chrysene and pyrene. Metal contaminants may include species containing arsenic, chromium, mercury, selenium, lead, vanadium, nickel, cobalt, molybdenum, or zinc. Ionic contaminant species may include, for example, sulfates, chlorides, fluorides, lithium, potassium, aluminum, ammonia, and nitrates. Other species such as sulfates, ammonia, aluminum, potassium, magnesium, chlorides, flourides and phenols may also exist. If oxygen or air is employed, contaminant species may also include ketones, alcohols, and cyanides. Further, the specific migratory contaminant species present may include any subset or combination of the above-described species.

Figure 2A:
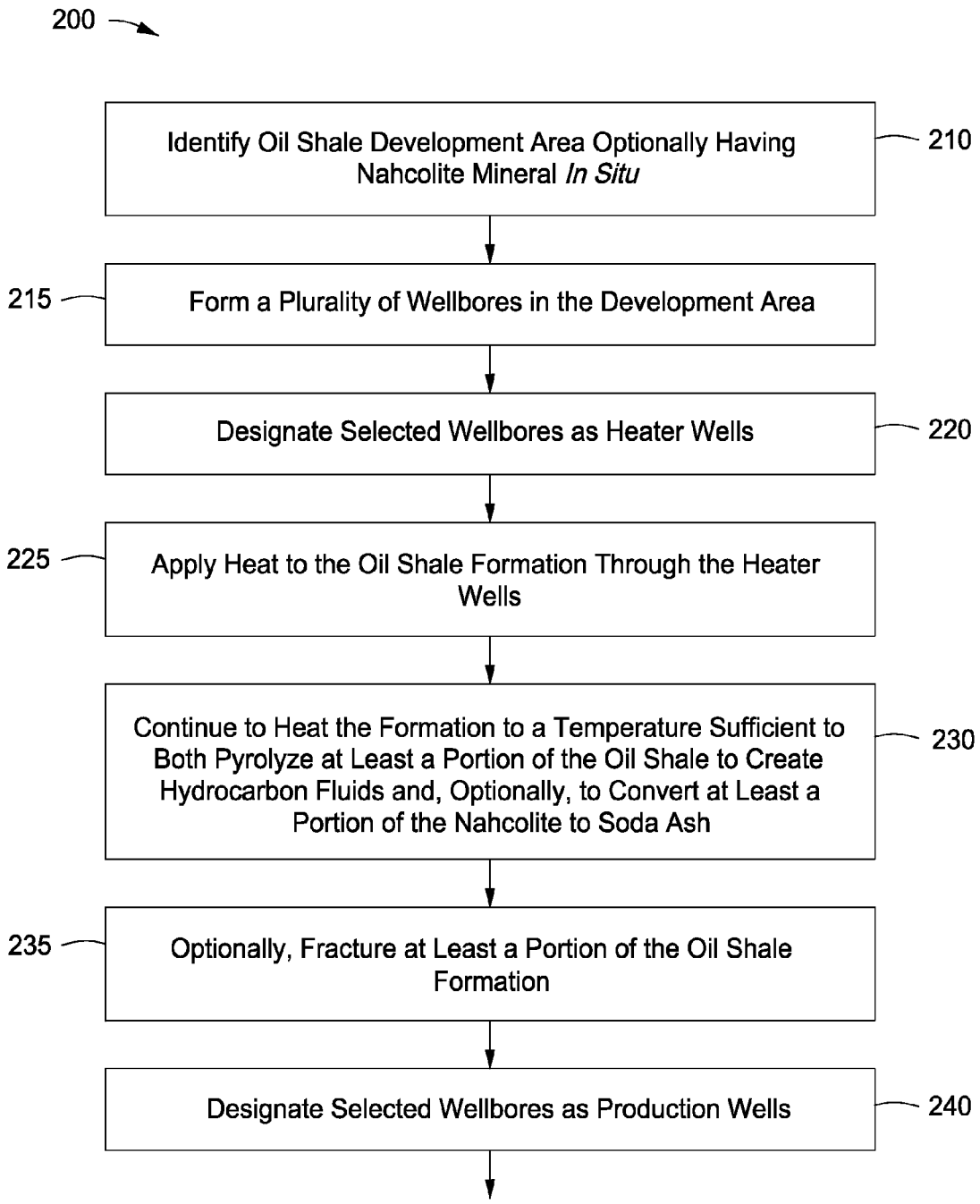
FIGS. 2A-2B present a unified flow chart demonstrating a general method of in situ thermal recovery of oil and gas from an organic-rich rock formation, in one embodiment.
Figure 2B:
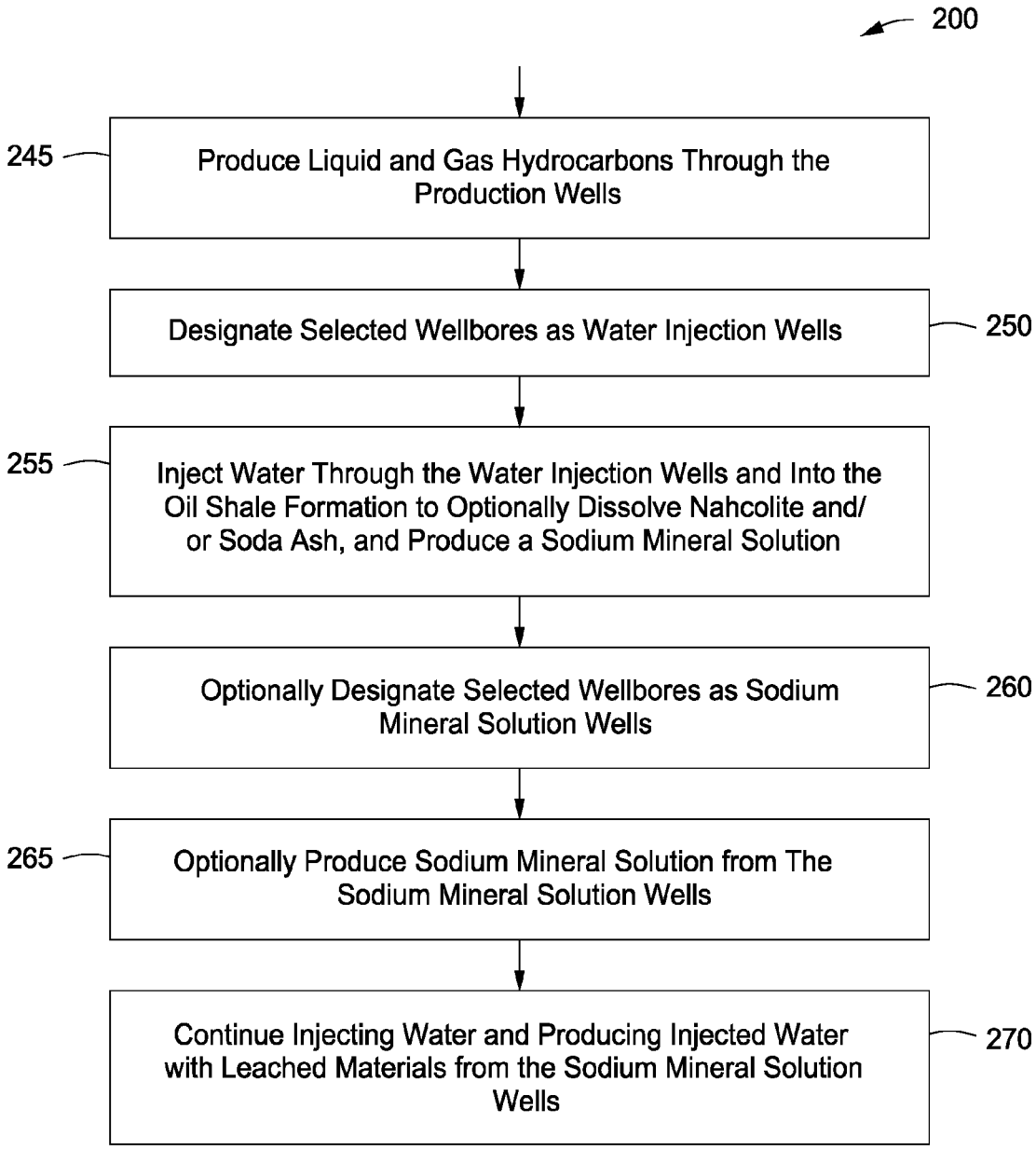

In order to recover oil, gas, and sodium (or other) water-soluble minerals, a series of steps may be undertaken. FIG. 2 presents a flow chart demonstrating a method 200 of in situ thermal recovery of oil and gas from an organic-rich rock formation, in one embodiment. It is understood that the order of some of the steps from FIG. 2 may be changed, and that the sequence of steps is merely for illustration.

First, an oil shale development area 10 is identified. This step is shown in Box 210. The oil shale development area includes an oil shale (or other organic-rich rock) formation 22. Optionally, the oil shale formation 22 contains nahcolite or other sodium minerals.

The targeted development area 10 within the oil shale formation 22 may be identified by measuring or modeling the depth, thickness and organic richness of the oil shale as well as evaluating the position of the formation 22 relative to other rock types, structural features (e.g. faults, anticlines or synclines), or hydrogeological units (i.e. aquifers). This is accomplished by creating and interpreting maps and/or models of depth, thickness, organic richness and other data from available tests and sources. This may involve performing geological surface surveys, studying outcrops, performing seismic surveys, and/or drilling boreholes to obtain core samples from subsurface rock.

In some fields, formation hydrocarbons, such as oil shale, may exist in more than one subsurface formation. In some instances, the organic-rich rock formations may be separated by rock layers that are hydrocarbon-free or that otherwise have little or no commercial value. Therefore, it may be desirable for the operator of a field under hydrocarbon development to undertake an analysis as to which of the subsurface, organic-rich rock formations to target or in which order they should be developed.

The organic-rich rock formation may be selected for development based on various factors. One such factor is the thickness of the hydrocarbon-containing layer within the formation. Greater pay zone thickness may indicate a greater potential volumetric production of hydrocarbon fluids. Each of the hydrocarbon-containing layers may have a thickness that varies depending on, for example, conditions under which the formation hydrocarbon-containing layer was formed. Therefore, an organic-rich rock formation 22 will typically be selected for treatment if that formation includes at least one formation hydrocarbon-containing layer having a thickness sufficient for economical production of produced hydrocarbon fluids.

An organic-rich rock formation 22 may also be chosen if the thickness of several layers that are closely spaced together is sufficient for economical production of produced fluids. For example, an in situ conversion process for formation hydrocarbons may include selecting and treating a layer within an organic-rich rock formation having a thickness of greater than about 5 meters, 10 meters, 50 meters, or even 100 meters. In this manner, heat losses (as a fraction of total injected heat) to layers formed above and below an organic-rich rock formation may be less than such heat losses from a thin layer of formation hydrocarbons. A process as described herein, however, may also include selecting and treating layers that may include layers substantially free of formation hydrocarbons or thin layers of formation hydrocarbons.

The richness of one or more organic-rich rock formations may also be considered. For an oil shale formation, richness is generally a function of the kerogen content. The kerogen content of the oil shale formation may be ascertained from outcrop or core samples using a variety of data. Such data may include organic carbon content, hydrogen index, and modified Fischer assay analyses. The Fischer Assay is a standard method which involves heating a sample of a formation hydrocarbon containing layer to approximately 500° C. in one hour, collecting fluids produced from the heated sample, and quantifying the amount of fluids produced.

Richness may depend on many factors including the conditions under which the formation hydrocarbon-containing layer was formed, an amount of formation hydrocarbons in the layer, and/or a composition of formation hydrocarbons in the layer. A thin and rich formation hydrocarbon layer may be able to produce significantly more valuable hydrocarbons than a much thicker, less rich formation hydrocarbon layer. Of course, producing hydrocarbons from a formation that is both thick and rich is desirable.

Subsurface permeability may also be assessed via rock samples, outcrops, or studies of ground water flow. Furthermore the connectivity of the development area to ground water sources may be assessed. An organic-rich rock formation may be chosen for development based on the permeability or porosity of the formation matrix even if the thickness of the formation is relatively thin. Reciprocally, an organic-rich rock formation may be rejected if there appears to be vertical continuity with groundwater.

Other factors known to petroleum engineers may be taken into consideration when selecting a formation for development. Such factors include depth of the perceived pay zone, continuity of thickness, and other factors. For instance, the organic content or richness of rock within a formation will also effect eventual volumetric production.

Next, a plurality of wellbores 14, 16 is formed across the targeted development area 10. This step is shown schematically in Box 215. For purposes of the wellbore formation step of Box 215, only a portion of the wellbores need be completed initially. For instance, at the beginning of the project heat injection wells are needed, while a majority of the hydrocarbon production wells are not yet needed. Production wells may be brought in once conversion begins, such as after 4 to 12 months of heating.

The purpose for heating the organic-rich rock formation is to pyrolyze at least a portion of the solid formation hydrocarbons to create hydrocarbon fluids. The solid formation hydrocarbons may be pyrolyzed in situ by raising the organic-rich rock formation, (or heated zones within the formation), to a pyrolyzation temperature. In certain embodiments, the temperature of the formation may be slowly raised through the pyrolysis temperature range. For example, an in situ conversion process may include heating at least a portion of the organic-rich rock formation to raise the average temperature of the zone above about 270° C. at a rate less than a selected amount (e.g., about 10° C., 5° C.; 3° C., 1° C., 0.5° C., or 0.1° C.) per day. In a further embodiment, the portion may be heated such that an average temperature of the selected zone may be less than about 375° C. or, in some embodiments, less than about 400° C.

The formation may be heated such that a temperature within the formation reaches (at least) an initial pyrolyzation temperature, that is, a temperature at the lower end of the temperature range where pyrolyzation begins to occur. The pyrolysis temperature range may vary depending on the types of formation hydrocarbons within the formation, the heating methodology, and the distribution of heating sources. For example, a pyrolysis temperature range may include temperatures between about 270° C. and about 900° C. Alternatively, the bulk of the target zone of the formation may be heated to between 300° to 600° C. In an alternative embodiment, a pyrolysis temperature range may include temperatures between about 270° C. to about 500° C.

It is understood that petroleum engineers will develop a strategy for the best depth and arrangement for the wellbores 14, 16 depending upon anticipated reservoir characteristics, economic constraints, and work scheduling constraints. In addition, engineering staff will determine what wellbores 14 shall be used for initial formation 22 heating. This selection step is represented by Box 220.

Concerning heat injection wells, there are various methods for applying heat to the organic-rich rock formation 22. The methods disclosed herein are not limited to the heating technique employed unless specifically so stated in the claims. The heating step is represented generally by Box 225.

The organic-rich rock formation 22 is heated to a temperature sufficient to pyrolyze at least a portion of the oil shale in order to convert the kerogen to hydrocarbon fluids. The conversion step is represented in FIG. 2 by Box 230. The resulting liquids and hydrocarbon gases may be refined into products which resemble common commercial petroleum products. Such liquid products include transportation fuels such as diesel, jet fuel and naphtha. Generated gases include light alkanes, light alkenes, $H_2$, $CO_2$, CO, and $NH_3$.

Preferably, for in situ processes the heating and conversion steps of Boxes 225 and 230 occur over a lengthy period of time. In one aspect, the heating period is from three months to four or more years. Alternatively, the formation may be heated for one to fifteen years, alternatively, 3 to 10 years, 1.5 to 7 years, or 2 to 5 years. Also as an optional part of Box 230, the formation 22 may be heated to a temperature sufficient to convert at least a portion of nahcolite, if present, to soda ash. In this respect, heat applied to mature the oil shale and recover oil and gas will also convert nahcolite to sodium carbonate (soda ash), a related sodium mineral. The process of converting nahcolite (sodium bicarbonate) to soda ash (sodium carbonate) is described herein.

Some production procedures include in situ heating of an organic-rich rock formation that contains both formation hydrocarbons and formation water-soluble minerals prior to substantial removal of the formation water-soluble minerals from the organic-rich rock formation. In some embodiments of the invention there is no need to partially, substantially or completely remove the water-soluble minerals prior to in situ heating.

Conversion of oil shale into hydrocarbon fluids will create permeability in rocks in the formation 22 that were originally substantially impermeable. For example, permeability may increase due to formation of thermal fractures within a heated portion caused by application of heat. As the temperature of the heated portion increases, water may be removed due to vaporization. The vaporized water may escape and/or be removed from the formation. In addition, permeability of the heated portion may also increase as a result of production of hydrocarbon fluids from pyrolysis of at least some of the formation hydrocarbons within the heated portion on a macroscopic scale.

In one embodiment, the organic-rich rock formation has an initial total permeability less than 1 millidarcy, alternatively less than 0.1 or even 0.01 millidarcies, before heating the organic-rich rock formation. Permeability of a selected zone within the heated portion of the organic-rich rock formation 22 may rapidly increase while the selected zone is heated by conduction. For example, pyrolyzing at least a portion of organic-rich rock formation may increase permeability within a selected zone of the portion to about 1 millidarcy, alternatively, greater than about 10 millidarcies, 50 millidarcies, 100 millidarcies, 1 Darcy, 10 Darcies, 20 Darcies, or 50 Darcies. Therefore, a permeability of a selected zone of the portion may increase by a factor of more than about 10, 100, 1,000, 10,000, or 100,000.

In connection with the heating step 225, the organic-rich rock formation 22 may optionally be fractured to aid heat transfer or later hydrocarbon fluid production. The optional fracturing step is shown in Box 235. Fracturing may be accomplished by creating thermal fractures within the formation through application of heat. Thermal fracturing can occur both in the immediate region undergoing heating, and in cooler neighboring regions. The thermal fracturing in the neighboring regions is due to propagation of fractures and tension stresses developed due to the expansion in the hotter zones. Thus, by both heating the organic-rich rock and transforming the kerogen to oil and gas, the permeability is increased not only from fluid formation and vaporization, but also via thermal fracture formation. The increased permeability aids fluid flow within the formation and production of the hydrocarbon fluids generated from the kerogen.

Alternatively, a process known as hydraulic fracturing may be used. Hydraulic fracturing is a process known in the art of oil and gas recovery where an injection fluid is pressurized within the wellbore above the fracture pressure of the formation, thus developing fracture planes within the formation to relieve the pressure generated within the wellbore. Hydraulic fractures may be used to create additional permeability in portions of the formation 22 and/or be used to provide a planar source for heating.

International patent publication WO 2005/010320 entitled "Methods of Treating a Subterranean Formation to Convert Organic Matter into Producible Hydrocarbons" describes one use of hydraulic fracturing, and is incorporated herein by reference in its entirety. This international patent publication teaches the use of electrically conductive fractures to heat oil shale. A heating element is constructed by forming wellbores and then hydraulically fracturing the oil shale formation around the wellbores. The fractures are filled with an electrically conductive material which forms the heating element. Calcined petroleum coke is an exemplary suitable conductant material. Preferably, the fractures are created in a vertical orientation extending from horizontal wellbores. Electricity may be conducted through the conductive fractures from the heel to the toe of each well. The electrical circuit may be completed by an additional horizontal well that intersects one or more of the vertical fractures near the toe to supply the opposite electrical polarity. The WO 2005/010320 process creates an "in situ toaster" that artificially matures oil shale through the application of electric heat. Thermal conduction heats the oil shale to conversion temperatures in excess of about 300° C., causing artificial maturation.

International patent publication WO 2005/045192 teaches an alternative heating means that employs the circulation of a heated fluid within an oil shale formation. In the process of WO 2005/045192, supercritical heated naphtha may be circulated through fractures in the formation. This means that the oil shale is heated by circulating a dense, hot hydrocarbon vapor through sets of closely-spaced hydraulic fractures. In one aspect, the fractures are horizontally formed and conventionally propped. Fracture temperatures of 320°-400° C. are maintained for up to five to ten years. Vaporized naphtha may be the preferred heating medium due to its high volumetric heat capacity, ready availability and relatively low degradation rate at the heating temperature. In the WO 2005/045192 process, as the kerogen matures, fluid pressure will drive the generated oil to the heated fractures where it will be produced with the cycling hydrocarbon vapor.

As part of the hydrocarbon fluid production process 200, certain wellbores 16 may be designated as oil and gas production wells. This step is depicted by Box 240. Oil and gas production might not be initiated until it is determined that the kerogen has been sufficiently retorted to allow a steady flow of oil and gas from the formation 22. In some instances, dedicated production wells are not drilled until after heat injection wells 14 (Box 230) have been in operation for a period of several weeks or months. Thus, Box 240 may include the formation of additional wellbores 16 for production. In other instances, selected heater wells are converted to production wells.

After certain wellbores 16 have been designated as oil and gas production wells, oil and/or gas is produced from the wellbores 16. The oil and/or gas production process is shown at Box 245. At this stage (Box 245), any water-soluble minerals, such as nahcolite and converted soda ash likely remain substantially trapped in the organic-rich rock formation 22 as finely disseminated crystals or nodules within the oil shale beds, and are not produced. However, some nahcolite and/or soda ash may be dissolved in the water created during heat conversion (Box 235) within the formation. Thus, production fluids may contain not only hydrocarbon fluids, but also aqueous fluid containing water-soluble minerals. In such a case, the production fluids may be separated into a hydrocarbon stream and an aqueous stream at the surface production fluids processing facility 60. Thereafter, the water-soluble minerals and any migratory contaminant species may be recovered from the aqueous stream as discussed more fully below.

Box 250 presents an optional next step in the oil and gas recovery method 100. Here, certain wellbores 14 are designated as water or aqueous fluid injection wells. This is preferably done after the production wells have ceased operation.

The aqueous fluids used for the injection wells are solutions of water with other species. The water may constitute "brine," and may include dissolved inorganic salts of chloride, sulfates and carbonates of Group I and II elements of The Periodic Table of Elements. Organic salts can also be present in the aqueous fluid. The water may alternatively be fresh water containing other species. The other species may be present to alter the pH. Alternatively, the other species may reflect the availability of brackish water not saturated in the species wished to be leached from the subsurface. Preferably, wellbores used for the water injection wells are selected from some or all of the wellbores initially used for heat injection or for oil and/or gas production. However, the scope of the step of Box 250 may include the drilling of yet additional wellbores 14 for use as dedicated water injection wells. Injection wells serve to create a boundary of high pressure.

Next, water or an aqueous fluid may be injected through the water injection wells and into the oil shale formation 16. This step is shown at Box 255. The water may be in the form of steam or pressurized hot water. Alternatively the injected water may be cool and becomes heated as it contacts the previously heated formation. The injection process may further induce fracturing. This process may create fingered caverns and brecciated zones in the nahcolite-bearing intervals some distance, for example up to 200 feet out, from the water injection wellbores. In one aspect, a gas cap, such as nitrogen, may be maintained at the top of each "cavern" to prevent vertical growth.

Along with the designation of certain wellbores 14 as water injection wells, the design engineers may also designate certain wellbores 16 as water production wells. This step is shown in Box 260. These wells may be the same as wells used to previously produce hydrocarbons. The water production wells may be used to produce an aqueous solution of dissolved water-soluble minerals and other species, including, for example, migratory contaminant species. For example, the solution may be one primarily of dissolved soda ash. This step is shown in Box 265. Alternatively, single wellbores may be used to both inject water and then later to recover a sodium mineral solution. Thus, Box 265 includes the option of using the same wellbores 16 for both water injection and water or aqueous solution production (Box 265).

The use of wellbores for more than one purpose helps to lower project costs and/or decrease the time required to perform certain tasks. For example, one or more of the production wells may also be used as injection wells for later injecting water into the organic-rich rock formation. Alternatively, one or more of the production wells may also be used as water production wells for later circulating an aqueous solution through the organic-rich rock formation in order to leach out migratory contaminant species.

In other aspects, production wells (and in some circumstances heater wells) may initially be used as dewatering wells (e.g., before heating is begun and/or when heating is initially started). In addition, in some circumstances dewatering wells can later be used as production wells (and in some circumstances heater wells). As such, the dewatering wells may be placed and/or designed so that such wells can be later used as production wells and/or heater wells. The heater wells may be placed and/or designed so that such wells can be later used as production wells and/or dewatering wells. The production wells may be placed and/or designed so that such wells can be later used as dewatering wells and/or heater wells. Similarly, injection wells may be wells that initially were used for other purposes (e.g., heating, production, dewatering, monitoring, etc.), and injection wells may later be used for other purposes. Similarly, monitoring wells may be wells that initially were used for other purposes (e.g., heating, production, dewatering, injection, etc.). Finally, monitoring wells may later be used for other purposes such as water production.

Figure 3:
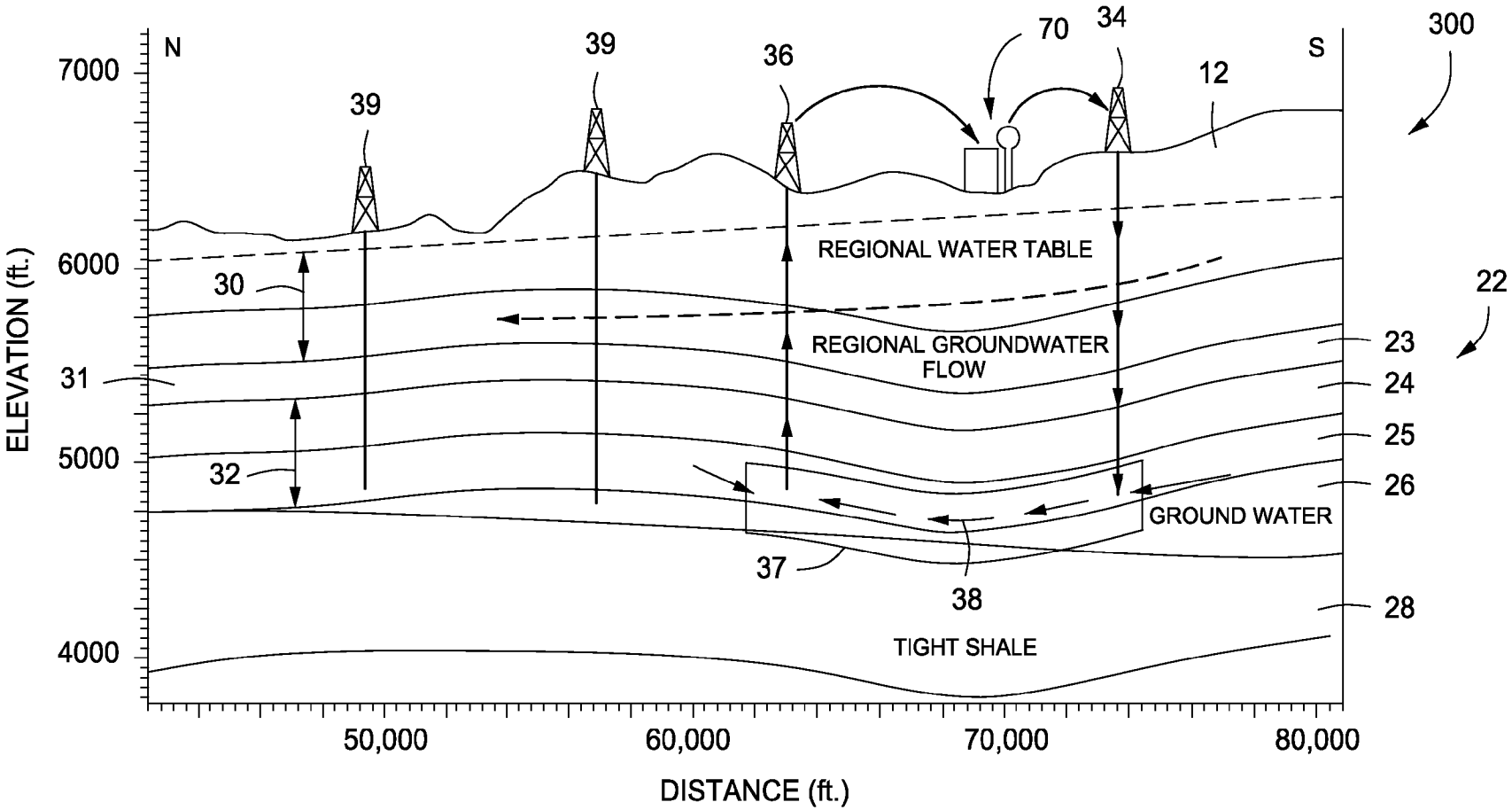
FIG. 3 is a cross-sectional side view of an illustrative oil shale formation that is within or connected to groundwater aquifers and a formation leaching operation.

The circulation of water through a shale oil formation is shown in one embodiment in FIG. 3. FIG. 3 presents a field 300 under hydrocarbon development. A cross-sectional view of an illustrative oil shale formation 22 is seen within the field 300. Four separate oil shale formation zones 23, 24, 25 and 26 are depicted within the oil shale formation 22. This includes an oil shale area 37 within zones 25 and 26.

The formation 22 is within or connected to ground water aquifers and a formation leaching operation. The water aquifers are below the ground surface 12, and are categorized as an upper aquifer 30 and a lower aquifer 32. Intermediate the upper 30 and lower 32 aquifers is an aquitard 31. It can be seen that certain zones of the formation 22 are both aquifers or aquitards and oil shale zones.

A pair of wells 34, 36 is shown traversing vertically downward through the aquifers 30, 32. One of the wells is serving as a water injection well 34, while another is serving as a water production well 30. In this way, water is circulated 38 through at least the lower aquifer 32. A tight shale" formation underlies the aquifers 30, 32.

FIG. 3 shows diagrammatically water circulating 38 through an oil shale volume 37 that was heated, that resides within or is connected to the lower aquifer 32, and from which hydrocarbon fluids were previously recovered. Introduction of water via the water injection well 34 forces water into the previously heated oil shale 37 and water-soluble minerals and migratory contaminants species are swept to the water production well 36. The water may then be processed in a water treatment facility (not shown) wherein the water-soluble minerals (e.g. nahcolite or soda ash) and the migratory contaminants may be substantially removed from the water stream. The migratory contaminant species may be removed through use of, for example, an adsorbent material, reverse osmosis, chemical oxidation, bio-oxidation, hot lime softening and/or ion exchange. Examples of these processes are individually known in the art. Exemplary adsorbent materials may include activated carbon, clay, or fuller's earth.

In one aspect, an operator may calculate a pore volume of the oil shale formation after hydrocarbon production is completed. The operator will then circulate an amount of water equal to one pore volume for the primary purpose of producing the aqueous solution of dissolved soda ash and other water-soluble sodium minerals. The operator may then circulate an amount of water equal to two, three, four or even five additional pore volumes for the purpose of leaching out any remaining water-soluble minerals and other non-aqueous species, including, for example, remaining hydrocarbons and migratory contaminant species. The produced water is carried through the water treatment facility. The step of injecting water and then producing the injected water with leached minerals is demonstrated in Box 270.

Water is re-injected into the oil shale volume 37 and the formation leaching is repeated. This leaching with water is intended to continue until levels of migratory contaminant species are at environmentally acceptable levels within the previously heated oil shale zone 37. This may require one cycle, two cycles, five cycles or more cycles of formation leaching, where a single cycle indicates injection and production of approximately one pore volume of water.

The injected water may be treated to increase the solubility of the migratory contaminant species and/or the water-soluble minerals. The adjustment may include the addition of an acid or base to adjust the pH of the solution. The resulting aqueous solution may then be produced from the organic-rich rock formation to the surface for processing.

The circulation of water through the oil shale volume 37 is preferably completed after a substantial portion of the hydrocarbon fluids have been produced from the matured organic-rich rock. In some embodiments, the circulation step (Box 270) may be delayed after the hydrocarbon fluid production step (Box 245). The circulation, or "leaching," may be delayed to allow heat generated from the heating step to migrate deeper into surrounding unmatured organic-rich rock zones to convert nahcolite within the surrounding unmatured organic-rich rock zones to soda ash. Alternatively, the leaching may be delayed to allow heat generated from the heating step to generate permeability within the surrounding unmatured organic-rich rock zones. Further, the leaching may be delayed based on current and/or forecast market prices of sodium bicarbonate, soda ash.

Removal of water-soluble minerals may represent the degree of removal of a water-soluble mineral that occurs from any commercial solution mining operation as known in the art. Substantial removal of a water-soluble mineral may be approximated as removal of greater than 5 weight percent of the total amount of a particular water-soluble mineral present in the zone targeted for hydrocarbon fluid production in the organic-rich rock formation. In alternative embodiments, in situ heating of the organic-rich rock formation to pyrolyze formation hydrocarbons may be commenced prior to removal of greater than 3 weight percent, alternatively 7 weight percent, 10 weight percent or 13 weight percent of the formation water-soluble minerals from the organic-rich rock formation.

The water-soluble minerals may include sodium. The water-soluble minerals may also include nahcolite (sodium bicarbonate), soda ash (sodium carbonate), dawsonite ($NaAl(CO_3)(OH)_2$), or combinations thereof After partial or complete removal of the water-soluble minerals, at least some of the aqueous solution may be re-injected into a subsurface formation where it may be sequestered. The subsurface formation may be the same as or different from the original organic-rich rock formation. Assuming that state environmental standards are met, other circulated water may be released into the local watershed or a nearby stream.

The step of producing a sodium mineral solution (Box 265) may include processing an aqueous solution containing water-soluble minerals in a surface facility to remove a portion of the water-soluble minerals therein. The processing step may include removing the water-soluble minerals by precipitation caused by altering the temperature of the aqueous solution. The surface processing may convert soda ash to sodium bicarbonate (nahcolite) in the surface facility by reaction with $CO_2$.

The impact of heating oil shale to produce oil and gas prior to producing nahcolite is to convert the nahcolite to a more recoverable form (soda ash), and provide permeability facilitating its subsequent recovery. Water-soluble mineral recovery may take place as soon as the retorted oil is produced, or it may be left for a period of years for later recovery. If desired, the soda ash can be readily converted back to nahcolite on the surface. The ease with which this conversion can be accomplished makes the two minerals effectively interchangeable.

During the pyrolysis and water circulation processes, migration of hydrocarbon fluids and migratory contaminant species may be contained by creating a peripheral area in which the temperature of the formation is maintained below a pyrolysis temperature. Preferably, the temperature of the formation is maintained below the freezing temperature of in situ water. The use of subsurface freezing to stabilize poorly consolidated soils or to provide a barrier to fluid flow is generally known in the art. Shell Exploration and Production Company has discussed the use of freeze walls for oil shale production in several patents, including U.S. Pat. Nos. 6,880,633 and 7,032,660. Shell's '660 patent uses subsurface freezing to protect against groundwater flow and groundwater contamination during in situ shale oil production. Additional patents that disclose the use of so-called freeze walls are U.S. Pat. Nos. 3,528,252, 3,943,722, 3,729,965, 4,358,222, and 4,607,488.

Freeze walls may be formed by circulating refrigerant through peripheral wells to substantially reduce the temperature of the rock formation 22. This, in turn, prevents the pyrolyzation of kerogen present at the periphery of the field and the outward migration of oil and gas. Freeze walls may also cause native water in the formation along the periphery to freeze. This serves to prevent the migration of pyrolyzed fluids into ground water outside of the field.

Once production of hydrocarbons begins, control of the migration of hydrocarbons and migratory contaminant species can also be obtained via selective placement of injection 16 and production wells 14 such that fluid flow out of the heated zone is minimized. Typically, this involves placing injection wells at the periphery of the heated zone so as to cause pressure gradients which prevent flow inside the heated zone from leaving the zone. The injection wells may inject water, steam, $CO_2$, heated methane, or other fluids to drive cracked kerogen fluids inwardly towards production wells.

It is understood that there may be numerous water injection 34 and water production 36 wells in an actual oil shale development 10. Moreover, the system may include one or more monitoring wells 39 disposed at selected points in the field. The monitoring wells 39 can be utilized during the oil shale heating phase, the shale oil production phase, the leaching phase, or during any combination of these phases to monitor for migratory contaminant species and/or water-soluble minerals. Further, the monitoring wells 39 may be configured with one or more devices that measure a temperature, a pressure, and/or a property of a fluid in the wellbore. In some instances, a production well may also serve as a monitoring well, or otherwise be instrumented.

As noted above, several different types of wells may be used in the development of an organic-rich rock formation, including, for example, an oil shale field. For example, the heating of the organic-rich rock formation may be accomplished through the use of heater wells. The heater wells may include, for example, electrical resistance heating elements. An early patent disclosing the use of electrical resistance heaters to produce oil shale in situ is U.S. Pat. No. 1,666,488. The '488 patent issued to Crawshaw in 1928. Since 1928, various designs for downhole electrical heaters have been proposed. Illustrative designs are presented in U.S. Pat. Nos. 1,701,884, 3,376,403, 4,626,665, 4,704,514, and 6,023,554).

In one aspect, an electrically resistive heater may be formed by providing electrically resistive piping or materials within multiple wellbores. A conductive granular material is then placed between two or three adjacent wellbores, and a current is passed between the wellbores. Passing current through the wellbores causes resistive heat to be generated primarily from elongated conduits or resistive granular material within the wellbores. In another aspect, the resistive heat is generated primarily from electrically conductive material injected into the formation between the adjacent wellbores. An electrical current is passed through the conductive material between the two wellbores so that electrical energy is converted to thermal energy. In either instance, thermal energy is transported to the formation by thermal conduction to heat the organic-rich rocks.

The use of electrical resistors in which an electrical current is passed through a resistive material which dissipates the electrical energy as heat is distinguished from dielectric heating in which a high-frequency oscillating electric current induces electrical currents in nearby materials and causes them to heat.

Co-owned U.S. Pat. Appl. No. 61/109,369 is also instructive. That application was filed on Oct. 29, 2008 and is entitled "Electrically Conductive Methods for Heating a Subsurface Formation to Convert Organic Matter into Hydrocarbon Fluids." The application teaches the use of two or more materials placed within an organic-rich rock formation and having varying properties of electrical resistance. An electrical current is passed through the materials in the formation to generate resistive heat. The materials placed in situ provide for resistive heat without creating hot spots near the wellbores. This patent application is incorporated herein by reference in its entirety.

It is desirable to arrange the heater wells and production wells for an oil shale field in a pre-planned pattern. For instance, heater wells may be arranged in a variety of patterns including, but not limited to triangles, squares, hexagons, and other polygons. The pattern may include a regular polygon to promote uniform heating through at least the portion of the formation in which the heater wells are placed. The pattern may also be a line drive pattern. A line drive pattern generally includes a first linear array of heater wells, a second linear array of heater wells, and a production well or a linear array of production wells between the first and second linear array of heater wells. Injection wells may likewise be disposed within a repetitive pattern of units. The pattern may be similar to or different from that used for the heater wells.

The arrays of heater wells may be disposed such that a distance between each heater well is less than about 70 feet (21 meters). A portion of the formation may be heated with heater wells disposed substantially parallel to a boundary of the hydrocarbon formation. In alternative embodiments, the array of heater wells may be disposed such that a distance between each heater well may be less than about 100 feet, or 50 feet, or 30 feet. Regardless of the arrangement of or distance between the heater wells, in certain embodiments, a ratio of heater wells to production wells disposed within a organic-rich rock formation may be greater than about 5, 8, 10, 20, or more.

Interspersed among the heater wells are typically one or more production wells. In one embodiment, individual production wells are surrounded by at most one layer of heater wells. This may include arrangements such as 5-spot, 7-spot, or 9-spot arrays, with alternating rows of production and heater wells. In another embodiment, two layers of heater wells may surround a production well, but with the heater wells staggered so that a clear pathway exists for the majority of flow away from the further heater wells. Flow and reservoir simulations may be employed to assess the pathways and temperature history of hydrocarbon fluids generated in situ as they migrate from their points of origin to production wells.

Figure 4:
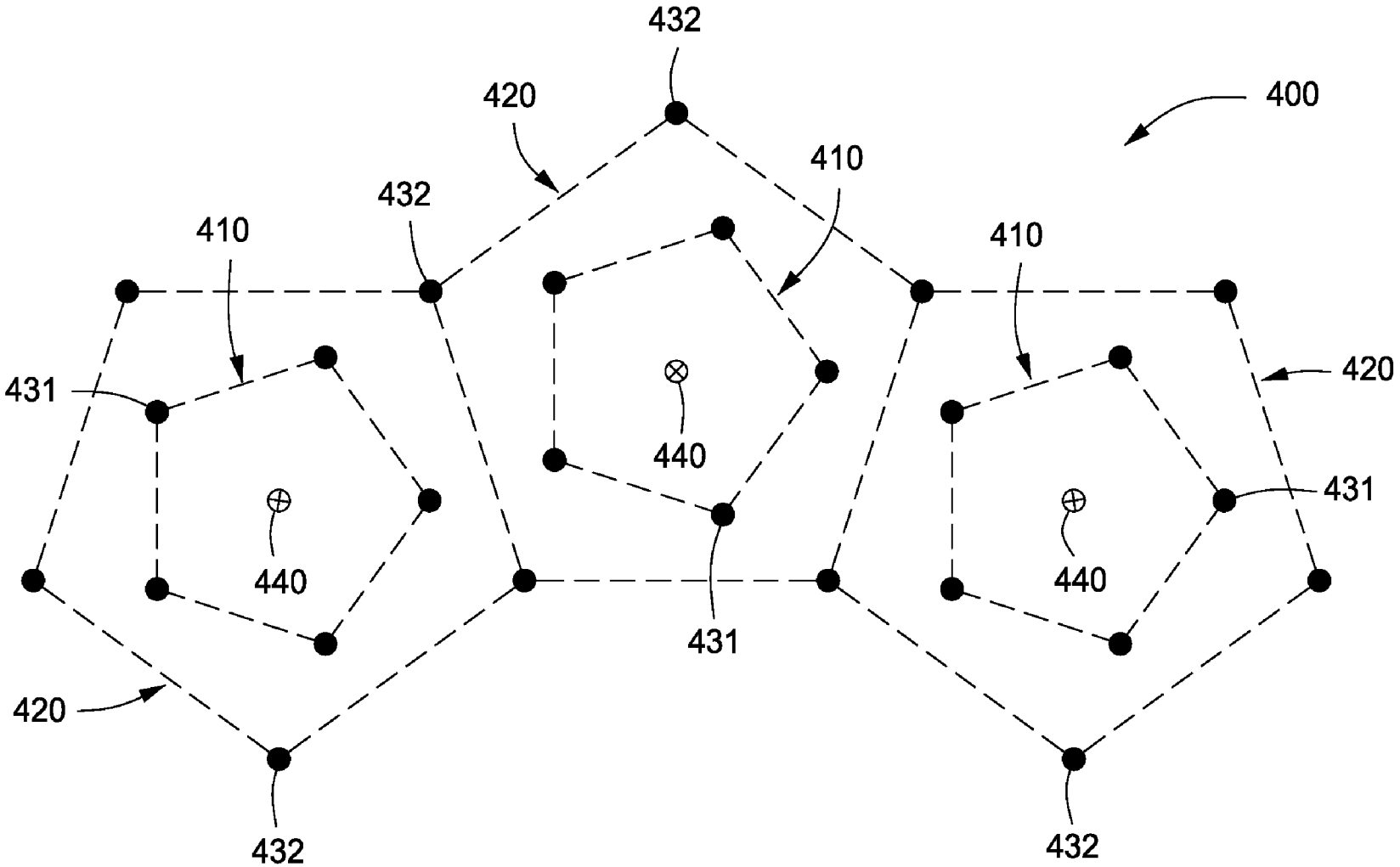
FIG. 4 provides a plan view of an illustrative heater well pattern. Two layers of heater wells are shown surrounding respective production wells.

FIG. 4 provides a plan view of an illustrative heater well arrangement using more than one layer of heater wells. The heater well arrangement is used in connection with the production of hydrocarbons from a shale oil development area 400. In FIG. 4, the heater well arrangement employs a first layer of heater wells 410, surrounded by a second layer of heater wells 420. The heater wells in the first layer 410 are referenced at 431, while the heater wells in the second layer 420 are referenced at 432.

A production well 440 is shown central to the well layers 410 and 420. It is noted that the heater wells 432 in the second layer 420 of wells are offset from the heater wells 431 in the first layer 410 of wells, relative to the production well 440. The purpose is to provide a flowpath for converted hydrocarbons that minimizes travel near a heater well in the first layer 410 of heater wells. This, in turn, minimizes secondary cracking of hydrocarbons converted from kerogen as hydrocarbons flow from the second layer of wells 420 to the production wells 440.

The heater wells 431, 432 in the two layers 410, 420 also may be arranged such that the majority of hydrocarbons generated by heat from each heater well 432 in the second layer 420 are able to migrate to a production well 440 without passing substantially near a heater well 431 in the first layer 410. The heater wells 431, 432 in the two layers 410, 420 further may be arranged such that the majority of hydrocarbons generated by heat from each heater well 432 in the second layer 420 are able to migrate to the production well 440 without passing through a zone of substantially increasing formation temperature.

In the illustrative arrangement of FIG. 4, the first layer 410 and the second layer 420 each defines a 5-spot pattern. However, it is understood that other patterns may be employed, such as 3-spot or 6-spot patterns. In any instance, a plurality of heater wells 431 comprising a first layer of heater wells 410 is placed around a production well 440, with a second plurality of heater wells 432 comprising a second layer of heater wells 420 placed around the first layer 410.

In some instances it may be desirable to use well patterns that are elongated in a particular direction, particularly in a direction determined to provide the most efficient thermal conductivity. Heat convection may be affected by various factors such as bedding planes and stresses within the formation. For instance, heat convection may be more efficient in the direction perpendicular to the least horizontal principal stress on the formation. In some instances, heat convection may be more efficient in the direction parallel to the least horizontal principal stress. Elongation may be practiced in, for example, line drive patterns or spot patterns.

In connection with the development of a shale oil field, it may be desirable that the progression of heat through the subsurface in accordance with steps 225 and 230 be uniform. However, for various reasons the heating and maturation of formation hydrocarbons in a subsurface formation may not proceed uniformly despite a regular arrangement of heater and production wells. Heterogeneities in the oil shale properties and formation structure may cause certain local areas to be more or less productive. Moreover, formation fracturing which occurs due to the heating and maturation of the oil shale can lead to an uneven distribution of preferred pathways and, thus, increase flow to certain production wells and reduce flow to others. Uneven fluid maturation may be an undesirable condition since certain subsurface regions may receive more heat energy than necessary where other regions receive less heat energy than desired. This, in turn, leads to the uneven flow and recovery of production fluids. Produced oil quality, overall production rate, and/or ultimate recoveries may be reduced.

To detect uneven flow conditions, production and heater wells may be instrumented with sensors. Sensors may include equipment to measure temperature, pressure, flow rates, and/or compositional information. Data from these sensors can be processed via simple rules or input to detailed simulations to reach decisions on how to adjust heater and production wells to improve subsurface performance. Production well performance may be adjusted by controlling backpressure or throttling on the well. Heater well performance may also be adjusted by controlling energy input. Sensor readings may also sometimes imply mechanical problems with a well or downhole equipment which requires repair, replacement, or abandonment.

In one embodiment, flow rate, compositional, temperature and/or pressure data are utilized from two or more wells as inputs to a computer algorithm to control heating rate and/or production rates. Unmeasured conditions at or in the neighborhood of the well are then estimated and used to control the well. For example, in situ fracturing behavior and kerogen maturation are estimated based on thermal, flow, and compositional data from a set of wells. In another example, well integrity is evaluated based on pressure data, well temperature data, and estimated in situ stresses. In a related embodiment the number of sensors is reduced by equipping only a subset of the wells with instruments, and using the results to interpolate, calculate, or estimate conditions at uninstrumented wells. Certain wells may have only a limited set of sensors (e.g., wellhead temperature and pressure only) where others have a much larger set of sensors (e.g., wellhead temperature and pressure, bottomhole temperature and pressure, production composition, flow rate, electrical signature, casing strain, etc.).

As noted above, there are various methods for applying heat to an organic-rich rock formation. For example, one method may include electrical resistance heaters disposed in a wellbore or outside of a wellbore. One such method involves the use of electrical resistive heating elements in a cased or uncased wellbore. Electrical resistance heating involves directly passing electricity through a conductive material such that resistive losses cause it to heat the conductive material. Other heating methods include the use of downhole combustors, in situ combustion, radio-frequency (RF) electrical energy, or microwave energy. Still others include injecting a hot fluid into the oil shale formation to directly heat it. The hot fluid may or may not be circulated. The present methods are not limited to the heating technique employed unless so stated in the claims.

A review of application of electrical heating methods for heavy oil reservoirs is given by R. Sierra and S. M. Farouq Ali, "*Promising Progress in Field Application of Reservoir Electrical Heating Methods*", Society of Petroleum Engineers Paper No. 69709 (2001). The entire disclosure of this reference is hereby incorporated by reference.

In certain embodiments of the methods of the present invention, downhole burners may be used to heat a targeted oil shale zone. Downhole burners of various design have been discussed in the patent literature for use in oil shale and other largely solid hydrocarbon deposits. Examples include U.S. Pat. Nos. 2,887,160; 2,847,071; 2,895,555; 3,109,482; 3,225,829; 3,241,615; 3,254,721; 3,127,936; 3,095,031; 5,255,742; and 5,899,269. Downhole burners operate through the transport of a combustible fuel (typically natural gas) and an oxidizer (typically oxygen-enriched air) to a subsurface position in a wellbore. The fuel and oxidizer react downhole to generate heat. The combustion gases are removed, typically by transport to the surface, but possibly via injection into the formation. Oftentimes, downhole burners utilize pipe-in-pipe arrangements to transport fuel and oxidizer downhole, and then to remove the flue gas back up to the surface through the annulus. Some downhole burners generate a flame, while others may not.

Downhole burners have advantages over electrical heating methods due to the reduced infrastructure cost. In this respect, there is no need for an expensive electrical power plant and distribution system. Moreover, there is increased thermal efficiency because the energy losses inherently experienced during electrical power generation are avoided.

Few applications of downhole burners exist due to various design issues. Downhole burner design issues include temperature control and metallurgy limitations. In this respect, the flame temperature can overheat the tubular and burner hardware and cause them to fail via melting, thermal stresses, severe loss of tensile strength, or creep. Certain stainless steels, typically with high chromium content, can tolerate temperatures up to ~700° C. for extended periods. (See for example H. E. Boyer and T. L. Gall (eds.), *Metals Handbook,* "Chapter 16: Heat-Resistant Materials", American Society for Metals, (1985.) The existence of flames can cause hot spots within the burner and in the formation surrounding the burner. This is due to radiant heat transfer from the luminous portion of the flame. However, a typical gas flame can produce temperatures up to about 1,650° C. Materials of construction for the burners must be sufficient to withstand the temperatures of these hot spots. The heaters are therefore more expensive than a comparable heater without flames.

For downhole burner applications, heat transfer can occur in one of several ways. These include conduction, convection, and radiative methods. Radiative heat transfer can be particularly strong for an open flame. Additionally, the flue gases can be corrosive due to the $CO_2$ and water content. Use of refractory metals or ceramics can help solve these problems, but typically at a higher cost. Ceramic materials with acceptable strength at temperatures in excess of 900° C. are generally high alumina content ceramics. Other ceramics that may be useful include chrome oxide, zirconia oxide, and magnesium oxide based ceramics.

Heat transfer in a pipe-in-pipe arrangement for a downhole burner can also lead to difficulties. The down going fuel and air will heat exchange with the up going hot flue gases. In a well there is minimal room for a high degree of insulation and hence significant heat transfer is typically expected. This cross heat exchange can lead to higher flame temperatures as the fuel and air become preheated. Additionally, the cross heat exchange can limit the transport of heat downstream of the burner since the hot flue gases may rapidly lose heat energy to the rising cooler flue gases.

Improved downhole burners are offered in co-owned U.S. Pat. Appl. No. 61/148,388. That application was filed on Apr. 18, 2008, and is entitled "Downhole Burner Wells for In Situ Conversion of Organic-Rich Formations." The teachings pertaining to improved downhole burner wells are incorporated herein by reference.

The use of downhole burners is an alternative to another form of downhole heat generation called steam generation. In downhole steam generation, a combustor in the well is used to boil water placed in the wellbore for injection into the formation. Applications of the downhole heat technology have been described in F. M. Smith, "A Down-Hole Burner—Versatile Tool for Well Heating," 25$^{th}$ Technical Conference on Petroleum Production, Pennsylvania State University, pp 275-285 (Oct. 19-21, 1966); H. Brandt, W. G. Poynter, and J. D. Hummell, "Stimulating Heavy Oil Reservoirs with Downhole Air-Gas Burners," World Oil, pp. 91-95 (September 1965); and C. I. DePriester and A. J. Pantaleo, "Well Stimulation by Downhole Gas-Air Burner," Journal of Petroleum Technology, pp. 1297-1302 (December 1963).

The process of heating formation hydrocarbons within an organic-rich rock formation, for example, by pyrolysis, may generate fluids. The heat-generated fluids may include water which is vaporized within the formation. In addition, the action of heating kerogen produces pyrolysis fluids which tend to expand upon heating. The produced pyrolysis fluids may include not only water, but also, for example, hydrocarbons, oxides of carbon, ammonia, molecular nitrogen, and molecular hydrogen. Therefore, as temperatures within a heated portion of the formation increase, a pressure within the heated portion may also increase as a result of increased fluid generation, molecular expansion, and vaporization of water. Thus, some corollary exists between subsurface pressure in an oil shale formation and the fluid pressure generated during pyrolysis. This, in turn, indicates that formation pressure may be monitored to detect the progress of a kerogen conversion process.

The pressure within a heated portion of an organic-rich rock formation depends on other reservoir characteristics. These may include, for example, formation depth, distance from a heater well, a richness of the formation hydrocarbons within the organic-rich rock formation, the degree of heating, and/or a distance from a producer well.

It may be desirable for the developer of an oil shale field to monitor formation pressure during development. Pressure within a formation may be determined at a number of different locations. Such locations may include, but may not be limited to, at a wellhead and at varying depths within a wellbore. In some embodiments, pressure may be measured at a producer well. In an alternate embodiment, pressure may be measured at a heater well. In still another embodiments, pressure may be measured downhole of a dedicated monitoring well.

The process of heating an organic-rich rock formation to a pyrolysis temperature range will not only increase formation pressure, but will also increase formation permeability. The pyrolysis temperature range should be reached before substantial permeability has been generated within the organic-rich rock formation. An initial lack of permeability may prevent the transport of generated fluids from a pyrolysis zone within the formation. In this manner, as heat is initially transferred from a heater well to an organic-rich rock formation, a fluid pressure within the organic-rich rock formation may increase proximate to that heater well. Such an increase in fluid pressure may be caused by, for example, the generation of fluids during pyrolysis of at least some formation hydrocarbons in the formation.

Alternatively, pressure generated by expansion of pyrolysis fluids or other fluids generated in the formation may be allowed to increase. This assumes that an open path to a production well or other pressure sink does not yet exist in the formation. In one aspect, a fluid pressure may be allowed to increase to or above a lithostatic stress. In this instance, fractures in the hydrocarbon containing formation may form when the fluid pressure equals or exceeds the lithostatic stress. For example, fractures may form from a heater well to a production well. The generation of fractures within the heated portion may reduce pressure within the portion due to the production of produced fluids through a production well.

Once pyrolysis has begun within an organic-rich rock formation, fluid pressure may vary depending upon various factors. These include, for example, thermal expansion of hydrocarbons, generation of pyrolysis fluids, rate of conversion, and withdrawal of generated fluids from the formation. For example, as fluids are generated within the formation, fluid pressure within the pores may increase. Removal of generated fluids from the formation may then decrease the fluid pressure within the near wellbore region of the formation.

In certain embodiments, a mass of at least a portion of an organic-rich rock formation may be reduced due, for example, to pyrolysis of formation hydrocarbons and the production of hydrocarbon fluids from the formation. As such, the permeability and porosity of at least a portion of the formation will increase. Any in situ method that effectively produces oil and gas from oil shale or other solid hydrocarbon material will create permeability in what was originally a very low permeability rock. The extent to which this will occur is illustrated by the large amount of expansion that must be accommodated if fluids generated from kerogen are not produced. The concept is illustrated in FIG. 5.

Figure 5:
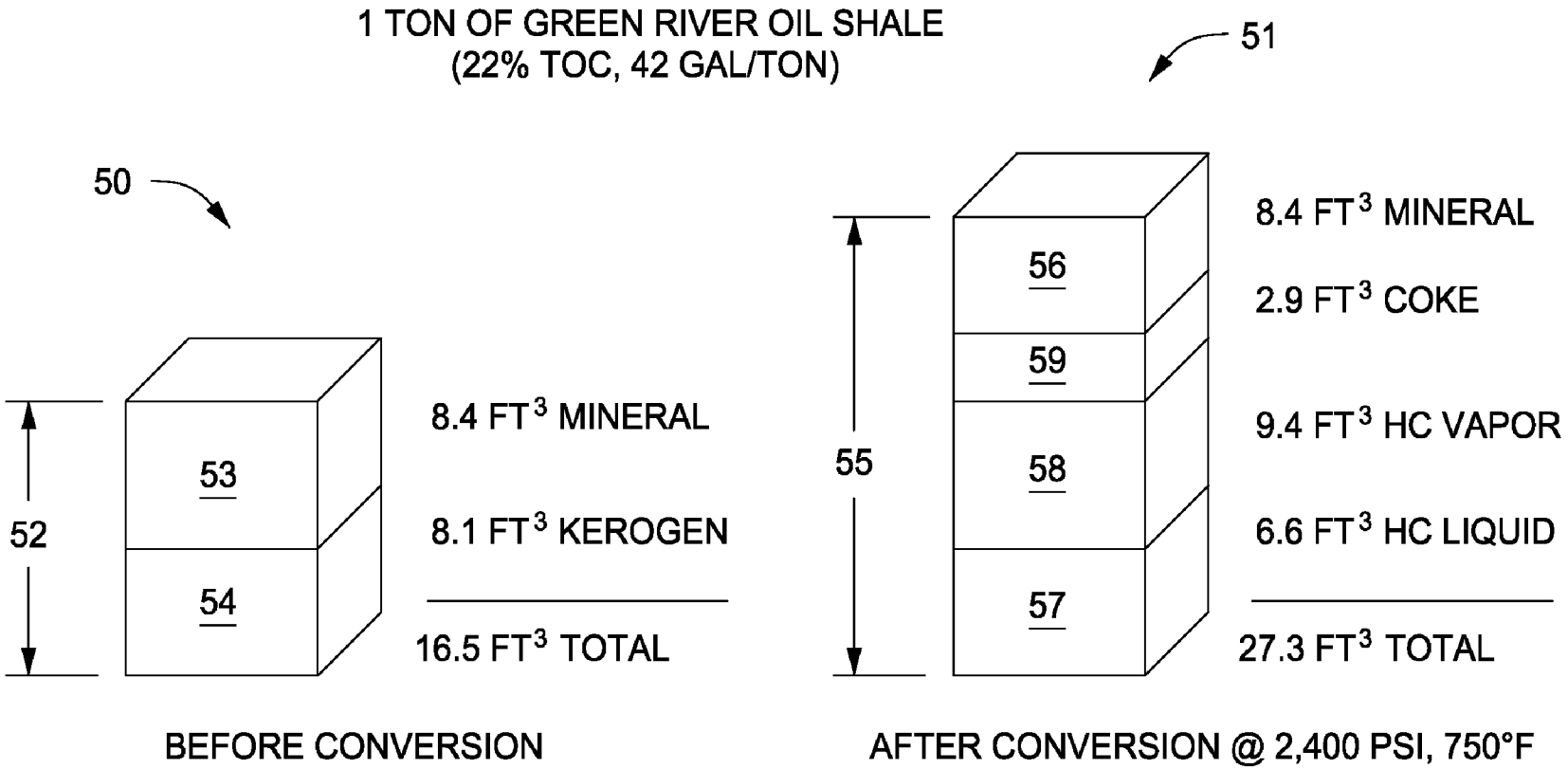
FIG. 5 is a bar chart comparing one ton of Green River oil shale before and after a simulated in situ, retorting process.

FIG. 5 provides a bar chart comparing one ton of Green River oil shale before 50 and after 51 a simulated in situ, retorting process. The simulated process was carried out at 2,400 psi and 750° F. on oil shale having a total organic carbon content of 22 wt. % and a Fisher assay of 42 gallons/ton. Before the conversion, a total of 16.5 $ft^3$ of rock matrix 52 existed. This matrix comprised 8.4 $ft^3$ of mineral 53, i.e., dolomite, limestone, etc., and 8.1 $ft^3$ of kerogen 54 imbedded within the shale. As a result of the conversion the material expanded to 27.3 $ft^3$ 55. This represented 8.4 $ft^3$ of mineral 56 (the same number as before the conversion), 6.6 $ft^3$ of hydrocarbon liquid 57, 9.4 $ft^3$ of hydrocarbon vapor 58, and 2.9 $ft^3$ of coke 59. It can be seen that substantial volume expansion occurred during the conversion process. This, in turn, increases permeability of the rock structure.

It is preferred that thermal recovery of oil and gas is conducted before any solution mining of nahcolite or other water-soluble minerals present in the formation. Solution mining can generate large voids in a rock formation and collapse breccias in an oil shale development area. These voids and brecciated zones may pose problems for in situ and mining recovery of oil shale, further increasing the utility of supporting pillars.

In some embodiments, compositions and properties of the hydrocarbon fluids produced by an in situ conversion process may vary depending on, for example, conditions within an organic-rich rock formation. Controlling heat and/or heating rates of a selected section in an organic-rich rock formation may increase or decrease production of selected produced fluids.

In one embodiment, operating conditions may be determined by measuring at least one property of the organic-rich rock formation. The measured properties may be input into a computer executable program. At least one property of the produced fluids selected to be produced from the formation may also be input into the computer executable program. The program may be operable to determine a set of operating conditions from at least the one or more measured properties. The program may also be configured to determine the set of operating conditions from at least one property of the selected produced fluids. In this manner, the determined set of operating conditions may be configured to increase production of selected produced fluids from the formation.

Certain heater well embodiments may include an operating system that is coupled to any of the heater wells such as by insulated conductors or other types of wiring. The operating system may be configured to interface with the heater well. The operating system may receive a signal (e.g., an electromagnetic signal) from a heater that is representative of a temperature distribution of the heater well. Additionally, the operating system may be further configured to control the heater well, either locally or remotely. For example, the operating system may alter a temperature of the heater well by altering a parameter of equipment coupled to the heater well. Therefore, the operating system may monitor, alter, and/or control the heating of at least a portion of the formation.

Temperature (and average temperatures) within a heated organic-rich rock formation may vary, depending on, for example, proximity to a heater well, thermal conductivity and thermal diffusivity of the formation, type of reaction occurring, type of formation hydrocarbon, and the presence of water within the organic-rich rock formation. At points in the field where monitoring wells are established, temperature measurements may be taken directly in the wellbore. Further, at heater wells the temperature of the immediately surrounding formation is fairly well understood. However, it is desirable to interpolate temperatures to points in the formation intermediate temperature sensors and heater wells.

In accordance with one aspect of the production processes of the present inventions, a temperature distribution within the organic-rich rock formation may be computed using a numerical simulation model. The numerical simulation model may calculate a subsurface temperature distribution through interpolation of known data points and assumptions of formation conductivity.

The numerical simulation model may also include assessing various properties of a fluid formed within an organic-rich rock formation under the assessed temperature distribution. For example, the various properties of a formed fluid may include, but are not limited to, a cumulative volume of a fluid formed in the formation, fluid viscosity, fluid density, and a composition of the fluid formed in the formation. Such a simulation may be used to assess the performance of a commercial-scale operation or small-scale field experiment. For example, a performance of a commercial-scale development may be assessed based on, but not limited to, a total volume of product that may be produced from a research-scale operation.

Some embodiments include producing at least a portion of the hydrocarbon fluids from the organic-rich rock formation. The hydrocarbon fluids may be produced through production wells. Production wells may be cased or uncased wells and drilled and completed through methods known in the art. Because of the exceedingly high formation temperatures expected to be experienced in connection with the in situ pyrolysis process, heat resistant downhole equipment may need to be substituted. For example, a part of the casing string may need to be fabricated from ceramic.

The produced hydrocarbon fluids may include a pyrolysis oil component (or condensable hydrocarbon component) and a pyrolysis gas component (or non-condensable component). Condensable hydrocarbons produced from the formation will typically include paraffins, cycloalkanes, mono-aromatics, and di-aromatics as components. Such condensable hydrocarbons may also include other components such as tri-aromatics and other hydrocarbon species. In some instances, the ratio of the non-condensable hydrocarbon portion to the condensable hydrocarbon portion may be greater than 700 standard cubic feet of gas per barrel of liquid. This ratio is sometimes referred to as the gas to oil ratio, or GOR. In alternate embodiments, the ratio of the non-condensable hydrocarbon portion to the condensable hydrocarbon portion may be greater than 1,000, 1,500 or 2,000 standard cubic feet of gas per barrel of liquid.

In addition to hydrocarbon oil and gas components, the production fluids may include non-hydrocarbon fluids. Exemplary non-hydrocarbon fluids include, for example, water, carbon dioxide ($CO_2$), hydrogen sulfide ($H_2S$), hydrogen gas ($H_2$), ammonia ($NH_3$), and/or carbon monoxide (CO). In in situ heating operations, the composition of the non-hydrocarbon fluids is expected to change over time. For example, early in the pyrolysis of a volume of oil shale, the composition of the produced gas may have a high $CO_2$ mole fraction and a low $H_2$ mole fraction. As the pyrolysis continues, the composition of the produced gas changes to where the $CO_2$ concentration is low and the $H_2$ concentration is high. Alkane species (e.g., methane and ethane) may exhibit maximum concentrations in the pyrolysis gas at intermediate times. (See for example "*Isothermal Decomposition of Colorado Oil Shale*", DOE/FE/60177-2288.)

This phenomenon is expected to occur over the life of a commercial in situ shale oil development, which may take from 3 to 10 years or more. Moreover, the relative proportions of gaseous hydrocarbon species, including methane, ethane, ethylene, propane, iso-propane and propylene are expected to change over the life of the field development.

The composition of the pyrolysis gas component changing over time may include an averaged concentration of one or more species in the gas stream changing by greater than 5 mol. percent over a 6 month period or over a 1 year period. In alternate embodiments, an averaged concentration of one or more species in the gas stream may change by greater than 10, 15 or 20 mol. percent over a 6 month period or over a 1 year period. In alternate embodiments, the averaged concentration of one or more species in the gas stream may change by greater than 5, 10, 15 or 20 mol. percent over a 2 year period or a greater period. In particular embodiments, the species whose concentration changes may be methane, carbon dioxide, hydrogen gas, or combinations thereof. The averaged concentration may be, for example, a daily, a weekly or a monthly average concentration.

In alternate embodiments, an averaged Wobbe Index of the pyrolysis gas component may change by greater than 5, 10, 15 or 20 percent over a 1 year period. In alternate embodiments, the averaged Wobbe Index of the gas stream may change by greater than 5, 10, 15 or 20 percent over a 2, 3, or 5 year period. The averaged concentration may be, for example, a daily, a weekly or a monthly average of Wobbe Index value assessments.

In the production of oil and gas resources, it may be desirable to use the produced hydrocarbons as a source of electrical power for ongoing operations. This may be applied to the development of oil and gas resources from oil shale. For example, when electrically resistive heaters are used in connection with in situ heating and subsequent shale oil production, large amounts of power are required. The needed energy may be provided by feeding produced gas into a gas turbine, which in turn generates energy for electricity such as downhole electrical heating elements. Excess electricity not used in the field can be fed into the power grid and sold.

A drawback to using produced gas to generate electrical energy is that its composition must be carefully controlled. Control is necessary so as to maximize efficiency and so as not to damage the turbine or cause the turbine to misfire. In addition, controlling the gas composition may prevent the generation of excessive pollutants (e.g., $NO_x$).

Gas turbines operate through combustion to utilize heat to turn an electrical generator. Combustion behavior of the fuel is important. Combustion parameters to consider include heating value, specific gravity, adiabatic flame temperature, flammability limits, autoignition temperature, autoignition delay time, and flame velocity. All of these parameters together determine the fuel quality.

One measure of fuel quality is the Wobbe Index. Control of a fuel's Wobbe Index to a target value can allow simplified turbine design and increased optimization of performance. Maintaining a gas feed's Wobbe Index within a range of, for example, ±20% or more ideally ±10% is desirable.

Wobbe Index is generally used to compare the combustion energy output of different composition fuel gases, such as in an appliance. If two fuels have identical Wobbe Indices, then for a given valve setting the energy output will also be identical. Typically, variations in Wobbe Index of up to 5% are allowed as these would not be noticeable to the consumer. Wobbe Index may be expressed by the following formula:

$$I_W = \frac{V_C}{\sqrt{G_S}}.$$

wherein: $I_W$ is the Wobbe Index, $V_C$ is the heating value (or calorific value), and $G_S$ is the specific gravity of the gas.

In words, the above equation can be translated into Wobbe Index=heating value divided by the square root of gas specific gravity.

A related measure is the Modified Wobbe Index ("MWI"). MWI may be calculated using the following equation:

$$MWI = \frac{LHV}{\sqrt{SG * Tgas}}$$

wherein: MWI is the Modified Wobbe Index,

LHV is the lower heating value of the gas fuel in units of BTU/SCF, where BTU is a British Thermal Unit and SCF is the unit standard cubic feet, SG is the specific gravity of the gas fuel relative to air, and $T_{gas}$ is the temperature of the gas fuel in degrees Rankine.

The Wobbe Index of a gas stream produced from a development area is dependent on the composition of the gas stream. Gas streams produced from shale oil developments contain quantities of inert gases. For example, non-condensable hydrocarbon fluids generated from oil shale pyrolysis programs may contain significant amounts of carbon dioxide ($CO_2$), carbon monoxide (CO), and hydrogen ($H_2$) in addition to the light hydrocarbons. However, and as noted above, the concentrations of these components will vary over the life of an in situ heating production operation. Therefore, in certain embodiments of the production processes, the $CO_2$ content of the fuel gas is adjusted via separation or addition in the surface facilities to optimize turbine performance.

Total removal or absence of $CO_2$ is not necessary. Indeed, inert gases in the gas feed or "turbine fuel" can increase power generation by increasing mass flow while maintaining a flame temperature within a desirable range. Moreover inert gases such as $CO_2$ can lower flame temperature and thus reduce $NO_x$ pollutant generation. A certain hydrogen content for low-BTU fuels may also be desirable to achieve appropriate burn properties. The $H_2$ content of the fuel gas may be adjusted via separation or addition in the surface facilities to optimize turbine performance. Adjustment of $H_2$ content in non-shale oil surface facilities utilizing low BTU fuels has been discussed in the patent literature (e.g., U.S. Pat. Nos. 6,684,644 and 6,858,049), the entire disclosures of which are hereby incorporated by reference).

The expected changes in the overall produced gas composition present processing challenges, particularly where the produced gas or a portion thereof is combusted in a gas turbine. This is due to the inability of gas turbines with specific combustors to accommodate large changes in feed gas composition while maintaining stable operation. In general, gas turbines are highly optimized machines. For example, gas turbine manufacturers typically designate a preferred pressure or range of pressures to deliver a gas turbine feed gas stream for combustion in the gas turbine combustor. If the gas turbine feed gas stream is delivered to the gas turbine outside the designated pressure range, then the gas turbine can experience unstable operation, reduced efficiency and/or increased emissions of environmentally regulated components. Thus, it is useful to operate an organic-rich rock formation in situ heating operation to provide the feed gas within a pressure range targeted to the gas turbine.

As another example, modern gas turbines are typically equipped with low emissions combustors in order to meet modern environmental regulations. These combustors have a fixed geometry, typically, a set of circular orifices that have little flexibility to accommodate wide changes in fuel gas composition. Thus, it is desirable to obtain a gas stream from the production fluids that has a substantially constant composition even where the composition of the pyrolysis gas component changes over time.

A gas having a composition in a substantially constant condition may refer to the range of fuel gas composition that a given gas turbine can utilize while maintaining a sufficiently stable operational performance. For example, a gas with a substantially constant set of conditions is able to be utilized by a given gas turbine without experiencing unacceptable combustion dynamics, including pressure pulsations, which may lead to unreliability caused by flame extinction, ultimately resulting in a shutdown of the turbine. Further, a gas with a substantially constant condition may be utilized by a given gas turbine without generating emissions (e.g., $NO_x$, CO, etc.) in excess of specified targets or environmental regulations. Further, a gas with a substantially constant composition is able to be utilized by a given gas turbine such that the turbine may be operated without need for frequent overhauls or replacement of its internal parts that may be caused by wear or fatigue of components due to excessive combustion dynamics or damage of components due to flame flashback or flame anchoring in a location that is not designed for the elevated temperatures caused by such an event. Further, a gas with a substantially constant condition is able to be utilized without the need to shut down the turbine in order to replace the combustion components with components that are designed to accommodate a different fuel gas composition with respect to an initial fuel gas composition. This component replacement may otherwise be necessary to match the fuel injection port geometry to the fuel gas composition in order to achieve the necessary pressure ratio of fuel gas supplied into the combustion zone. Alternatively, it may be necessary to alter the geometry of dilution air holes in a combustor in order to provide the proper air split between combustion and dilution.

Other factors may affect gas turbine operation. These include flowrate, pressure ratio and temperature. For example, if the fuel composition changes, and thus the Modified Wobbe Index changes, then the pressure ratio required to supply sufficient amounts of fuel energy to the turbine (in order to maintain load) will change. However, the pressure ratio required by the specific combustor geometry is set by the aero-mechanical design of the combustor, which is generally a fixed geometry. Therefore, any changes in fuel gas composition will force the combustor to operate outside of its optimal design point. In summary, variations in the gas feed can result in the need to periodically shut-down the turbine for significant overhaul and parts replacement to re-optimize the turbine. This is typically a costly operation both in terms of direct expenses and lost operational time. Therefore, it is desirable to minimize the need for such overhauls.

An improved in situ method of producing hydrocarbon fluids from an organic-rich rock formation to a surface facility is provided that offers a substantially constant gas composition and/or Wobbe Index for the gas turbine feed stream. Preferably, the organic-rich rock formation is an oil shale formation. The method in one embodiment provides for staggering start-up times of wells or groups of wells. Alternatively, or in addition, flow rates between wells or groups of wells within a development area are adjusted. Alternatively, or in addition, the number of wells within selected sections of a development area are adjusted. The result is that the gas composition and/or Wobbe Index of a produced gas stream is held substantially within a designated range over a specified period of time.

Figure 7:
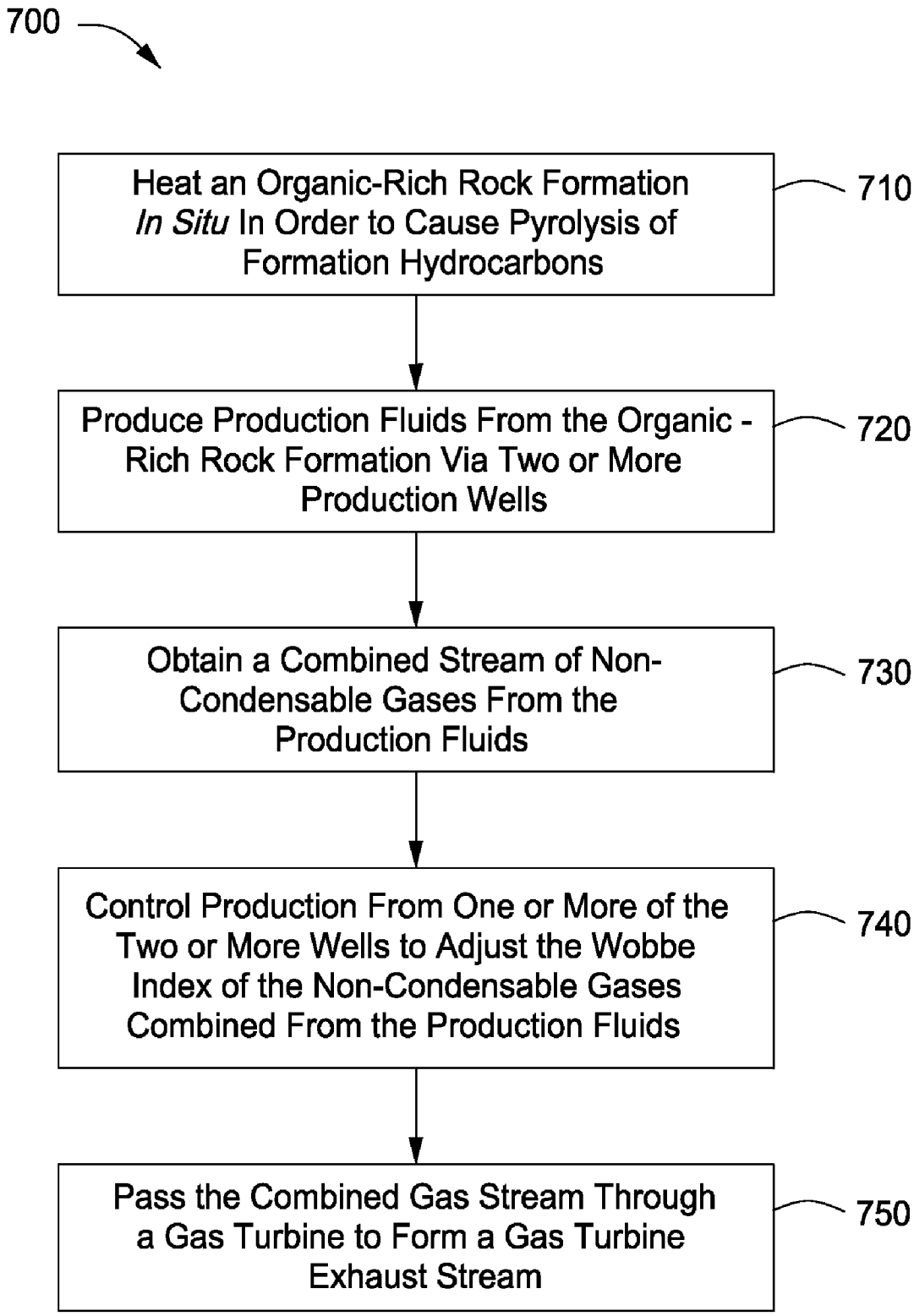
FIG. 7 is a flowchart demonstrating steps for producing hydrocarbon fluids from an organic-rich rock formation to a surface facility, in one embodiment.

FIG. 7 presents a flow chart demonstrating steps of a method 700 for producing hydrocarbon fluids. The method 700 first includes heating the organic-rich rock formation in situ. This step is shown at Box 710. The purpose of the operation 710 is to cause pyrolysis of hydrocarbons in the organic-rich rock formation.

The formation may be, for example, a heavy hydrocarbon formation or a solid hydrocarbon formation. Particular examples of such formations include an oil shale formation, a tar sands formation or a coal formation. Particular formation hydrocarbons present in such formations may include oil shale, kerogen, coal, and/or bitumen. Solid hydrocarbon formations may comprise kerogen.

The pyrolysis of solid hydrocarbons such as kerogen generates hydrocarbon fluids. The hydrocarbon fluids are produced from the organic-rich rock formation as production fluids. This step is shown via Box 720. The production fluids produced during the production step 720 are obtained through two or more production wells. The production wells transport production fluids from the organic-rich formation to the surface. A surface facility (such as facility 60 in FIG. 6) is preferably provided for separating and treating the produced fluids.

The produced hydrocarbon fluids may include both a condensable hydrocarbon portion (e.g., liquid) and a non-condensable hydrocarbon portion (e.g., gas). The hydrocarbon fluids of the production fluids may additionally be produced together with non-hydrocarbon fluids. Exemplary non-hydrocarbon fluids include, for example, water, carbon dioxide ($CO_2$), hydrogen sulfide ($H_2S$), hydrogen gas ($H_2$), ammonia ($NH_3$), and/or carbon monoxide (CO).

The condensable components may be separated from non-condensable components by reducing temperature and/or increasing pressure. This is performed in a surface facility such as facility 60 shown in FIG. 6. Temperature reduction may be accomplished using heat exchangers cooled by ambient air or available water. The pressure may be increased via centrifugal or reciprocating compressors. Alternatively, the hot produced fluids may be cooled via heat exchange with produced hydrocarbon fluids previously cooled or by using available water. Alternatively, or in conjunction, a diffuser-expander apparatus may be used to condense out liquids from gaseous flows. Complete fluids separation may involve several stages of cooling and/or pressure changes.

Water in addition to condensable hydrocarbons may be dropped out of the gas when reducing temperature or increasing pressure. Liquid water may be separated from condensable hydrocarbons via gravity settling vessels or centrifugal separators. Demulsifiers may be used to aid in water separation.

An additional step in the method 700 is obtaining a combined stream of non-condensable fluids, i.e., gas, from the production fluids. This step is shown at Box 730. The combined stream of non-condensable gas may be obtained from the production fluids in various ways. For example, all of the fluids produced from step 720 may be gathered and combined at the surface facility. From there, the combined fluids may be run through separators to separate fluids including streams of non-condensable gas. Alternatively, production fluids from selected groups of production wells may be separated, and the collected gases then commingled. In any event, a combined stream of non-condensable gas is obtained to form the combined gas stream 730.

The gases from the combined gas stream gathered in step 730 comprise combustible hydrocarbon fluids. It is desirable that these combustible hydrocarbon fluids be used in part for power generation. More specifically, it is desirable that the combustible hydrocarbon fluids be used for power generation at the development area. Generated power may be used, for example, for powering downhole electrical heating elements. This may be accomplished by running the combined gas stream through a gas turbine.

As noted, a problem arises in that gas turbines used for power generation are generally designed to process gases within a designated range of gas composition. On the other hand, the gases from the various wells used in the production step 720 have a composition that varies substantially over the lives of the respective production wells. During in situ heating operations, the composition of the production fluids changes over time. Indeed, both the production fluid flow rate and the fluid composition are expected to change over a period of time as a result of heating. For example, early in the pyrolysis of a volume of oil shale, the composition of produced gas may have a high $CO_2$ mole fraction and a low $H_2$ mole fraction. As pyrolysis continues, the composition of the produced gas changes such that the $CO_2$ concentration decreases and the $H_2$ concentration increases. Alkane species (e.g., methane and ethane) may exhibit maximum concentrations in the pyrolysis gas at intermediate times.

In one embodiment of the present methods, the gas portions obtained from the individual production wells have averaged Wobbe Index values which vary at a rate of more than 5% over a period of time. Alternatively, the averaged Wobbe Index values may vary at a rate of more than 10% over a period of time. Changes in the composition of the produced gas mean that the Wobbe Index is also changing. The period of time may be, for example, six months. Alternatively, the period of time may be one year. Alternatively still, the time period may be two, three or four years or more. The average concentration may be a daily, a weekly or a monthly average concentration.

It is noted that the averaging time will be dependent on a number of factors. These may include the frequency of compositional monitoring and the turbine design, that is, the ability of the turbine to handle off-specification gas. Generally, shorter averaging times are preferred as even relatively short-time deviations from turbine specifications may be problematic.

Figure 8:
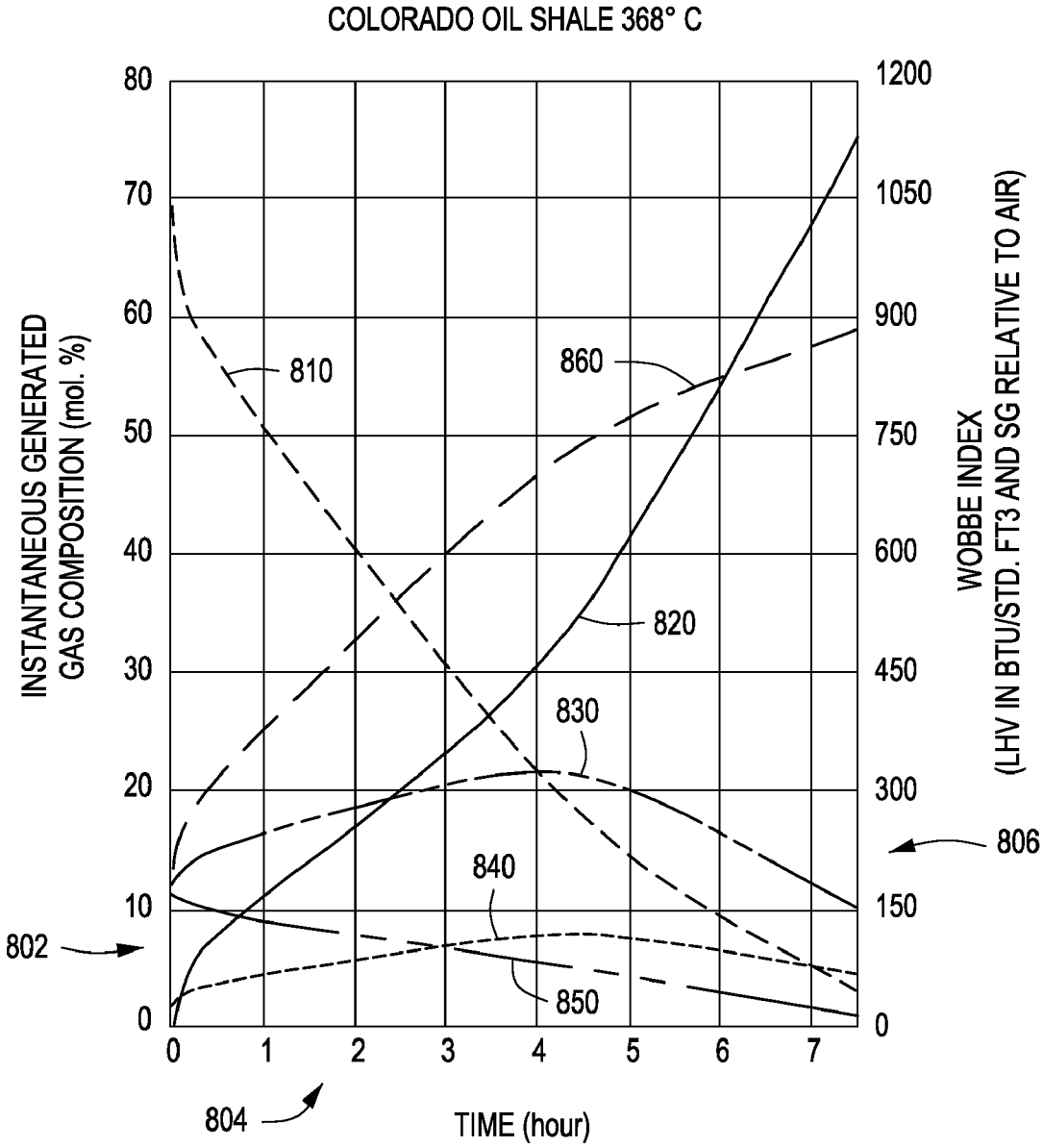
FIG. 8 is a graph of several gaseous species evolved from laboratory heating of Colorado oil shale. The left y-axis reports the concentration in mol. % of the measured gaseous species, including $CO_2$, $H_2$, methane, ethane, and CO, evolved over a 12-hour experiment. The x-axis represents time and is expressed in terms of hours.

FIG. 8 provides a graphical depiction of several gaseous species evolved from laboratory heating of Colorado oil shale. The figure is based on data from F. P. Miknis, P. J. Conn, and T. F. Turner, "*Isothermal Decomposition of Colorado Oil Shale*", DOE/FE/60177-2288 (DE87009043). The experiment consisted of heating and maintaining a sample of Colorado oil shale at a constant temperature of 368° C. for a period of at least 12 hours.

The left "y" axis 802 of FIG. 8 reports the concentration in mol. % of the measured gaseous species, including $CO_2$ 810, $H_2$ 820, methane 830, ethane 840, and CO 850, evolved over 7.5 hours. The right "y" axis 806 reports the Wobbe Index in units of BTU/SCF. Wobbe Index values are indicated at line 860. These values 860 were calculated based on the non-sulfur species in the gas. Lower heating value in BTU/SCF and specific gravity relative to air were used in the Wobbe Index calculation.

The "x" axis 804 represents time and is expressed in units of hours. The data in the figure represent values obtained by differentiating measured cumulative compositions so as to obtain estimates of instantaneous species concentrations.

As the graph shows, initially (hour 0-2) the evolved gas is primarily $CO_2$ 810. The $CO_2$ 810 fraction ranges from 70 mol. % down to 40 mol. % $CO_2$, with smaller amounts of methane 830 (12-18 mol. %) and ethane 840 (2-6 mol. %). As time progresses, hydrogen gas 820 production increases with an almost corresponding decrease in $CO_2$ 810 production. Near the end of the 7.5 hour-period, the $CO_2$ 810 concentration has dropped to about 4 mol. % while the hydrogen 820 concentration has increased to over 70 mol. %.

In FIG. 8, the hydrocarbon species have also varied over the 7.5-hour period, though to a lesser extent. The methane 830 concentration has ranged from a low of about 12 mol. % initially to a high of about 22 mol. % at hour 4, then back down to about 10 mol. % by hour 7.5. The ethane 840 concentration has ranged from a low of about 2-3 mol. % initially to a high of about 8 mol. % at hour 4.5, and then back down to about 5 mol. % by hour 7.5.

The varying composition over time results in a large variance in Wobbe Index 860. The value 860 is initially about 210 BTU/SCF and steadily increases to about 890 BTU/SCF at hour 7.5. The data also indicates that the gas produced from heating and pyrolyzing oil shale will be a relatively low BTU gas, including initially large amounts of $CO_2$ 810.

The data presented in FIG. 8 is illustrative of the potential variation in gas composition over time for heating oil shale. Of course, the time scale in a commercial operation would be over a much longer time frame due to large volumes and lower in situ temperatures, for example 270-350° C. The use of lower temperatures reflects the impracticality of rapidly heating large volumes of rock and increased efficiencies associated with application of lower average temperatures in the subsurface. For example, it may take from one to three years to gain significant hydrocarbon production in a commercial oil shale development depending on the energy input, heating rate, target formation density, target formation thickness, heater well spacing and heater well geometry. Further, it may take from six to ten years or more to substantially convert the kerogen in the oil shale to producible fluid hydrocarbons in a commercial in situ heating oil shale development, again dependent on the specific development parameters mentioned previously.

It is evident that the Wobbe Index in gas produced from an in situ heating operation will fluctuate over the life of a field. More specifically, the Wobbe Index in the combined gas stream obtained from step 730 will vary. Therefore, it is desirable to adjust production practices so that the Wobbe Index of the combined gas stream obtained from step 730 varies at a rate of less than 10% or, more preferably, 5% over a period of time. To this end, the method 700 also includes controlling production from one or more of the two or more production wells such that a combination of the production fluids from the two or more wells results in a combined gas stream whose Wobbe Index varies at a rate of less than 5% over the period of time. This is represented at box 740.

The step 740 of controlling production may include controlling start-up times of the two or more wells. For example, a first group of wells may begin to produce at a first time, while a second group of wells begins to produce at a second later time. In one aspect, the respective formation portions at the first and second groups of wells are heated over the same period of time before production begins. Alternatively, the formation for the first group of wells is heated for a first length of time before producing from the first group of wells begins, while the formation for the second group of wells is heated for a second length of time that is greater than the first length of time before producing from the second group of wells begins. In this latter instance, the heating temperature for the second group of wells is preferably lower than the heating temperature used in the formation for the first group of wells, though not necessarily.

Controlling production 740 may further comprise controlling production rates from the two or more wells. For example, it may be desirable to increase the production rate of wells in a second newer group in order to adjust the overall Wobbe Index of the combined gas stream. This might be used where the $CO_2$ content of the combined gas stream is too low and/or the $H_2$ content is too high. Alternatively, it may be desirable to decrease the production rate of wells in a second newer group in order to adjust the overall Wobbe Index of the combined gas stream. This might be used where the $CO_2$ content of the combined gas stream is too high and/or the $H_2$ content is too low.

In any instance, a computer simulation may be used to assist in determining optimum control. This means that a computer simulation may be performed in order to assess the impact of production rates and start-up times from the two or more wells on overall gas composition over a designated period of time.

The changing gas composition is not problematic if the field operator is content to simply separate out the carbon dioxide, hydrogen and other non-fuel gases from the methane (and other combustible hydrocarbons) before a sale. Carbon dioxide and other so-called acid gases (such as $H_2S$) may be removed from produced hydrocarbon gas through chemical reaction processes, physical solvent processes.

Chemical reaction processes typically involve contacting the gas stream with an aqueous amine solution at high pressure and/or low temperature. This causes the acid gas species to chemically react with the amines and go into solution. By raising the temperature and/or lowering the pressure, the chemical reaction can be reversed and a concentrated stream of acid gases can be recovered. An alternative chemical reaction process involves hot carbonate solutions, typically potassium carbonate. The hot carbonate solution is regenerated and the concentrated stream of acid gases is recovered by contacting the solution with steam. Physical solvent processes typically involve contacting the gas stream with a glycol at high pressure and/or low temperature. Like the amine processes, reducing the pressure or raising the temperature allows regeneration of the solvent and recovery of the acid gases. Certain amines or glycols may be more or less selective in the types of acid gas species removed.

Acid gas removal may also be effectuated through the use of distillation towers. Such towers may include an intermediate freezing section wherein frozen $CO_2$ and $H_2S$ particles are allowed to form. A mixture of frozen particles and liquids fall downward into a stripping section, where the lighter hydrocarbon gasses break out and rise within the tower. A rectification section may be provided at an upper end of the tower to further facilitate the cleaning of the overhead gas stream. Additional details of such a process and related processes may be found in U.S. Pat. Nos. 3,724,225; 4,511,382; 4,533,372; 4,923,493; 5,120,338; and 5,956,971.

The hydrogen content of a gas stream may be reduced by removing all or a portion of the hydrogen ($H_2$) or increased by removing all or a portion of the non-hydrogen species (e.g., $CO_2$, $CH_4$, etc.) Separations may be accomplished using cryogenic condensation, pressure-swing or temperature-swing adsorption, or selective diffusion membranes. If additional hydrogen is needed, hydrogen may be made by reforming methane via a classic water-shift reaction.

Notwithstanding these separation or removal techniques, it is preferred to have a more consistent composition in the combined gas stream 730 itself. A consistent composition helps the field operator properly size the surface facilities. Sizing of a processing facility requires determining the amount of chemical to circulate, the rate of circulation, the energy input for regeneration, and the size and type of gas-chemical contacting equipment. Contacting equipment may include packed or multi-tray countercurrent towers. Alternatively, a series of compact, co-current contacting vessels may be employed. Optimal sizing for each of the vessels is highly dependent on the rate at which gas is being produced from the formation and the concentration of the acid gases in the gas stream. In addition, a consistent gas composition helps in the design and operation of gas turbines.

As noted, the gases from the combined gas stream gathered in step 730 comprise combustible hydrocarbon fluids. In addition to or instead of selling the gaseous species of hydrocarbon fluids into the power grid, it is desirable to utilize at least a portion of the energy from the produced hydrocarbon gases to sustain the operation in the field. Stated another way, it is preferred that at least some of the gases be used for power generation in the development area itself. For example, a portion of generated electrical power may be used to supply energy to electrical heating elements that are in turn used to heat the formation. However, changes in the overall produced gas composition are expected to present processing challenges, particularly where the produced gas or a portion thereof is combusted in a gas turbine. This is due to the inability of gas turbines with specific combustors to accommodate large changes in feed gas composition while maintaining stable operation.

A gas turbine includes a means of combustion, that is, a combustor. Generally, combustors include a nozzle or injector for injecting the gas feed and then mixing the feed with air or an oxygen-containing stream. The resulting mixture is then combusted prior to entry into the turbine portion of the gas turbine to generate a hot combustion product stream. Energy is extracted from the hot combustion product stream.

As described more fully above, gas combustors and their injectors are typically designed for a certain gas composition or range of compositions where the gas turbine will operate stably and most efficiently. If the gas composition changes outside the design range, then the gas turbine can experience unstable and inefficient operation, reduced reliability, and/or increased emissions of environmentally regulated species including, for example, nitrogen oxides ($NO_x$), carbon monoxide (CO), and/or sulfur (e.g., sulfur oxides ($SO_x$)) emissions. This can create downtime for modification of the turbine. The problem may be addressed through the control process provided in step 740.

Referring again to method 700, in one aspect of the method 700 the surface facility comprises a gas turbine. The method 700 may then further comprise passing the combined gas stream from step 730 through the gas turbine to form a gas turbine exhaust stream. This procedure is represented at box 750 of FIG. 7.

The gas turbine may be configured to provide energy from the gas turbine exhaust stream to one or more electrical generators. The electrical generators may then be used to provide power to the heating operations of step 710 or other functions of producing hydrocarbon fluids from the organic-rich rock formation. The electrical generators may also be used to provide power to run electrical appliances and light fixtures needed by production and maintenance crews at the development area.

If the composition of the combined gas stream of 730 is not controlled in 740, then different gas turbines may have to be installed over the life of a shale oil development to accommodate changes in gas composition. It is also observed that hydrocarbon production for shale oil development areas may be low in BTU content. Moreover, gas turbines have a limited range of feed compositions that meet $NO_x$ emission rules. These facts combined with the presence of an unusually large percentage of $CO_2$ means that a series of specially designed turbines may be required. Therefore, it is desirable to schedule different areas of a field for production or to vary production rates between wells or groups of wells so that when the gas streams from the various areas are combined in step 730, they yield a more constant composition.

Figure 9:
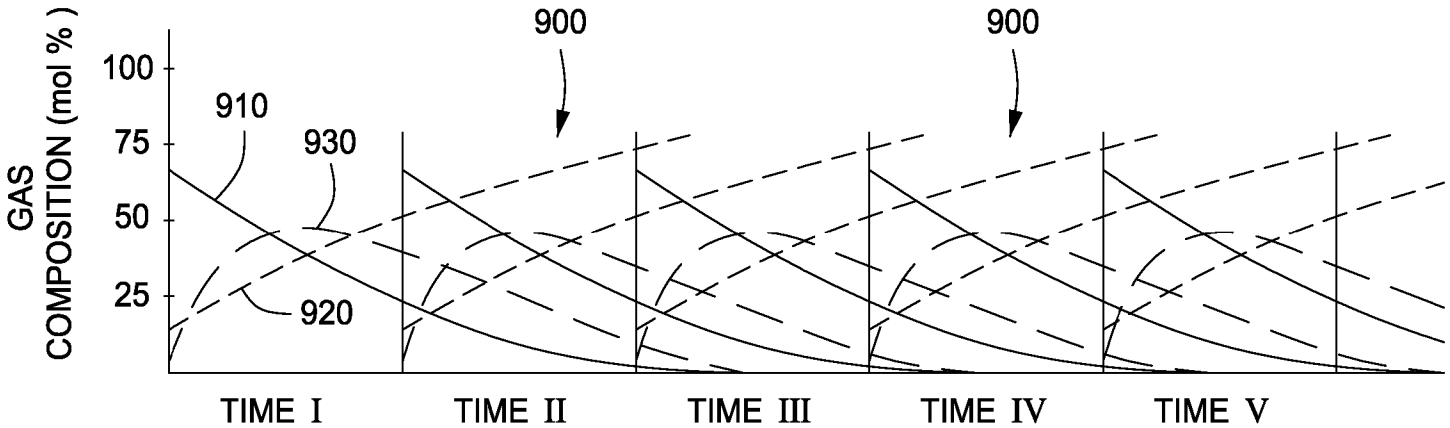
FIG. 9 is a graph that shows gas production from a hydrocarbon development area. The gas production is broken down to show gas composition by mol. % as a function of time. Time is divided into incremental start-up times for different wells or groups of wells in the development area.
Figure 10:
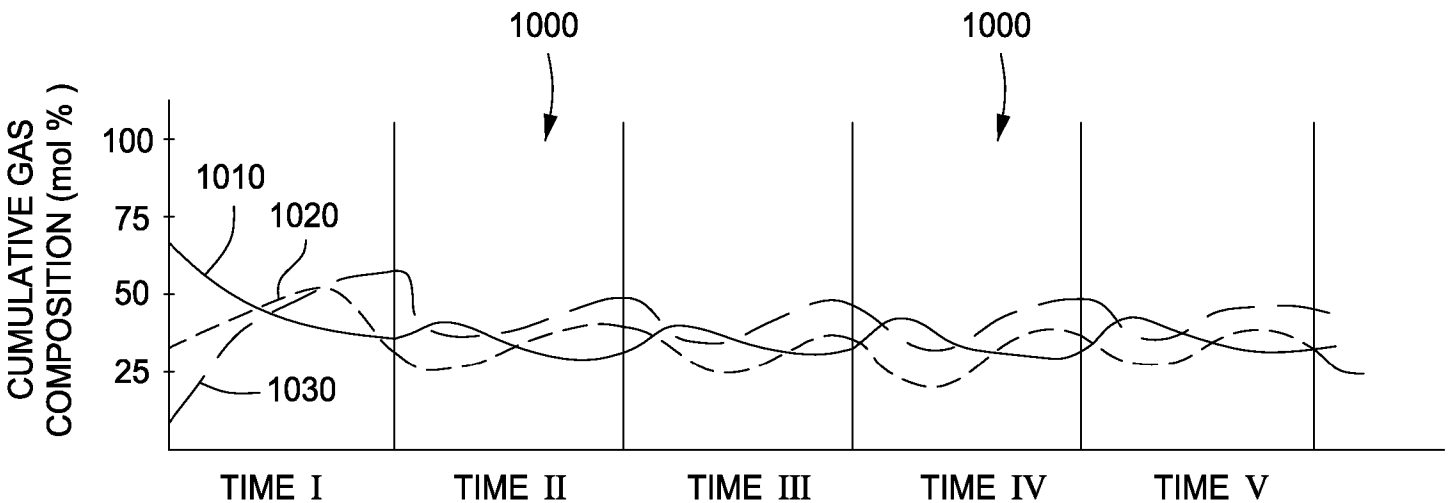
FIG. 10 is a graph that shows cumulative gas composition by mol. % of the gas production from FIG. 9. The cumulative gas composition is shown as a function of time. Time is divided into the same start-up time increments as provided in FIG. 9.

In order to more fully understand the step 740 of controlling production rates, FIGS. 9 and 10 are provided. First, FIG. 9 provides a graph charting the composition of different individual gas streams 900 that are initiated at different times. The times are represented by Time I, Time II, Time III, etc. on the x-axis of FIG. 9. Each of the gas streams 900 may be considered as one of the individual gas streams making up the combined gas stream of step 730. More specifically, the various individual gas streams 900 are represented by their principal constituent gas species resulting after separating the non-condensable gas components from the production fluids acquired in step 720.

In FIG. 9, the gas streams 900 are shown along the "y" axis in terms of individual components. The primary individual components are:

Carbon Dioxide ($CO_2$) indicated at 910;

Hydrogen ($H_2$) indicated at 920; and

Methane ($CH_4$) indicated at 930.

The gas components 910, 920, 930 are in mol. %. The gaseous contents 910, 920, 930 together represent a substantial portion of the composition for the individual gas streams 900. It is, of course, understood that the non-condensable components forming the gas streams 900 will contain components other than carbon dioxide 910, hydrogen 920 and methane 930. Such components may include, for example, ammonia, carbon monoxide, hydrogen sulfide, and nitrogen. Such components may also include other light alkanes or alkenes such as ethane or propene. However, components 910, 920 and 930 represent the major portion of the components that will be recovered from the separation step of 730 for the production fluids, particularly from a shale oil production operation.

Over the course of the life of a well in a shale oil development area, the relative fractions of gases 910, 920, 930 generated during pyrolysis will change. For example, when an oil shale formation is initially heated, a high mol. % of carbon dioxide 910 is generated. Conversely, a relatively low mol. % of hydrogen 920 is generated. As the temperature of the formation is raised and pyrolysis proceeds, the relative mol. % of carbon dioxide 910 decreases while the relative mol. % of hydrogen 920 increases. In addition, the relative mol. % of methane will significantly increase, at least for a time.

The gas compositions are indicated in FIG. 9 as a function of time. Time is shown along the "x" axis and is broken down according to Time I, Time II, Time III, etc. Each "Time" indicates a start-up time in which a portion of a field begins to be developed through pyrolysis and production. Time increments may be measured in weeks or months for purposes of evaluating gas stream composition and establishing start-up. Thus, separate gas streams 900 are shown according to different start-up times in the development of a field.

In the example of FIG. 9, it can be seen that the initial percentage of carbon dioxide 910 at each Time is about 70%. The initial percentage of produced hydrogen 920 is about 5%. The initial percentage of methane 930, of course, is only about 15% as the pyrolysis and production procedures are just beginning. The remaining 10% of gas stream 900 components is not indicated as these components are considered nominal. However, it is noted that the initial ethane composition may be about 5% itself.

If all wells in a development area are brought into production at the same time in response to formation pyrolysis, then the gas composition of the production stream generated in step 720 will change in accordance with any one of the individual Time increments shown in FIG. 9. In the context of shale oil development, this means that initial gas production from the field will have a high relative percentage of carbon dioxide 910 early in production, and a low relative percentage of carbon dioxide 910 towards the later life of the field. Reciprocally, initial gas production from the field will have a fairly low relative percentage of hydrogen 920 early in production, and a higher relative percentage of hydrogen 920 towards the later life of the field. Moreover, the relative proportions of gaseous hydrocarbon species, including methane, ethane, ethylene, propane, iso-propane and propylene are expected to change over the life of the field development, though not as much.

It is proposed to bring different portions of a development field on-line in a sequential manner as one way of controlling production 740. This creates a blended gas composition that provides something of an averaged gas composition over a selected life of a field. In this way, a single gas turbine design can be employed. FIG. 9 demonstrates this principle.

In FIG. 9, a series of wells or collections of wells are brought in over designated Times. These Times are set out in increments along the "x" axis. The increments may be, for example, two months, six months, ten months, twelve months, or other time increment. The well or wells brought into production at Time I will continue to produce when the wells at Time II are brought in. Similarly, the well or wells brought into production at Time I and Time II will continue to produce when new wells are brought in at Time III, and so forth. Eventually, production in wells brought in during the earliest Times will taper off, but new wells will be brought along as new production Times begin.

It is preferred that the well or wells that are brought into production at one Time increment continue to produce as subsequent start-up Times occur. In one aspect, start-up Times are established at increments of four months, with a development area being separated into ten groups of wells. This means that 10 Times are provided in the development area, with the wells being brought into production incrementally over the course of 40 months. Of course, production will take place for longer than 40 months as the various wells or groups of wells are depleted. This is merely an example. It is also noted that management of well start-up and completion times has limited utility at the very start and end of a field's life since there will be fewer well compositions to average.

In another example, 20 start-up Times may be established for a production program in a development area, representing a separate start-up Time for 20 different groups of production wells. The start-up Times may be separated by increments of three months. In this way, the wells in the development area are brought into production incrementally over the course of 60 months, or five years. It is within the field operator's choice as to how to divide the development area and how often to bring in new groups of production wells.

In any arrangement for controlling production 740, the number of wells allocated to groups of production wells may be varied. Thus, for example, 20 start-up Times may be established for a production program in a development area, representing a separate start-up Time for 20 different groups of production wells "$G_n$." The groups of production wells may be designated as $G_1$, $G_2$, $G_3$, . . . $G_{18}$, $G_{19}$, and $G_{20}$. The number of wells forming the early groups, i.e., $G_1$ and $G_2$, and the number of wells forming the end groups, i.e., $G_{19}$ and $G_{20}$, may only have two or three wells. At the same time, the number of wells included in the intermediate wells, i.e., $G_3$, . . . $G_{18}$, may have five or six wells. By varying the number of wells as between groups $G_n$, a better overall average of gas composition in the combined gas stream of step 730 is obtained.

Referring again to FIG. 9 specifically, it is seen that the mol. % of the individual components 910, 920, 930 changes over the course of time. This is true for the well or wells brought in at each Time. In FIG. 9, five different start-up Times are indicated, with the respective gas compositions for components 910, 920 and 930 changing in a consistent manner over time after the beginning of each Time. In practice, numerous start-up Times will be employed for a development area, such as 10, 15, 20 or 25 start-ups. The life of a commercial in situ heating operation in a field may take, for example, from 3 to 10 years.

FIG. 10 is another graph charting composition of the gas streams 900. In this instance, the gas streams 900 are combined to represent a cumulative gas stream 1000. The compositions of the gas streams 1000 are again made up of three primary components. Those are:

Carbon Dioxide ($CO_2$) indicated at 1010;

Hydrogen ($H_2$) indicated at 1020; and

Methane ($CH_4$) indicated at 1030.

The gas compositions 1010, 1020, 1030 are in mol. %. The gaseous contents 1010, 1020, 1030 represent the cumulative gas components from the various gas streams 900 during each Time. More specifically, the gaseous contents 1010, 1020, 1030 represent the cumulative gas contents from components 910, 920, 930, respectively, as additional groups of wells are brought into production in incremental start-up Times.

In FIG. 10, the cumulative gas streams 1000 are shown along the "y" axis as a function of time. Time is shown along the "x" axis and broken up into start-up Times that correlate to the Times provided in FIG. 9. Times I through V are shown. However, it is again understood that in an actual shale oil development, numerous additional Times are used generally correlating to the number of subdivided areas or groups of wells provided in the development area.

It can be seen in FIGS. 9 and 10 that as new wells or groups of wells are brought on line with the respective start-up Times, the relative percentages of gas species 910, 920, 930 generated in response to pyrolysis change. However, the cumulative percentages of gas species 1010, 1020, 1030 remain within a more narrow range. For example, the cumulative mol. % of carbon dioxide 1010 varies beginning at Time II from 25% to 50%; the cumulative mol. % of hydrogen 1020 remains between 20% and 40%; and the cumulative mol. % of methane 1030 is between 40% and 60%.

It is noted that these percentages are illustrative only. FIGS. 9 and 10 do not reflect actual field data. At the same time, they do reflect plausible ratios based upon the data yielded from the experiment disclosed in FIG. 8.

It can be seen that by incrementally heating and producing wells or groups of wells as illustrated by the start-up Times of FIGS. 9 and 10, the composition of the gas streams 1000 remains within a particular range. Gas turbines may then be selected or tuned to match the ranges.

Preferably, each Time represents a point at which a group of wells within a production area is brought on line. It is understood that the greater the number of production areas that are formed within a development area, the more narrow the cumulative range of gas compositions will be. Thus, the operator may determine in connection with step 740 how best to subdivide the development area and when to bring new wells or groups of wells on line. In addition, the number of wells in the respective groups of wells may be varied.

The constancy of the gas composition streams 1000 may be expressed in terms of Wobbe Index. In one aspect of the present methods, the combined gas stream obtained in step 730 over time has an average Wobbe Index which varies at a rate of no more than 5% during a substantial period of field development. The average may be calculated daily, weekly, or monthly. In one aspect, the time period for field development is one year. In any event, the sizes of the incremental areas of production, the frequency of the start-up Times, and the number of wells in the respective groups of wells is arranged so that a substantially constant Wobbe Index gas stream for use in turbines is provided. This, in turn, leads to a more consistent or Wobbe Index of the combined gas stream 740 over the life of the development area.

In another aspect, the constancy of the Wobbe Index is further maintained under step 740 by managing well production rates within respective production areas. In doing so, the operator may monitor gas compositions in the combined gas stream 730. If the composition of one particular component is too high, then the flow rate from one or more production areas wherein that component is being primarily produced may be reduced. For example, if the carbon dioxide content in a cumulative gas stream 1000 is too high for the selected gas turbine, then the flow rate from areas having later start-up Times may be reduced. On the other hand, if the carbon dioxide content in a cumulative gas stream 1000 is too low, then the flow rate from a production area more recently brought on line may be reduced. In this way, turbine efficiency is optimized and the need for turbine shut-downs to perform equipment change-outs is minimized.

It is noted that various means may be employed for determining gas composition coming out of a production stream. For example, gas samples may be periodically taken and evaluated by gas chromatography (GC). More limited compositional analysis may be performed with in-line GC or specific sensors such as sensors for monitoring $H_2$ or $CO_2$. Other methods may be used such as density measurements and heating value measurements.

Figure 11:
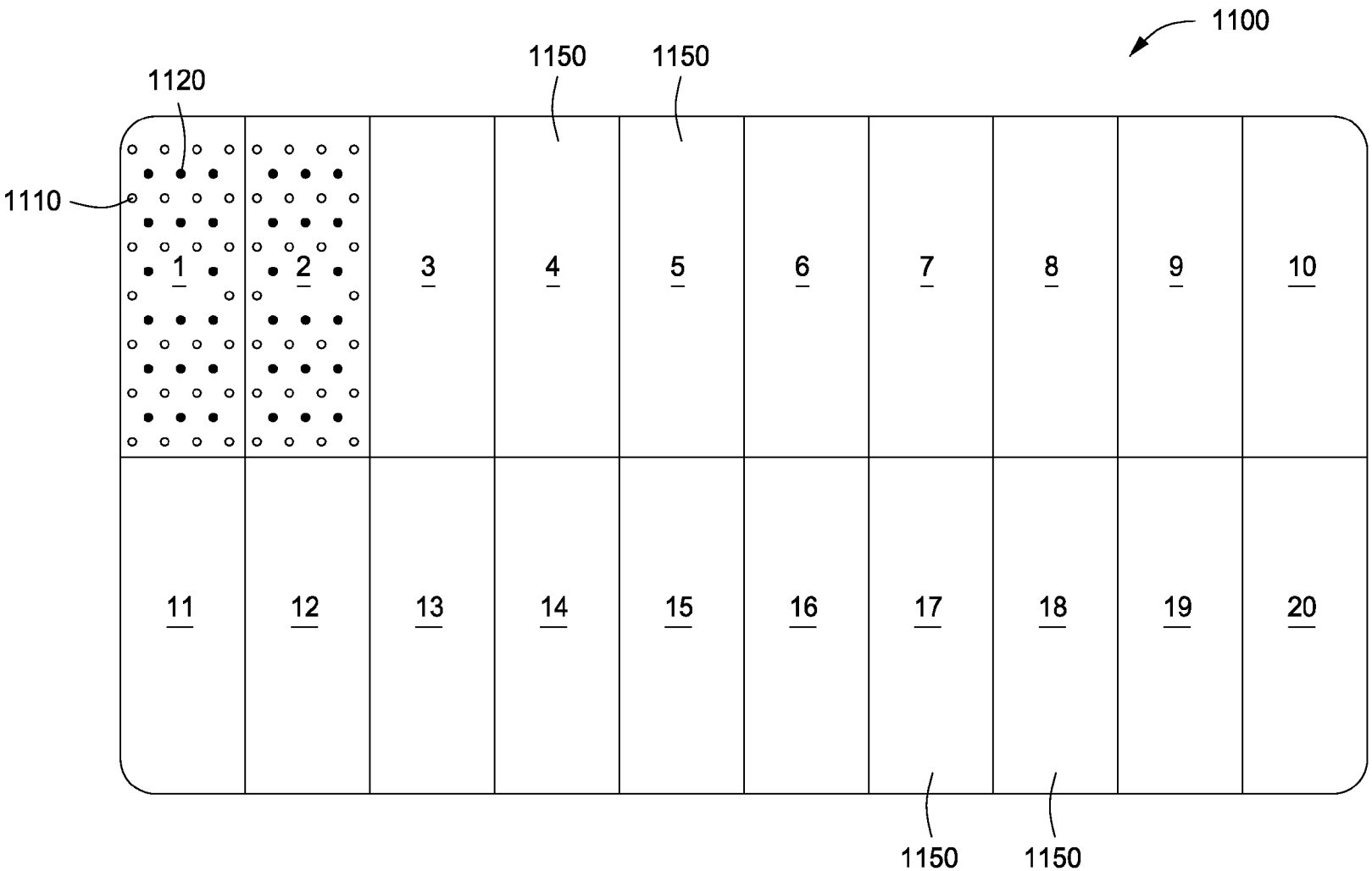
FIG. 11 shows a plan view of a hydrocarbon development area. The development area is subdivided into a plurality of incremental production areas.

To demonstrate the subdivision of a development area into discrete production areas or groups of wells, FIG. 11 is provided. FIG. 11 shows a layout of a development area 1100. The development area 1000 is divided into 20 separate production areas 1150. The production areas 1150 are numbered 1 through 20 for illustrative purposes. The development area 1000 will be developed incrementally, meaning that fluid production will begin sequentially in each production area 1150. For example, heating and fluid production may be initiated in increments of one to twelve months, such as four month increments.

Each production area 1150 has a plurality of wells. Some of the wells are heater wells 1110 while other wells are production wells 1120. Optionally, injection wells (not shown) are also employed to help maintain formation pressure and drive pyrolyzed fluids towards production wells. In the arrangement of FIG. 11, illustrative wells 1110, 1120 are shown in the production areas denoted as "1" and "2." Wells 1110, 1120 have not yet been formed and completed in the remaining production areas 1150 (to with, areas 3 through 20). Thus, a noted benefit of some of the methods disclosed herein is that various wells in a production area need not all be completed and ready at the same time.

Each of the production areas 1150 of FIG. 11 may be indicative of a respective start-up Time from FIGS. 9 and 10. Thus, for example Time 1 may represent the time in which production from production area 1 begins; Time 2 may represent the time in which production from production area 2 begins; and so on. In this way, production from wells across the development area 1100 is staggered or provided incrementally. As a result, the composition of the combined gas streams 730 of the various production areas is averaged into a defined range over time.

The development area 1100 may be divided into even smaller production areas. The illustrative areas 1 and 2 show 15 production wells 1120. However, production areas in the development area 1100 could be divided into even smaller clusters of wells 1110, 1120 in an effort to provide finer averaging of gas composition. In addition, production areas that are subject to first and last development may include fewer production wells than the intermediate production areas.

It is also noted that start-up time increments between the various production areas need not be the same. For example, the start-up time increment between production area 1 and production area 2 may be five months; the start-up time increment between production area 2 and production area 3 may be four months; the start-up time increment between production area 3 and production area 4 may be four months; and the start-up time increment between subsequent production areas may be only three months. This helps minimize the impact on gas compositions as new production areas are brought on line. In addition, and as discussed further below, production rates in the wells in each production area may be adjusted to maintain composition of the combined gas stream within a defined range.

Referring again to FIG. 6, FIG. 6 illustrates a hydrocarbon development area 70. The hydrocarbon development area 70 employs in situ pyrolysis to convert solid or heavy hydrocarbons into the hydrocarbon fluids. The fluids are brought to the surface of the development area 70 through a main production lines 76 as production fluids 85.

Figure 6:
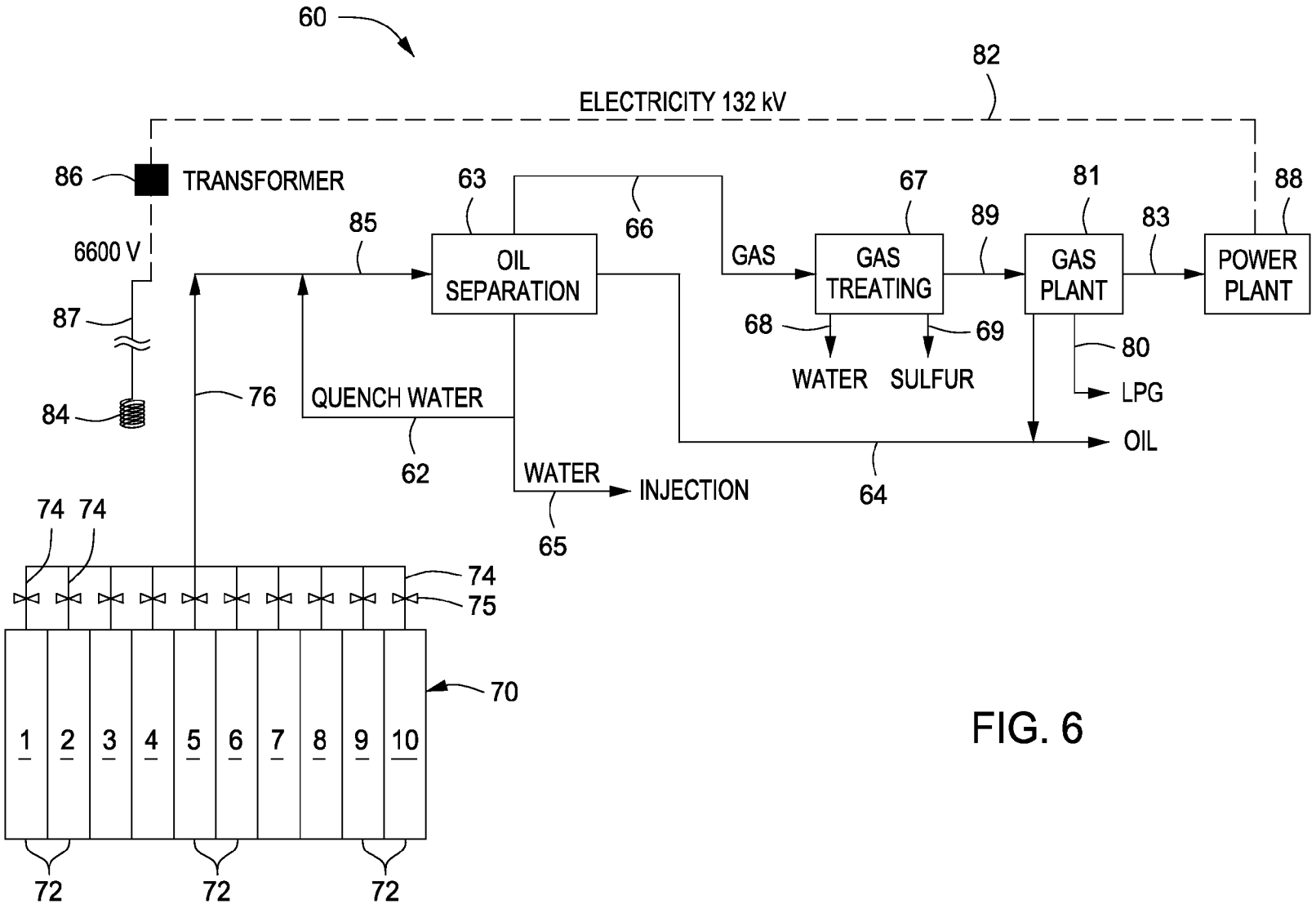
FIG. 6 is a diagram illustrating a hydrocarbon development area. The development area has been subdivided. A process flow diagram for a surface processing facility is shown at the development area.

In the arrangement of FIG. 6, the hydrocarbon development area 70 has been subdivided into a plurality of production areas 72. The production areas 72 are individually numbered "1" through "10." These numbers "1" through "10" correlate to Times in which a portion of the development area will incrementally undergo heating and production. Thus, for example, production area "1" will be heated and produced at a first Time, production area "2" will be heated and produced at a second Time, and so on. These incremental Times may be spaced apart as discussed above. Moreover, the production during these Times will overlap so that a combined gas stream from the production areas 72 having an averaged compositional range may be obtained.

Each production area 72 has a plurality of heater wells and a plurality of production wells. These wells are not indicated individually in FIG. 6. However, it is understood that the number and arrangement of heater wells and production wells within the respective production areas 72 is a matter of designer's choice for the field operator, guided by the goal of maintaining a substantially constant gas composition and/or Wobbe Index for the ultimate combined gas stream.

Each production area 72 produces production fluids 85 at its designated Time. Production flowlines 74 carry the production fluids 85 from the individual production areas 72 to the main production line 76 and to the production fluids processing facility 60. Valves 75 are provided in flowlines 74 to control production and flow rates. Sensors or gauges (not shown) may be provided adjacent to valves 75 to monitor flow rates.

The controlling step 740 of method 700 may be performed by controlling startup Times in the production areas 72. By controlling when the production areas 72 are brought on line, an averaging effect is created which provides for a more consistent range of compositions, particularly for the gaseous $CO_2$ and $H_2$, components which tend to have fractions that vary substantially over time. Alternatively, the controlling step 740 may be performed by controlling production rates at individual production wells or groups of wells within a production area 72. The controlling step 740 may alternatively be performed by adjusting valves 75 or other valves (not shown). Production rates may be adjusted from selected wells or selected production areas 72 in response to data received as a result of monitoring. Thus, if it appears for example that the hydrogen content of the cumulative gas composition 66 is too high, then flow rate from the more mature sections could be reduced.

The production fluids 85 are produced from a subsurface formation that is part of the hydrocarbon development area 70. The subsurface formation 84 may be any subsurface formation having organic-rich rock formation. The organic-rich rock formation may be, for example, a heavy hydrocarbon formation or a solid hydrocarbon formation. Particular examples of such formations may include an oil shale formation, a tar sands formation or a coal formation. Particular formation hydrocarbons present in such formations may include oil shale, kerogen, coal, and/or bitumen.

The production fluids 85 may include any of the produced fluids discussed herein. Production fluids 85 typically contain water, noncondensable hydrocarbon alkane species (e.g., methane, ethane, propane, n-butane, isobutane), noncondensable hydrocarbon alkene species (e.g., ethene, propene), condensable hydrocarbon species composed of (alkanes, olefins, aromatics, and polyaromatics among others), $CO_2$, CO, $H_2$, $H_2S$, and $NH_3$. Together the noncondensable and condensable fluids are transported from the individual flowlines 74 to the surface facility 60 through the main production line 76.

The controlling step 740 of method 700 may also be performed by monitoring and adjusting the components within the production fluids 76 at the surface facility 60. In this respect, the components in the production fluids 85 are separated in the surface processing facility 60. A process flow diagram is provided in connection with the surface processing facility 60 to demonstrate treatment of the production fluids 85.

Processing may involve quenching produced fluids to a temperature below 300° F., 200° F., or even 100° F. Quenching is shown at 62. Next, the separation process begins. More specifically, the condensable components of the production fluids 85 are separated from the noncondensable components. The condensable components include oil 64 and water 65, while the noncondensable components represent gases 66. Separation is done in the illustrative processing facility 60 in an oil separator 63.

After separation, the noncondensable components 66 are treated in a gas treating unit 67. The purpose is to remove additional water 68 as well as sulfur species including, for example, hydrogen sulfide. Removal of hydrogen sulfide or other sulfur-containing compounds from the gas stream 66 produces a rich $H_2S$ stream 69. The rich $H_2S$ stream 69 may be further processed in, for example, a sulfur recovery plant (not shown). Alternatively, the rich $H_2S$ stream 69 may be injected into a coal seam, a deep aquifer, a substantially depleted fractured tight gas zone, a substantially depleted oil shale zone, an oil shale zone depleted of sodium minerals, or combinations thereof as part of an acid gas injection process.

Removal of hydrogen sulfide or other sulfur-containing compounds creates a sweetened gas stream 89. The gas treating unit 67 may remove at least a portion of the sulfur containing compounds present in the gas 66 so that the sweetened gas stream 89 has less than 5 mol. % of sulfur containing compounds. Alternatively, the sulfur containing compounds present in the sweetened gas stream 89 may be reduced so that the sweetened gas stream 89 has less than 1 mol. % or less than 1,000 ppm of sulfur containing compounds. Removal of hydrogen sulfide or other sulfur-containing compounds should reduce or prevent the formation of sulfur oxides (e.g., $SO_2$) which are environmentally regulated compounds.

Preferably, the gas 66 representing the noncondensable components is further treated to remove a portion of the heavier components from the sweetened gas stream 89. Heavier components may include propane and butane. This separation is conducted in a gas plant 81 to form liquid petroleum gas (LPG) 80 for sale. A separated combined gas turbine feed stream is thus provided at 83.

In accordance with certain methods herein, the gas turbine feed stream 83 is also used to generate electrical power 82. The gas turbine feed steam 83 is sent to a power plant 88. For purposes of the present disclosure, the gas turbine feed stream 83 represents the combined gas stream 730 from method 700, and the power plant 88 contains the gas turbine from step 750. However, it is understood that the combined gas stream 730 may be a result of separation to produce gas stream 66. Moreover, the present inventions are not limited by the manner in which the gas turbine feed stream 83 is acquired unless so stated in a particular claim.

The electrical power 82 may be used as an energy source for heating a subsurface formation through any of the methods described herein. For example, the electrical power 82 may be fed at a high voltage, for example 132 kV, to a transformer 86 and let down to a lower voltage, for example 6,600 V, before being fed to electrical resistance heater elements 84 located in heater wells, such as heater well 87 completed in the subsurface formation. In this way a portion of the power required to heat the subsurface formation may be generated from the non-condensable portion of the produced fluids 85. In one embodiment, the generated electricity accounts for greater than 60 percent of the heat used in heating the organic-rich rock formation. In alternate embodiments, the generated electricity accounts for greater than 70, 80, or 90 percent of the heat used in heating the organic-rich rock formation. Some of the generated electricity may be sold to a third party, including for example, an electric utility. Some embodiments may include buying electricity from an electricity supplier at selected off-peak demand times to satisfy power needs for resistive heating elements 84.

The methods may in some embodiments also utilize heating methods other than electrical resistance heating methods. In such cases a portion of the gas stream may be combusted in a process furnace to heat a process fluid. The heated process fluid or a derivative thereof may then be used to heat the organic-rich rock formation. Alternatively, the heated process fluid may be used as a heat transfer fluid in heating a separate fluid that is used to heat the organic-rich rock formation.

In some embodiments of the processes herein, either the production fluids 85, the non-condensable components 66 or the gas turbine feed stream 83 may be monitored to determine the condition of the gas stream. For example, the gas turbine feed stream may 83 be monitored for one or more properties. In one embodiment, the gas stream is monitored prior to substantial combustion of the gas stream in the combustor of a gas turbine. Exemplary properties that may be monitored may include one or more properties selected from gas composition, temperature, heating value, specific gravity, Wobbe Index, Modified Wobbe Index, dew point, flammability limit, flame velocity, and combinations thereof.

As a specific example, the composition of the gas turbine feed stream 83 from the various development areas 72 may be monitored for inert or high heating value component content. For example, if the content of high heating value component gases is too high, this may be an indication that flow rate from a particular production area should be reduced. Alternatively, if the content of an inert gas component like $CO_2$ is too low, this may be an indication that flow rate from a particular production area should be increased. One or more additional wells may be brought on line or taken off line in response to data received as a result of monitoring in order to adjust $CO_2$ or other high heating value component content. Alternatively, a gas composition may be altered by blending the gas turbine feed stream 83 with a designated, pre-mixed gas reserve.

In response to monitoring, the composition of the gas turbine feed stream 83 may be modified by adding or blending gas from a separate gas reserve (not shown) at the surface. The gas reserve may comprise one or more of $C_2$ and higher hydrocarbons, $C_3$ and higher hydrocarbons, carbon dioxide, inert gases such as hydrogen, ethane, ethylene, propane, and combinations thereof The gas reserve may be from a source other than production fluids. The addition of such components to the gas turbine feed stream 83 may be useful in increasing the flame speed of the gas turbine feed stream 83, adjusting the burn rate of the feed stream 83, stabilizing combustion in the gas turbine (which is part of power plant 88), or combinations thereof.

In some embodiments of the invention, the composition of the gas turbine feed stream 83 may be altered in order to control one or more operating parameters of the gas stream. This could be done, for instance, at the gas treating facility 67. In one embodiment, the composition of the gas turbine feed stream 83 may be adjusted through blending a pre-blended gas reserve with the gas streams 66 or 89. The gas reserve may include methane or a mixture of gaseous hydrocarbons, including a blended gas stream from a source other than the production fluids 76. In some applications, altering the composition of the gas stream includes adding hydrogen, methane, ethane, ethylene, carbon dioxide, or combinations thereof to the separated gas stream 66, the sweetened gas stream 89, or the processed gas stream 83. The addition of such components may be useful in increasing the flame speed of the gas stream, adjusting the burn rate of the gas stream, stabilizing combustion in the gas turbine, or combinations thereof.

In further embodiments, the composition of the processed gas stream 83 may be altered by reforming at least a portion of the methane in the gas stream 66 to generate hydrogen. This may be particularly useful where the gaseous feed 83 to a gas turbine combustor in the power plant 88 contains significant $CO_2$ and therefore requires additional hydrogen in order to maintain a substantially constant flame speed in the combustor of the gas turbine. This too could be done, for instance, at the gas treating facility 67. In some embodiments, other hydrocarbon compounds, for example ethane and/or propane, may also be reformed together with the methane. The hydrogen gas content of the gas turbine feed may be increased by different reforming configurations. In one embodiment, at least a portion of the methane is removed from the sweetened gas stream 89 prior to the reforming. The removed methane is reformed in separate processing facilities to generate hydrogen gas, and the generated hydrogen gas is combined with the processed gas stream 89 prior to passing the gas stream 89 to the gas turbine. Alternatively, at least a portion of the methane is reformed on line while present in the gas stream without the need to remove the methane and generate hydrogen gas in separate reforming facilities. In either case, the portion of methane reformed into hydrogen may be controlled to maintain a chosen operating parameter, including for example a substantially constant Wobbe Index over time.

In connection with various processes herein, the composition of the combined gas stream 83 may alternatively be altered by adjusting the pressure or temperature of one or more oil-gas separators 63 located in the surface processing facilities 60. Such a pressure or temperature adjustment will thereby change the composition of the off-gas 66 from a separator 63. The processing facilities 60 may include several stages of oil-gas separators, typically at successively lower pressures. For a series of separators at similar temperatures, the off-gas from the initial higher pressure separators will be lighter (e.g., richer in methane and hydrogen) than the off-gas from the later low pressure separators (e.g., richer in propane and carbon dioxide). Thus, the gas turbine feed stream 83 may be comprised of a blend of at least a first separator gas from a first oil-gas separator and a second separator gas from a second oil-gas separator. Further, the method may include altering the composition of the gas stream by adjusting the relative amounts of the first separator gas and the second separator gas making up the first gas stream.

The composition of the gas turbine feed stream 83 may also be altered through use of vapor-liquid extraction techniques. This too could be done, for instance, at the gas treating facility 67 or at the gas plant 81. In such techniques a gas stream may be contacted with a liquid in order to allow for mass transfer of certain components in the gas stream with preferential solubility in the liquid stream, typically heavier components, to move from the gas stream and dissolve in the liquid stream, thereby altering the composition of the resulting gas stream 83. Contacting may be used, for example, to increase $H_2$ content of a gas stream by reducing the amount of heavier components. There are various ways known in the art for conducting vapor-liquid extraction including, for example, employing stripping trays or packed columns in chemical or physical adsorption processes to carry out contacting the liquid stream with the vapor or gas stream. Typically, the gas stream is cooled before contacting to improve solubility. Pressure may also be increased to improve solubility.

It may be desirable that the composition of the gas turbine feed stream 83 be suitable to meet a targeted $NO_x$ concentration in the gas turbine exhaust stream. $NO_x$ formation is known to be affected by flame temperature and residence time of the nitrogen gas ($N_2$) in the combustion zone. Thus $NO_x$ generation can be reduced by decreasing the combustion zone temperature and/or the amount of $N_2$ present in the combustion zone. In one embodiment, the composition of the gas turbine feed stream 83 may be altered by reducing the nitrogen gas content of the gas stream. In one embodiment, the composition of the gas turbine feed stream 83 may be altered by increasing the inert gas content of the gas stream to reduce $NO_x$ generation in the gas turbine. In such an embodiment, the inert gas concentration may be increased by increasing the $CO_2$ content of the combined gas stream 83. In such an embodiment the inert gas content of the feed stream 83 that is passed to the gas turbine may be between 10-60 mol. %.

Additional $NO_x$ reduction technologies may be used instead of or in combination with the previously discussed methods. In certain instances, the previously discussed technologies strive to reduce the generation of $NO_x$, however, there are additional methods useful in reducing the $NO_x$ present in a gas turbine exhaust stream. For example, generated $NO_x$ may be removed from a gas turbine exhaust stream by contacting the gas turbine exhaust stream with an ammonia ($NH_3$) treatment stream. The ammonia treatment stream may optionally be obtained from a stream derived completely or partially from the production fluid. One embodiment includes separating $NH_3$ from the production fluids to form a $NH_3$ treatment stream and injecting the $NH_3$ treatment stream into the gas turbine exhaust stream, thereby converting a portion of $NO_x$ components in the gas turbine exhaust stream to $N_2$. In some embodiments, the $NH_3$ treatment stream has a composition of greater than 50 mol. % $NH_3$. In alternate embodiments, the $NH_3$ treatment stream has a composition of greater than 90 mol. % $NH_3$.

Figure 12:
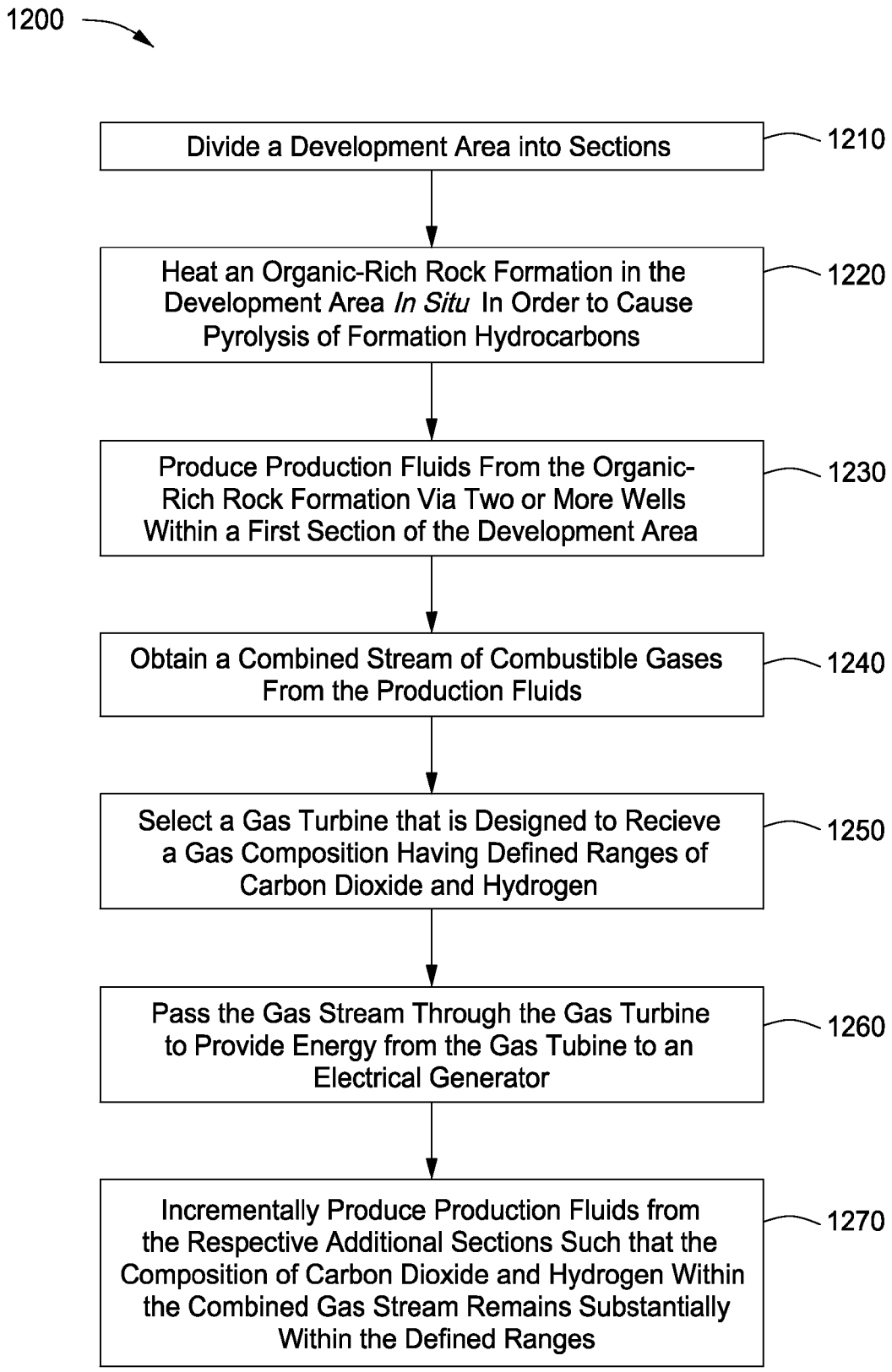
FIG. 12 presents a flowchart demonstrating steps, in one embodiment, for utilizing gas produced from an in situ conversion process.

A method 1200 for utilizing gas produced from an in situ conversion process is also provided herein. The method 1200, in one embodiment, is shown in FIG. 12. The method 1200 includes dividing the development area into production areas or sections. This is indicated at Box 1210. Each section has two or more production wells.

The method 1200 also includes heating an organic-rich rock formation in the development area, in situ. This step is shown at Box 1220. As with step 710 of FIG. 7, the purpose of the heating step 1220 is to cause pyrolysis of formation hydrocarbons in the formation. For example, the hydrocarbons may by solid hydrocarbons comprising kerogen.

The pyrolysis of formation hydrocarbons generates hydrocarbon fluids. The hydrocarbon fluids are produced as production fluids from the organic-rich rock formation. This step is shown via Box 1230. The produced fluids have been at least partially generated as a result of pyrolysis of the formation hydrocarbons located in the organic-rich rock formation. Production 1230 initially occurs through the two or more production wells within a first of the sections.

The production fluids are produced in one example from pyrolyzed or converted kerogen. As such, the production fluids will include both condensable and non-condensable components. The non-condensable components are ultimately separated from the condensable components at a surface processing facility (such as facility 60) to form a gas stream. The non-condensable component includes both hydrocarbon fluids and non-hydrocarbon fluids such as carbon dioxide and hydrogen.

In addition, the method 1200 includes producing production fluids from the organic-rich rock formation within respective additional sections. Each additional section within the development area has two or more production wells which also produce non-condensable components. Production within the additional sections is brought in incrementally as described above. This is provided in Box 1270.

The method 1200 comprises a next step of obtaining a combined stream of combustible gases from the production fluids. This step is shown at Box 1240. In performing this step 1240, non-condensable hydrocarbon fluids from the first and from the additional sections are commingled. Step 1240 may be done by combining the production fluids from the pertinent sections in the main production line 76, delivering the fluids to the surface processing facility 60, and then separating the hydrocarbon fluids from steps 1230 and 1270 at the surface facility. Alternatively, step 1240 may be performed by separating the condensable and the non-condensable components of the production fluids from each section first, and then commingling the non-condensable components.

The method 1200 also comprises selecting a gas turbine. This is shown in Box 1250. The gas turbine is designed to receive the combined gas stream having a composition of carbon dioxide and hydrogen within defined ranges. For example, the cumulative mol. % of carbon dioxide may vary from 30% to 50%, while the cumulative mol. % of hydrogen may vary from between 20% to 40%. The optimal ranges will be production- and turbine-specific.

The method 1200 further comprises passing the gas stream through the gas turbine to provide energy from the gas tubine to an electrical generator. This is seen at Box 1260. In one aspect, the gas stream is passed through through the gas turbine to form a gas turbine exhaust stream that feeds the generator. The electrical generator provides electricity to downhole heating elements. It may also provide electricity to support surface production or processing facilities.

Returning to Box 1270, production from the first and respective additional sections is structured and controlled such that the concentrations of carbon dioxide and hydrogen species within the combined gas stream remain substantially within the defined ranges for the gas turbine. This step 1270 may include defining increments of time between start-up for production of the respective additional sections. This step 1270 may also include selecting the number of wells to be produced within each section and manners of completion.

In one aspect, the method 1200 further includes adjusting the production rate of hydrocarbon fluids being produced from a first section to change the mol. percentages of carbon dioxide and hydrogen within the gas stream. In addition, the method 1200 may further include simultaneously producing hydrocarbon fluids from the first section, a second section and a third section of the development area at different production rates. The production rates are adjusted periodically to maintain mol. percentages of carbon dioxide and hydrogen within the gas stream and within the desired ranges. In addition, the start-up times for production wells within the second section and the third section may be adjusted to further maintain mol. percentages of carbon dioxide and hydrogen within the desired ranges.

The method may also include generating electricity from a gas turbine. Optionally, the gas turbine is part of a combined cycle power facility. In such an embodiment, the method may include, after passing the combined gas stream through a gas turbine and combusting the gas stream, feeding the combusted gas turbine exhaust stream to a steam boiler, thereby providing heat to the steam boiler for producing steam in the steam boiler. Depending on the generation method, the steam may be generated as a low, medium or high pressure steam stream. A low pressure steam is generally at a pressure below 150 psig; a medium pressure steam is generally in the range of 150-250 psig; and a high pressure steam is generally over 250 psig.

In one embodiment at least a portion of the steam, particularly where a high pressure steam is used, is delivered to the organic-rich rock formation to assist in heating the formation. Lower pressure steam, including in some cases, for example, a medium pressure steam, may also be useful in formation heating through injection. In some embodiments, particularly where the steam is a steam turbine exhaust stream of a low or medium pressure, the steam stream may be utilized for process heat in processing of the production fluids or derivatives thereof. Exemplary processes where steam may be useful include (1) in the regeneration of an absorber fluid for heavy hydrocarbons or acid gases, (2) in a reboiler of a distillation system, or (3) in regeneration of a solid adsorption system for acid gas and trace contaminant removal. Further examples include membrane separation, cryogenic distillation, and pressure swing adsorption. Alternatively, the first gas turbine exhaust stream itself may be utilized for process heat in the processing of the production fluids or derivatives thereof.

In a combined cycle operation, the generated steam may then be fed to a steam turbine that is configured to provide energy to an electrical generator. The electrical generator may be the same electrical generator used by the gas turbine or a different electrical generator. In different embodiments, the steam boiler may be a supplementally fired waste heat boiler or may not include a supplemental boiler feed stream.

Figure 13:
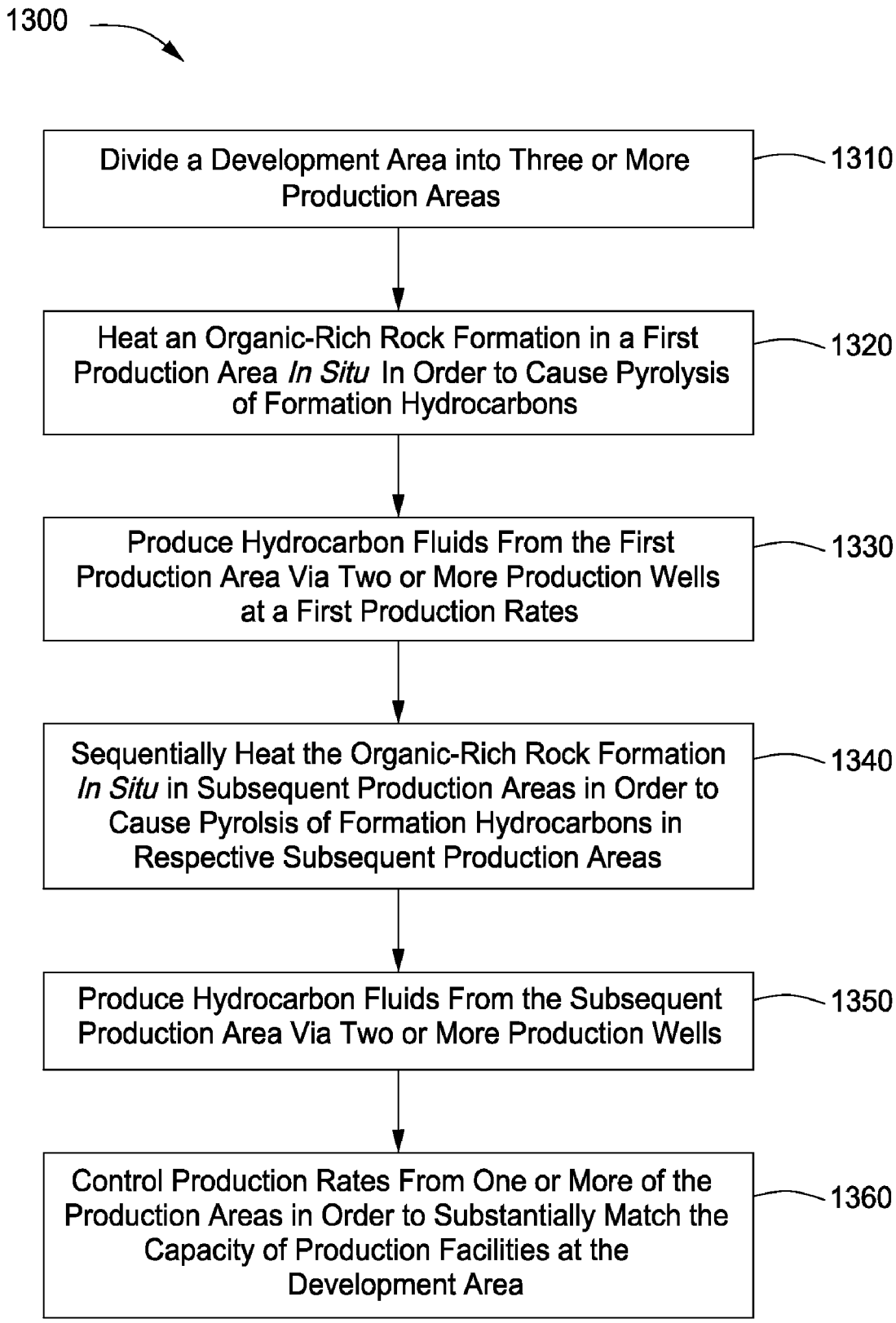
FIG. 13 is a flowchart demonstrating steps, in one embodiment, for optimizing processing facilities for a hydrocarbon development area.

Another method is provided herein for producing hydrocarbon fluids from an organic-rich rock formation in a shale oil development area. The method 1300, in one embodiment, is shown in the flowchart of FIG. 13.

In one aspect, the method 1300 includes dividing the development area into three or more production areas. This is shown at Box 1310. Each production area preferably has two or more production wells.

The method 1300 also includes heating the organic-rich rock formation in situ in a first production area. This is indicated at Box 1320. The purpose of heating is to cause pyrolysis of formation hydrocarbons in the first production area.

Also, the method 1300 comprises producing hydrocarbon fluids from the first production area. This is provided at Box 1330. Production is accomplished through the two or more production wells at a first production rate.

In addition, the method 1300 includes sequentially heating the organic-rich rock formation in situ in subsequent production areas in order to cause pyrolysis of formation hydrocarbons in the respective subsequent production areas. This is provided at Box 1340.

Also, the method 1300 includes producing hydrocarbon fluids from the subsequent production areas via the corresponding two or more production wells. This is represented at Box 1350. In one aspect, producing hydrocarbon fluids from the subsequent production areas comprises spacing the start-ups of production between the subsequent production areas by at least three months. The spacing need not be in the same time increments between each production area.

The method 1300 further includes controlling production rates from one or more of the production areas. This is indicated at Box 1360. Controlling production rates may be done by controlling production rates from individual wells within a selected subsequent production area, or by controlling rates from the respective production areas. The purpose is to substantially match the capacity of processing facilities at the development area. In this respect, if the processing facilities are too large, then the facilities have been over-built. This constitutes a waste of time and money. On the other hand, if the processing facilities are too small to handle the production from the development area, this represents a lost opportunity.

The above-described processes may be of merit in connection with the recovery of hydrocarbons in the Piceance Basin of Colorado. Some have estimated that in some oil shale deposits of the Western United States, up to 1 million barrels of oil may be recoverable per surface acre. One study has estimated the oil shale resource within the nahcolite-bearing portions of the oil shale formations of the Piceance Basin to be 400 billion barrels of shale oil in place. Overall, up to 1 trillion barrels of shale oil may exist in the Piceance Basin alone.

Certain features of the present invention are described in terms of a set of numerical upper limits and a set of numerical lower limits. It should be appreciated that ranges formed by any combination of these limits are within the scope of the invention unless otherwise indicated. Although some of the dependent claims have single dependencies in accordance with U.S. practice, each of the features in any of such dependent claims can be combined with each of the features of one or more of the other dependent claims dependent upon the same independent claim or claims.

While it will be apparent that the invention herein described is well calculated to achieve the benefits and advantages set forth above, it will be appreciated that the invention is susceptible to modification, variation and change without departing from the spirit thereof.

What is claimed is:

1. A method for producing hydrocarbon fluids from an organic-rich rock formation to a surface facility, comprising:

heating the organic-rich rock formation in situ in order to cause pyrolysis of formation hydrocarbons;

producing production fluids from the organic-rich rock formation via two or more wells, each of which two or more wells produces fluids which:

have been at least partially generated as a result of pyrolysis of the formation hydrocarbons located in the organic-rich rock formation, and comprise noncondensable gases having a Wobbe Index value which varies at a rate of more than 5% over a period of time;

obtaining a combined gas stream from the production fluids, the combined gas stream comprising combustible hydrocarbon fluids; and controlling production from the two or more wells such that a combination of the production fluids from the two or more wells results in the combined gas stream having a Wobbe Index value that varies at a rate of less than 5% over the period of time.

2. The method of claim 1, wherein the formation hydrocarbons comprise heavy hydrocarbons or solid hydrocarbons.

3. The method of claim 1, wherein the organic-rich rock formation is an oil shale formation.

4. The method of claim 3, wherein the period of time is at least six months.

5. The method of claim 3, wherein the Wobbe Index value constitutes a daily average or a weekly average of Wobbe Index assessments.

6. The method of claim 3, wherein controlling production comprises controlling start-up times of the two or more wells.

7. The method of claim 6, wherein the two or more wells comprises at least a first group of wells, a second group of wells and a third group of wells.

8. The method of claim 7, wherein the first group of wells comprises a different number of wells than the second group of wells or the third group of wells.

9. The method of claim 7, wherein the first group of wells begins to produce at a first start-up time, the second group of wells begins to produce at a second later start-up time, and the third group of wells begins to produce at yet a third later start-up time.

10. The method of claim 9, wherein:

a time between the first start-up time and the second start-up time represents a first increment;

a time between the second start-up time and the third start-up time represents a second increment; and the first increment and the second increment are different lengths of time.

11. The method of claim 7, wherein each of the wells in the first group of wells and the second group of wells is heated over the same period of time before the respective first and second start-up times begin.

12. The method of claim 7, wherein the first group of wells is heated for a first length of time before producing production fluids from the first group of wells begins, and the second group of wells is heated for a second length of time that is greater than the first length of time before producing production fluids from the second group of wells begins.

13. The method of claim 6, wherein controlling start-up times comprises performing a computer simulation in order to assess the impact of production from the two or more wells on a composition of the combined gas stream over the period of time.

14. The method of claim 6, further comprising:

monitoring the composition of the non-condensable gases in the production fluids of the two or more wells; and wherein controlling production from the two or more wells comprises adjusting the composition of the combined gas stream by adding selected one or more inert gas species to the combined gas stream from a gas reserve.

15. The method of claim 3, wherein controlling production comprises controlling production rates from the two or more wells.

16. The method of claim 3, wherein the surface facility comprises a gas turbine; and the method further comprises passing the combined gas stream through the gas turbine to form a gas turbine exhaust stream, the gas turbine being configured to provide energy to an electrical generator.

17. The method of claim 16, further comprising:

adjusting the composition of the combined gas stream before it is passed through the gas turbine by (i) adding methane from a gas reserve, (ii) adding carbon dioxide from a gas reserve, (iii) removing carbon dioxide, (iv) adding hydrogen from a gas reserve, (v) removing hydrogen, (vi) removing ethane, (vii) removing propane, or (viii) combinations thereof.

18. The method of claim 16, further comprising:

adjusting the composition of the combined gas stream before it is passed through the gas turbine by adding any of carbon dioxide, hydrogen, ethane, ethylene, propane, or combinations thereof in order to increase flame speed, adjust burn rate, or stabilize combustion of the combined gas stream.

19. The method of claim 16, wherein:

the heating step comprises heating the organic-rich rock formation through use of electrical resistance heaters; and the electrical resistance heaters are powered at least partially by the electrical generator.

20. The method of claim 16, wherein the combined gas stream composition is sufficient to meet a targeted $NO_x$ concentration in the gas turbine exhaust stream.

21. The method of claim 3, further comprising:

monitoring the composition of the non-condensable gases in the production fluids of the two or more wells; and wherein controlling production from the two or more wells comprises adjusting production rates in response to data received as a result of the monitoring.

22. The method of claim 3, wherein upon controlling production from the two or more wells:

a concentration of $CO_2$ in the combined gas stream generally ranges from between 25 and 50 mol. %; and a concentration of $H_2$ in the combined gas stream generally ranges from between 20 and 40 mol. %.

23. A method for utilizing gas produced from an in situ conversion process in a hydrocarbon development area, comprising:

operating in a development area in which production fluids are to be produced as a result of pyrolysis of formation hydrocarbons located in an organic-rich formation within the development area;

dividing the development area into sections, each respective section having two or more production wells;

selecting a gas turbine, the gas turbine being designed to receive a combustible gas stream having concentrations of carbon dioxide and hydrogen within defined ranges, and the gas turbine being configured to provide energy to an electrical generator or to a steam boiler;

incrementally producing production fluids from the organic-rich rock formation within the respective sections over a period of time, wherein the production fluids are delivered to a surface processing facility; and obtaining a combined gas stream from the production fluids, the combined gas stream having concentrations of carbon dioxide and hydrogen that remain substantially within the defined ranges for the gas turbine over the period of time, and the combined gas stream further comprising combustible hydrocarbons.

24. The method of claim 23, wherein the combined gas stream is obtained by:

separating the respective production fluids at a surface facility into liquid streams and gas streams; and combining the gas streams separated from the respective production fluids to form the combined gas stream.

25. The method of claim 23, wherein the combined gas stream is obtained by:

commingling the respective production fluids; and separating the commingled production fluids at a surface facility into at least a combined liquid stream and a combined gas stream.

26. The method of claim 23, wherein:

the formation hydrocarbons comprise oil shale; and the production fluids comprise shale oil.

27. The method of claim 26, further comprising:

passing the combined gas stream through the gas turbine to form a gas turbine exhaust stream.

28. The method of claim 27, wherein:

the combined gas stream comprises hydrogen sulfide; and the method further comprises removing at least a portion of the hydrogen sulfide from the combined gas stream before it is passed through the gas turbine.

29. The method of claim 27, further comprising:

adjusting the composition of the combined gas stream before it is passed through the gas turbine by (i) adding methane from a gas reserve, (ii) adding carbon dioxide from a gas reserve, (iii) removing carbon dioxide, (iv) adding hydrogen from a gas reserve, (v) removing hydrogen, (vi) removing ethane, (vii) removing propane, or (viii) combinations thereof.

30. The method of claim 26, further comprising:

adjusting the production rate of the production fluids being produced from at least one section of the development area to maintain the concentrations of carbon dioxide and hydrogen within the combined gas stream within the defined ranges.

31. The method of claim 26, further comprising:

simultaneously producing production fluids from a first section, a second section and a third section of the development area at different production rates; and adjusting the production rate of production fluids being produced from the first section, the second section and the third section over a period of time to maintain the concentrations of carbon dioxide and hydrogen within the defined ranges.

32. The method of claim 31, wherein:

the concentration of carbon dioxide in the combined gas stream generally ranges from between 25 and 50 mol. %; and the concentration of hydrogen in the combined gas stream generally ranges from between 20 and 40 mol. %.

33. The method of claim 31, further comprising:

selecting start-up times for production wells within the second section and the third section to further maintain the concentrations of carbon dioxide and hydrogen within the defined ranges.

34. A method for producing hydrocarbon fluids from an organic-rich rock formation in a shale oil development area, comprising:

dividing the development area into a plurality of production areas;

heating the organic-rich rock formation in situ in a first production area of the development area in order to cause pyrolysis of formation hydrocarbons;

producing hydrocarbon fluids from the first production area via two or more production wells at a first production rate;

sequentially heating the organic-rich rock formation in situ in respective subsequent production areas in order to cause pyrolysis of formation hydrocarbons in the respective subsequent production areas;

incrementally producing hydrocarbon fluids from the respective subsequent production areas, each subsequent production area comprising two or more production wells;

obtaining a gas stream from the hydrocarbon fluids; and controlling production rates from one or more of the subsequent production areas in order to substantially match the capacity of fluids processing facilities at the development area and to maintain a substantially constant concentration of carbon dioxide or hydrogen in the gas stream.

35. The method of claim 34, wherein matching the capacity of processing facilities means maintaining a substantially constant hydrocarbon production rate from the development area.

36. The method of claim 34, wherein incrementally producing hydrocarbon fluids from the respective subsequent production areas comprises spacing start-up of production between the respective subsequent production areas by at least three months.

37. The method of claim 34, wherein controlling production rates comprises controlling production rates from individual wells within one or more selected subsequent production areas.

38. The method of claim 34, wherein:

the surface facility comprises a gas turbine configured to provide energy to an electrical generator; and the method further comprises passing the gas stream through the gas turbine to form a gas turbine exhaust stream.

39. The method of claim 34, wherein incrementally producing hydrocarbon fluids comprises controlling start-up times of the two or more production wells in the respective subsequent production areas.

40. The method of claim 39, wherein the start-up times are separated by at least six months.

* * * * *